US006549742B1

(12) United States Patent
Chigono et al.

(10) Patent No.: US 6,549,742 B1
(45) Date of Patent: Apr. 15, 2003

(54) CHARGING APPARATUS EMPLOYING CHARGING PARTICLES, AND IMAGE FORMING APPARATUS EMPLOYING SUCH A CHARGING APPARATUS

(75) Inventors: Yasunori Chigono, Susono (JP); Harumi Ishiyama, Numazu (JP); Jun Hirabayashi, Numazu (JP); Norio Takahashi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/983,688

(22) Filed: Oct. 25, 2001

(30) Foreign Application Priority Data

Oct. 25, 2000 (JP) ..... 2000-325610
Jan. 9, 2001 (JP) ..... 2001-001630

(51) Int. Cl.[7] ..... G03G 15/02
(52) U.S. Cl. ..... 399/174; 361/225; 399/176
(58) Field of Search ..... 399/174, 175, 399/176, 149, 150; 361/221, 225; 430/902, 105, 108.1

(56) References Cited

U.S. PATENT DOCUMENTS 5,666,192 A 9/1997 Mashimo et al. ..... 399/174
5,740,008 A * 4/1998 Masuda et al. ..... 361/225
6,061,539 A 5/2000 Ishiyama et al. ..... 399/175
6,081,681 A 6/2000 Nagase et al. ..... 399/174
6,128,456 A 10/2000 Chigono et al. ..... 399/176
6,134,407 A 10/2000 Ishiyama et al. ..... 399/174
6,157,800 A 12/2000 Ishiyama et al. ..... 399/175
6,301,455 B1 10/2001 Ishiyama et al. ..... 399/102

* cited by examiner

*Primary Examiner*—Sophia S. Chen
(74) *Attorney, Agent, or Firm*—Fitzpatrick, Cella, Harper & Scinto

(57) ABSTRACT

A charging device for electrically charging a member to be charged includes charging particles including electroconductive particles having particles diameters in the range of 10 nm–10 $\mu$m; and a charging particles carrying member, which has a nip with the member to be charged forming a nip with said member to be charged, for carrying the charging particle to the nip; wherein said charging particles have resistances in the range of $10^{-1}$–$10^{12}$ Ωcm; wherein (an amount, per unit area, of said charging particles carried by said charging particles carrying member)/(an average roughness Ra of a surface of said charging particles carrying member) is in the range of 0.005–1 mg/cm$^2$/$\mu$m.

24 Claims, 16 Drawing Sheets

(a)

$$SF\text{-}1 = \frac{(MXLNG)^2}{AREA} \times \frac{\pi}{4} \times 100$$

(b)

$$SF\text{-}2 = \frac{(PERI)^2}{AREA} \times \frac{1}{4\pi} \times 100$$

CHARGING APPARATUS EMPLOYING CHARGING PARTICLES, AND IMAGE FORMING APPARATUS EMPLOYING SUCH A CHARGING APPARATUS

FIELD OF THE INVENTION AND RELATED ART

The present invention relates to a charging apparatus for charging an object. More precisely, it relates to a contact type charging apparatus (contact charging apparatus) which charges the surface of an object by placing a charging member in contact with the object.

The present invention also relates to an image recording apparatus (image forming apparatus), such as a copying machine, a printer, or the like, which employs a charging apparatus of the above described type as a means for charging an image bearing member of the image recording apparatus.

In a conventional contact charging apparatus, the surface of an object to be charged, for example, the surface of an image bearing member of an image forming apparatus, is charged to predetermined polarity and potential level by applying a predetermined charge bias to an electrically conductive member (contact type charging member, contact charging device) in the form of a roller (charge roller), a fur brush, a magnetic brush, a blade, or the like, while keeping the electrically conductive member in contact with the object to be charged.

All charging apparatuses which match the above description regarding a contact charging apparatus are roughly categorized as a contact charging apparatus. However, there are large differences in terms of charging mechanism (or charging principle) among the contact charging apparatuses. There are two types of contact charging mechanisms: (1) the charging mechanism based on electrical discharge, and (2) the charging mechanism based on direct charge injection. Which of the two types of charging mechanism is employed by a contact charging apparatus determines the characteristics of the contact charging apparatus. Thus, the charging principles and characteristics of the electrical discharge type charging mechanism and direction injection type charging mechanism will be described next.

(1) Charging Mechanism Based on Electrical Discharge

This is a charging mechanism which charges an object with the use of the products generated by the electrical discharge which occurs through the gap between a contact type charging member and the object to be charged.

An electrical discharge type charging system is characterized by an electrical discharge threshold value: there must be a certain amount of voltage difference between a contact type charging member and an object to be charged. More specifically, referring to FIG. 7, a voltage, the level of which is higher than the potential level of the object to be charged, needs to be applied to the contact type charging member, as is represented by Line A in FIG. 7. Further, in principle, it generates by-products, admitting that the amount of the by-products is drastically smaller than that generated by a corona type charging apparatus.

From the standpoint of safety regarding electrical discharge, a roller based charging method (roller charging apparatus), which employs an electrically conductive roller (charge roller) as an electrical discharge based contact type charging member is preferable and is widely in use. An electrical discharge type charge roller comprises a base layer and a surface layer. The base layer is in the form of a roller and is formed of rubber or foamed substance, which is electrically conductive, or the electrical resistance of which is in the medium range. The surface layer is high in electrical resistance and covers the base layer. Electrical discharge occurs through the gaps between the roller and the object to be charged, immediately adjacent to the contact (interface) between the roller and the object, which are several tens of micrometers wide. Therefore, in order to stabilize the electrical discharge, the outward surface of the surface layer is rendered very smooth; its roughness in terms of Ra is less than one micrometer. Further, it is rendered high in hardness.

In order to charge an object with the use of an electrical discharge type roller, the voltage to be applied to the roller must be relatively high. Therefore, if there is a pinhole (exposure of the base layer of the object to be charged, caused by the damage to the surface layer of the object) in the surface of the object to be charged, not only does voltage drop occurs at the point of the pinhole, but also in the immediate areas of the pinhole, causing the object to be charged to be improperly charged. Thus, in order to prevent the voltage drop, the surface resistance of the surface layer is made to be no less than $10^{11}$ ohm□.

(2) Direct Injection on Type Charging Mechanism

The direct injection type charging mechanism is a charging mechanism for charging the surface of an object to be charged, by directly injecting electrical charge into the object to be charged, from a contact type charging member, through the molecular level contact between the contact type charging member and the object to be charged. It is sometimes called a direct charging mechanism or an injection charging mechanism.

In this charging mechanism, that is, a direct injection type charging mechanism, the difference in potential level between a contact type charging member and an object to be charged is no more than several volts to several tens of volts. Line B in FIG. 7 represents the charging performance characteristic of a direct injection type charging mechanism (magnetic brush type charging apparatus). In this case, the potential level of the voltage applied to a charging member is equal to the potential level to which an object will be charged. Therefore, there is no difference in potential level between the charging member and the object to be charged, which causes electrical discharge. Also in this case, the voltage necessary for charging an object can be kept low in potential level.

As described above, a direct charging system as a charging mechanism is not accompanied by ion production, and therefore, it does not cause problems related to the byproducts of electrical discharge. In other words, a direct charging system is a superior charging system in terms of environmental safety, component deterioration, and power consumption.

Next, a charging apparatus employing a direct injection type charging mechanism will be described.

In a direct injection type charging mechanism, one of the essential factors which determine the charging performance of a direct injection type charging mechanism is the state of contact between a contact type charging member and an object to be charged. This state of contact means the number of contacts, in microscopic terms, the contact type charging member makes contact with the object to be charged, while the object is passing through a charging apparatus. Thus, it is required that not only does the contact type charging member have an extremely fine surface structure, but also it must have a sufficient amount of elasticity for keeping its surface in contact with the surface of the object.

As for the configuration of a contact type charging member employed by a direct injection type charging apparatus, an electrical discharge based charge roller or the like has been widely tried. However, the attempts to use an electrical discharge based charge roller for direct charge injection have been unsuccessful. This is due to the following fact. That is, in the case of a charge roller which has a hard and smooth surface, its surface seems to be perfectly in contact with the surface of an object to be charged, but, at a molecular level, that is, at a microscopic level, there is virtually no contact between the surfaces of the charge roller and the object to be charged.

As a presently proposed direct injection type charging mechanism, there is a particle based charging method which employs a magnetic brush.

(3) Particle Based Charging Method

From the standpoint of improvement in contact density, a charging method which employs electrically conductive particles (particle based charging method) is advantageous. The electrically conductive particle used for a particle based charging method hereinafter will be called "charging particle". As for an example of a charging particle, an electrically conductive magnetic particle may be listed as a typical one, and there have been made several proposals in which a magnetic brush type charging member is formed with the use of electrically conductive magnetic particles and a magnet.

FIG. 8 is a sectional view of a magnetic brush type charging apparatus 100, for showing the general structure thereof. A referential code 120 designates a magnetic brush type charging member, which comprises: a stationarily supported magnetic roll 122; a nonmagnetic and electrically conductive charge sleeve 121, which is rotationally and coaxially fitted around the magnetic roll 122; and a magnetic brush layer 124 (magnetic brush portion) formed on the peripheral surface of the charge sleeve 121 by adhering and holding electrically conductive magnetic particles C to the peripheral surface of the charge sleeve 121, with the use of the magnetic force of the magnetic roll 122 within the charge sleeve 121. A referential code 123 designates a casing, to which the magnetic brush type charging member 120 is attached, and in which a proper amount of electrically conductive magnetic particles C is stored. A referential code 125 designates a magnetic brush layer thickness regulating blade, with which the casing 123 is provided.

A referential code 1 designates an object to be charged, which in this embodiment is an electrophotographic photoconductive drum and is rotationally driven in the clockwise direction indicated by an arrow mark. In this magnetic brush type charging apparatus, the magnetic brush layer 124 of the magnetic brush type charging member 120 is placed in contact with the photoconductive drum 1 as an object to be charged, so that the width, in terms of the circumferential direction of the photoconductive drum 1, of the interface between the magnetic brush layer 124 and photoconductive drum 1 becomes a predetermined width. A referential code n designates the interface (charge nip) between the magnetic brush layer 124 and photoconductive drum 1.

More concretely, the charging sleeve 121 is a nonmagnetic and electrically conductive sleeve, which is 1.2 $\mu$m in average surface roughness Ra1 of its peripheral surface. 16 mm in external diameter, and approximately 220 mm in length.

The magnetic roll 122 is provided with four magnetic poles N1, N2, S1, and S2, which are 800 G in peak magnetic flux density at the surface of the charging sleeve in terms of the radius direction of the magnetic roll 122. It is stationarily supported so that the magnetic pole N1 opposes the photoconductive drum 1.

As the electrically conductive magnetic particles C as charging particles which form the magnetic brush layer), magnetic metallic particles, for example, ferrite particles or magnetite particles, or particles formed by agglutinating these magnetic metallic particles, or the like, are used. The magnetic metallic particles used as the charging particles are $1\times10^6$–$10^9$ ohm.cm in electrical resistance value, and 10–50 $\mu$m in average diameter.

The charging sleeve 121 is rotationally driven in the clockwise direction indicated by the arrow mark, as is the photoconductive drum 1. The magnetic brush layer 124 is moved with the charging sleeve 121 in the clockwise direction. As it is moved, it is regulated in thickness by the blade 125, and the thickness-regulated portion of the magnetic brush layer 124 makes contact with, and rubs, the peripheral surface of the photoconductive drum 1, in a contact charging nip n. The charging particles in the portion of the magnetic brush layer 124 which has passed through the charging nip n, are returned to the electrically conductive magnetic particle bin within the casing 123, from which they are recirculated.

As a predetermined charge bias is applied to the charging sleeve 121 from a charge bias application power source S1 while the peripheral surface of the photoconductive drum 1 is rubbed by the magnetic brush layer 124, electrical charge is directly injected into the peripheral surface of the photoconductive drum 1, in the charging nip n. As a result, the peripheral surface of the photoconductive drum 1 is uniformly charged to predetermined polarity and potential level.

To note the contact density of the electrically conductive magnetic particles of the magnetic brush layer 124 in the above described structure, when the average external diameter of the electrically conductive magnetic particles is approximately 30 $\mu$m, and the contact density is approximately $10^3$ point/mm$^2$, which provides good charging performance represented by the line B in FIG. 7.

Under the above described condition, the amount of the electrically conductive magnetic particles needs to be several hundreds of mg/cm$^2$ , and those particles held to the peripheral surface of the charging sleeve 121 form a 0.5–1.0 mm thick particle layer. In charge injection, it is required for a contact type charging member to contact an object to be charged, elastically, and densely in terms of the number of contacts. However, in the case of the magnetic brush type charging member 120, electrically conductive magnetic particles must be magnetically held to the peripheral surface of the magnetic brush type charging member 120. Therefore, the charging sleeve 121 as a particle bearing member must be a rigid member. Further, the flexibility of the contact type charging member must be provided by the magnetic brush layer formed of electrically conductive magnetic particles. Therefore, the magnetic brush layer must be proper in thickness and also proper in the amount of particle per unit area of the peripheral surface of the magnetic brush type charging member 120.

A charging particle based charging method is suitable for a toner recycling system. In a toner recycling system, waste toner particles (transfer residual toner particles) in an image recording apparatus of a transfer type are recycled for image formation. Therefore, not only is the toner supply more efficiently used, but also the space for a cleaning means container can be eliminated, making it possible to reduce apparatus size. In other words, a toner recycling system is an excellent system.

More specifically, the transfer residual toner particles are rendered reusable by being taken into a contact type charging member (given original amount of electrical charge), and are returned to a developing apparatus by way of an image bearing member, to be used again for development, or to be recovered for recycling. Thus, a charging apparatus used with a toner recycling system must be enabled to recover the transfer residual toner particles and recharge toner particles, in addition to being enabled to charge an image bearing member.

From the above described standpoint, the compatibility of a magnetic brush with a toner recycling system will be examined. A magnetic brush is characterized in that it is formed of magnetic particles, being therefore enabled to easily move or conform to the shape of an object to be charged, and also in that it is relatively large in specific surface area. Therefore, the mandatory functions of a toner recycling system, for example, recovering the transfer residual toner particles from an image bearing member, or properly charging the transfer residual toner particles after the recovery, can be easily realized with the employment of a magnetic brush.

As is evident from the above description, a magnetic brush type charging apparatus is an excellent charging apparatus. However, a magnetic brush type charging apparatus is desired to be further improved in toner recycling performance. For that purpose, it is desired that the average diameter of the charging particles is further reduced so that a contact type charging member which is higher in contact density and greater in conformity than currently available ones.

However, in the case of a conventional magnetic brush based charging method, as electrically conductive magnetic particles are simply reduced in size (no more than 10 $\mu$m), the effectiveness of the magnetic force, in terms of its ability to hold magnetic particles to a charge sleeve, reduces, creating a problem that magnetic particles fall out of the magnetic brush. The ill effects of such a problem are serious, since a magnetic brush type charging member is required to hold a certain amount of magnetic particles to its peripheral surface. More specifically, the magnetic particles which have fallen out of a magnetic brush cause such problems as adhering to an image bearing member, causing a latent image to be unsatisfactorily developed; transferring onto a recording paper, creating fog; or the like. In other words, they cause various image defects. As is evident from the above described problems of a conventional magnetic brush based charging method, simply replenishing a magnetic brush based charging member with magnetic particles is not a solution to the problems.

As described above, a conventional magnetic brush based charging method has a limit in terms of the improvement in contact density. Thus, the inventors of the present invention shifted their attention from the holding of charging particles with the use of magnetic force, and reviewed this problem from the viewpoint of the positive utilization of the attraction between two different substances.

As a result, it was discovered that it was important that the average size of charging particles was reduced, and that the amount of the charging particles held to the peripheral surface of the charging member was optimized. The discovery led to the development of a charging particle based charging apparatus, which is superior in charging performance to a conventional charging particle based charging apparatus, and yet does not suffer from the problems traceable to the particles which fall out of a magnetic brush. Incidentally, there have been known charging apparatuses employing electrically conductive nonmagnetic particles, some of which are disclosed in Japanese Laid-open patent Applications 10-307454–307459.

SUMMARY OF THE INVENTION

The primary object of the present invention is to provide a superior charging apparatus the superior charging performance of which is realized with the use of charging particles, and an image forming apparatus which employs such a charging apparatus.

Another object of the present invention is to provide a charging apparatus, which employs charging particles, and the contact density of which relative to an object to be charged is superior to that of a conventional charging apparatus, and an image forming apparatus which employs such a charging apparatus.

Another object of the present invention is to provide a charging apparatus, which is enabled to employ charging particles smaller in diameter than ordinary charging particles, and is structured so that the amount of charging particles on the charging particle bearing member is continuously optimized, and an image forming apparatus which employs such a charging apparatus.

Another object of the present invention is to provide a charging apparatus which does not adhere charging particles to an object to be charged, and an image forming apparatus which employs such a charging apparatus.

Another object of the present invention is to provide a charging apparatus, which does not cause image defects even if charging particles adhere to an image bearing member, and an image forming apparatus which employs such a charging apparatus.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

EMBODIMENT 1

Figure 1:
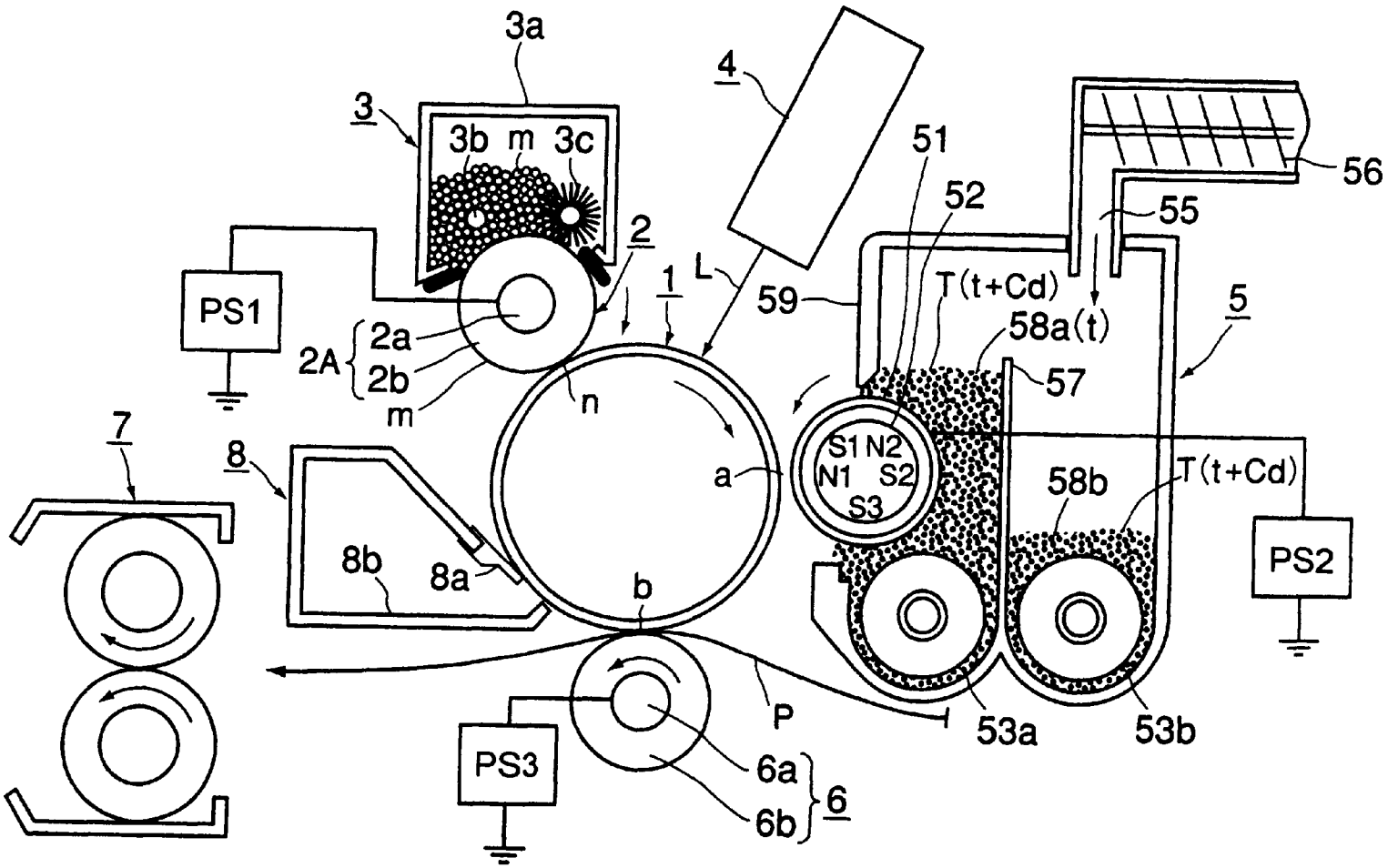
FIG. 1 is a schematic sectional view of the image recording apparatus in the first embodiment of the present invention.

FIG. 1 is a schematic sectional view of an image recording apparatus employing a charging apparatus in accordance with the present invention. It shows the general structure thereof. This image forming apparatus is a laser printer which employs a transfer type electrophotographic process and a direction injection type charging method.

(1) General Structure of Image Recording Apparatus

A referential code 1 designates an image bearing member. In this embodiment, it is a negatively chargeable organic photoconductive member in the form of a rotational drum (which hereinafter will be referred to as "photoconductive drum") with an external diameter of 24 mm, and is rotationally driven in the clockwise direction indicated by an arrow mark at a constant peripheral velocity of 47 mm/sec (process speed PS: printing speed).

This photoconductive drum will be described in more detail later, in a separate section.

Designated by a referential code 2 is a charging apparatus in accordance with the present invention, which is a contact type charging apparatus employing charging particles. This charging apparatus 2 has a charge roller 2A as a contact type charging member, a charge bias application power source S1 for the charge roller 2A, and a charging particle supply device 3 for the charge roller 2A.

The charge roller 2A comprises a metallic core 2*a*, an elastic layer as a charging particle bearing member 2*b*, and a layer of charging particles m (electrically conductive particles) held to the peripheral surface of the elastic layer. The charging particle bearing member 2*b* is in the form of a roller, and is formed of rubber or foamed substance. It is integrally and coaxially fitted around the metallic core 2*a*. Its electrical resistance is in the middle range. The charge roller 2A is placed in contact with the photoconductive drum 1 in such a manner that it appears as if the charge roller 2A has penetrated a predetermined distance into the photoconductive drum 1. As a result, a predetermined amount of contact pressure is generated between the charge roller 2A and photoconductive drum 1, and a charging nip n with a predetermined width (in terms of the circumferential direction of the charge roller 2A) is formed by the peripheral surfaces of the charge roller 2A and photoconductive drum 1. More precisely, the charging particles m held to the peripheral surface of the charge roller 2A contact the peripheral surface of the photoconductive drum 1, in the charging nip n.

The charge roller 2A is rotationally driven in the clockwise direction indicated by the arrow mark, as is the photoconductive drum 1. Thus, in the charging nip n, the peripheral surface of the charge roller 2A rotates in the direction opposite (counter) to that in which the photoconductive drum 1 does. Therefore, there is a difference in peripheral velocity between the peripheral surface of the elastic layer 2*b* and the peripheral surface of the photoconductive drum 1, with the presence of charging particles m between the two surfaces.

The speed difference between the peripheral surface of the charge roller 2A relative to the peripheral surface of the photoconductive drum 1 can also be provided by rotating the charge roller 2A in the direction opposite to the direction in which the charge roller 2A is rotated in this embodiment; in other words, the same direction as the photoconductive drum 1. In such a case, the charge roller 2A and photoconductive drum 1 must be driven at different peripheral velocities. However, the charging performance in a direction injection type charging method is dependent upon the ratio between the peripheral velocities of the photoconductive drum 1 and charge roller 2A. Therefore, rotating the charge roller 2A in the same direction as the photoconductive drum 1 is advantageous in terms of revolution, as well as in terms of particle retention. In other words, it is preferable that an image forming apparatus in accordance with the present invention is structured so that the charge roller 2A is rotated in the same direction as the photoconductive drum 1.

While an image is recorded by the image forming apparatus, a predetermined charge bias is applied to the metallic core 2*a* of the charge roller 2A from the charge bias application power source S1.

As a result, electrical charge is directly injected into the peripheral surface of the photoconductive drum 1, uniformly charging the peripheral surface of the photoconductive drum 1 to predetermined polarity and potential level. In this embodiment, a charge bias of −600 V was applied to the metallic core 2*a* of the charge roller 2A from the charge bias application power source S1. As a result, the peripheral surface of the photoconductive drum 1 was charged to a potential level virtually identical to the potential level of the bias applied to the metallic core 2*a*.

As the photoconductive drum 1 is charged, some of the charging particles m coated on the peripheral surface of the charge roller 2A are carried away from the peripheral surface of the charge roller 2A by being adhered to the peripheral surface of the photoconductive drum 1. Therefore, it is necessary to provide the image forming apparatus with a charging particle supplying device 3 for compensating for the charging particles carried away from the charge roller 2A. The charging particles m are stored in a housing 3*a* of the charging particle supplying device 3, and are coated on the peripheral surface of the charge roller 2A as the charging particles m are stirred by a stirring blade 3*b*. The excessive amount of the charging particles m relative to a target amount are scraped away by a fur brush so that a proper amount of the charging particles m remains coated on the peripheral surface of the charge roller 2A. The amount of the charging particles m on the peripheral surface of the charge roller 2A can be controlled, as necessary, by controlling the revolution of the fur brush 3*c*.

This charging apparatus 2, and a direct injection type charging method, will be described in more detail later, in a separate section.

A referential code 4 designates a laser scanner (exposing apparatus) comprising a laser diode, a polygon mirror, and the like. The laser scanner 4 outputs a beam of laser light L modulated with sequential electrical digital signals reflecting the data of an intended image, in such a manner that the laser beam L scans, exposing thereby, the uniformly charged peripheral surface of the photoconductive drum 1 being rotationally driven.

As the result of the exposure of the peripheral surface of the rotating photoconductive drum 1 by the scanning laser beam L, an electrostatic latent image in accordance with the data of the intended image is formed on the peripheral surface of the photoconductive drum 1.

A referential code 5 designates a developing apparatus (development device). The developing apparatus 5 in this embodiment contains two component developer T comprising magnetic carrier particles Cd and nonmagnetic toner particles t, and a predetermined amount of the developer T is coated on the peripheral surface of the development sleeve 51. The toner particles t are charged to a certain potential level as they are rubbed against the carrier particles Cd. The charged toner particles t develop the electrostatic latent image on the photoconductive drum 1 into a visible image, in a development region a, as development bias is applied between the development sleeve 51 and photoconductive drum 1 by a development bias application power source S2. The developing apparatus 5 will be described later in more detail, in a separate section.

Designated by a referential code 6 is a transfer roller as a contact type transferring means, the electrical resistance of which is in the medium range. It is placed in contact with the photoconductive drum 1 with the application of a predetermined amount of pressure, forming a transfer nip b. To this transfer nip b, a transfer medium p as a recording medium is fed from an unshown sheet feeding station, with a predetermined timing, while a predetermined transfer bias is applied to the transfer roller 6 from a transfer bias application power source S3. As a result, the tuner image on the photoconductive drum 1 is continually transferred onto the transfer medium p being passed through the transfer nip b.

The transfer roller 6 in this embodiment comprises a metallic core 6*a*, and a surface layer 6*b*. The surface layer 6*b* is formed of foamed substance, and its electrical resistance is in the medium range. The electrical resistance of the transfer roller 6 is $5\times10^8$ ohm. In order to transfer the toner image on the photoconductive drum 1 onto the transfer medium p, a voltage of +2.0 kV is applied to the metallic core 6*a*. After being introduced into the transfer nip b, the transfer medium p is conveyed through the transfer nip b, while being sandwiched by the top and bottom portions of the transfer nip b. While the transfer medium P is conveyed through the transfer nip b, the toner image, which has been formed, and borne, on the peripheral surface of the photoconductive drum 1 is continually transferred onto the transfer medium p by the electrostatic force and mechanical pressure.

A referential code 7 designates a fixing apparatus employing a thermal fixing method or the like. After the transfer medium p is fed into the transfer nip b and the toner image on the photoconductive drum 1 is transferred onto the recording medium p, the recording medium p is separated from the peripheral surface of the photoconductive drum 3, and is introduced into the fining apparatus 7, in which the toner image is permanently fixed to the recording medium. Thereafter, the recording medium p with the permanently fixed toner image is discharged as a print or copy from the apparatus main assembly.

A referential code 8 designates an apparatus for cleaning the photoconductive drum 1. The transfer residual toner particles, that is, the toner particles remaining on the peripheral surface of the photoconductive drum 1, are scraped away from the peripheral surface of the photoconductive drum 1 by the cleaning blade 8*a* of the photoconductive drum cleaning apparatus 8, and are recovered into a waste toner bin 8*b* of the cleaning apparatus 8.

Thereafter, the photoconductive drum 1 is charged again by the charging apparatus 2, to be used for the following image formation cycle.

(2) Photoconductive Drum 1

Figure 2:
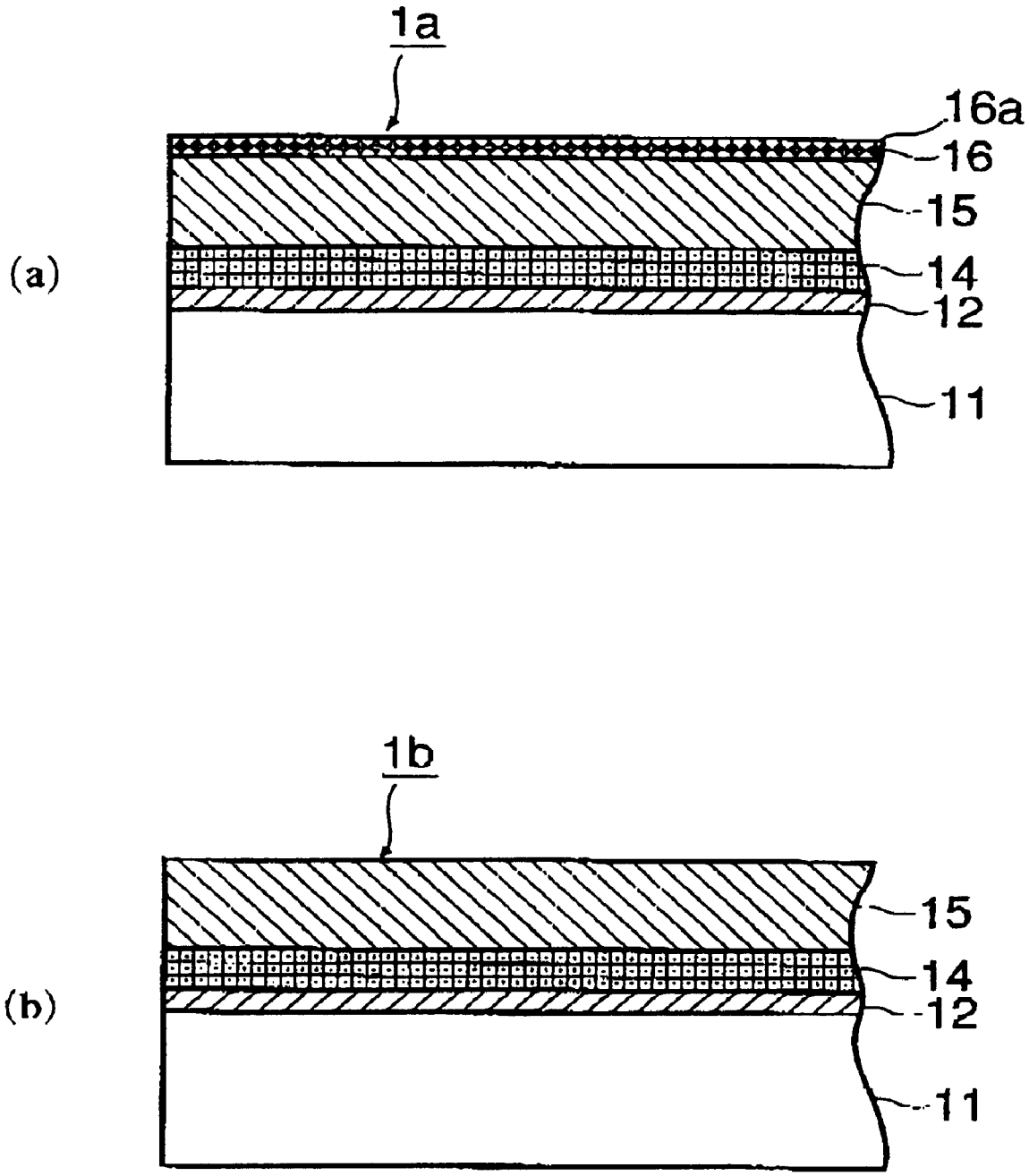
FIG. 2, consisting of FIGS. 2(*a*) and 2(*b*), are schematic views of the peripheral portion of a photoconductive drum, and show its laminar structure.

FIG. 2 is a schematic sectional view of the surface layers of the photoconductive drum 1 electrophotographic photoconductive member). It shows the laminar structure of the photoconductive drum 1. FIG. 2(*a*) represents a photoconductive drum 1*a*, which has a charge infection layer. FIG. 2(*b*) represents a photoconductive drum 1*b*, which does not nave a charge infection layer.

The photoconductive drum 1*b*, in FIG. 2(*b*), that is, a photoconductive drum without a charge infection layer, is an ordinary organic photoconductive drum, comprising an aluminum base 11 in the form of a cylinder (aluminum base drum), an undercoat layer 12, a charge generation layer 14, and a charge transfer layer 15. The three layers 12, 14, and 25 are coated in layers on the peripheral surface of the aluminum base drum 11 in the listed order.

The photoconductive drum 1*a* in FIG. 2(*a*), that is, a photoconductive drum with a charge injection layer, is a combination of the photoconductive member 1*b*, and a charge injection layer 16 coated on the peripheral surface of the photoconductive drum 1*b* to improve the charging performance of the photoconductive drum 1*b*.

The charge injection layer 16 is a mixture of a photo-curable acrylic resin as a binder, ultramicroscopic particles 16*a* of $SnO_2$ (approximately 0.03 $\mu$m in diameter) as electrically conductive particles (electrically conductive filler), polymerization initiator, and the like; ultramicroscopic particles 16*a* of Sno2, polymerization initiator, and the like, are dispersed in the photo-curable acrylic resin. The mixture is coated on the peripheral surface of the photoconductive drum 1*b*, and is photo-cured into a thin film (charge injection layer 16).

Incidentally, lubricant such as tetrafluoroethylene may be contained in the charge injection layer 16 to reduce the surface energy of the peripheral surface of the photoconductive drum. The addition of the lubricant such as tetrafluoroethylene is effective to reduce the overall amount of the charging particles which adhere to the photoconductive drum. The surface energy of the peripheral surface of the photoconductive drum is desired to be such that the contact angle of the peripheral surface of the photoconductive drum with respect to water is no less than 85 degrees, preferably no less than 90 degrees.

From the viewpoint of charging efficiency, the electrical resistance of the outermost layer is one of the essential factors. It is conceivable that in a direct injection type charging method, the size of the area of the surface of an object to be charged, which can be charged per injection point (contact point), can be increased by reducing the electrical resistance of the object to be charged. Thus, it is conceivable that when the state of contact between a charge roller and an object to be charged, and the state of contact between the same charge roller and another object to be charged, are identical, electrical charge is more efficiently given to the object to be charged with a smaller surface electrical resistance. On the other hand, when an object to be charged is a photoconductive member for image formation, it mast be able to retain an electrostatic latent image for a predetermined length of time. Thus, the volumetric resistivity of the charge injection layer 16, should be within a range of $1\times10^9$–$1\times10^4$ (ohm.cm). Further, even in the case of the photoconductive drum 1*b*, which does not have the charge injection layer 16, a charging efficiency equal to that of the photoconductive drum 1*a*, which has the charge injection layer 16, can be realized as long as the volumetric resistivity of the charge transfer layer 15 of the photoconductive drum 1*b* is in the above described range. Moreover, the charge efficiency equal to that of the photoconductive drum 1*b*, can also be realized when an amorphous silicon based photoconductive member, the volumetric resistivity of the outermost layer of which is approximately $10^{13}$ ohm.cm.

The electrical resistances of the outermost layers of the photoconductive drums 1*a* and 1*b*, are both $10^{12}$ ohm.cm, being greater than $10^{14}$ ohm.cm.

(3) Charge Roller 2A

As described above, the charge roller 2A as a contact type charging member in this embodiment comprises a metallic core 2*a*, an elastic layer as a charging particle bearing member 2*b*, and a layer of charging particles m (electrically conductive particles) held to the peripheral surface of the elastic layer. The charging particle bearing member 2*b* is in the form of a roller, and is formed of rubber or foamed material. It is integrally and coaxially fitted around the metallic core 2*a*. Its electrical resistance is in the middle range.

The elastic layer 2*b* with an intermediate electrical resistance is formed of a mixture of resin (for example, urethane), electrically conductive particles (for example, carbon particles); sulfurizing agent, foaming agent, and the like; it is in the form of a roller fitted around the metallic core 2*a*. The peripheral surface of the charge roller 2A is polished.

The charge roller 2A as a contact type charging member in accordance with the present invention is different from an ordinary electrical discharge based charge roller, in particular, in the following points.

1. Surface structure and surface roughness for retaining the charging particles m at high density on the surface.

2. Electrical resistance necessary for direction charge injection (volumetric resistivity, surface electrical resistance).

(3)-1 Surface Structure and Surface Roughness

The surface of a conventional Charge roller, that is, the surface of an electrical discharge based charge roller, is smooth, being less than one $\mu$m in average surface roughness Ra, and is relatively high in hardness. When an object is charged through electrical discharge, electrical discharge occurs a small distance away from the interface between the charge roller and the object to be charged, where the gap between the charge roller and the object is several tens of micrometers wide. When the surfaces of the charge roller and object to be charged are rough on their surfaces, the electric field between the charge roller and object to be charged is not form in strength, and therefore, electrical discharge is unstable. As a result, the object is nonuniformly charged. Thus, a conventional change roller is required to be have an extremely smooth and very hard surface.

While considering why it is impossible to satisfactorily inject electrical charge into an object with the use of a conventional electrical discharge based charging member, the following became evident. That is, when a charge roller and a photoconductive drum are as described above in surface structure, the charge roller and photoconductive drum appear to be perfectly in contact with each ether. However, in terms of contact at a molecular level, or contact at a microscopic level, which is necessary for satisfactory charge injection, there are virtually no contacts between the roller and drum.

On the other hand, the charge roller 2A as a contact type charging member in accordance with the present invention needs to bear charging particles m at a high density, and therefore is required to have a certain level of roughness across its peripheral surface. More specifically, the average surface roughness Ra of the charge roller 2A is desired to be in a range of 1 $\mu$m–500 $\mu$m.

If the average surface roughness Ra of the charge roller 2A is no more than 1 $\mu$m, the surface area of the charge roller 2A will not be large enough for satisfactorily bearing the charging particles m. Also in such a case, if an electrically insulative particle (for example, toner particle) adheres to the peripheral surface of the charge roller 2A, the portion of the peripheral surface of the charge roller 2A immediately adjacent to the electrically insulative particle, fails to contact the photoconductive drum, reducing the charging performance.

Further, in consideration of the particle bearing capacity of the charge roller 2A, the average surface roughness Ra of the charge roller 2A is desired to be greater than the average particle diameter of the charging particles m.

On the contrary, if the average surface roughness Ra of the charge roller 2A is no less than 500 $\mu$m, the roughness of the peripheral surface of the charge roller 2A reduces the degree of uniformity with which the peripheral surface of the photoconductive drum is charged. The average surface roughness Ra in this embodiment was 50 $\mu$m.

The configuration and average roughness Ra of the peripheral surface of the charge roller 2A are indirectly measured with the use of a surface shape measurement microscopes VF-7500 and VF-7510 (Keyence, Co. Ltd.), along with an object lens with a power range of 250 times to 1250 times.

(3)-2 Electrical Resistance

A conventional charge roller based on electrical discharge is made by forming a base layer with a low electrical resistance, around the peripheral surface of a metallic core, and then, covering the peripheral surface of the base layer with another layer with a higher electrical resistance. Therefore, in order to charge's photoconductive drum with the use of a conventional electrical discharge based charge roller, high voltage must be applied to the charge roller. Thus, if the drum has a pinhole (exposure of base layer caused by the damage to the surface layer), even the area surrounding the pinhole suffers from voltage drop, resulting in unsatisfactory charging of the photoconductive drum. Thus, the electrical resistance of a conventional electrical discharge based charge roller must be no less than $10^{11}$ ohm/□.

On the other hand, in the case of a direct injection type charging method in accordance with the present invention, it is unnecessary to provide the outermost layer of a contact type charging member with a high electrical resistance in order to make it possible to charge a photoconductive drum with the use of low voltage. Therefore, the charge roller 2A needs only a single layer. In addition, the surface electrical resistance of the charge roller 2A is desired to be rather lower, that is, within a range of $10^4$–$10^{10}$ ohm/□.

If the surface electrical resistance of the charge roller 2A is no less than $10^{10}$ ohm/□, the nonuniformity of the roller surface in terms of potential level is substantial, and the resultant bias acts on the charging particles, making it easier for the charging particles to be expelled. Further, the nonuniformity results in the nonuniformity of the charging surface, or the charging nip, and the unevenness in the rubbing of a photoconductive drum by the charge roller 2A manifests as streaks in the half-tone areas of an image, reducing image quality.

On the other hand, if the surface electrical resistance of the charge roller 2A is no more than $10^{14}$ ohm.cm, voltage drop occurs to the area of the photoconductive drum around a pinhole even when a direction infection type charging method is employed.

The volumetric resistivity of the charge roller 2A is desired to be in a range of $10^4$–$10^7$ ohm. If it is less than $10^4$ ohm, pinhole leak is likely to cause the voltage of a power source to drop. On the other hand, if it more than $10^7$ ohm, electrical current is not allowed to flow by the amount necessary to satisfactorily charge the photoconductive drum 1. Therefore, the photoconductive drum 1 fails to be charged to an intended potential level.

Figure 3:
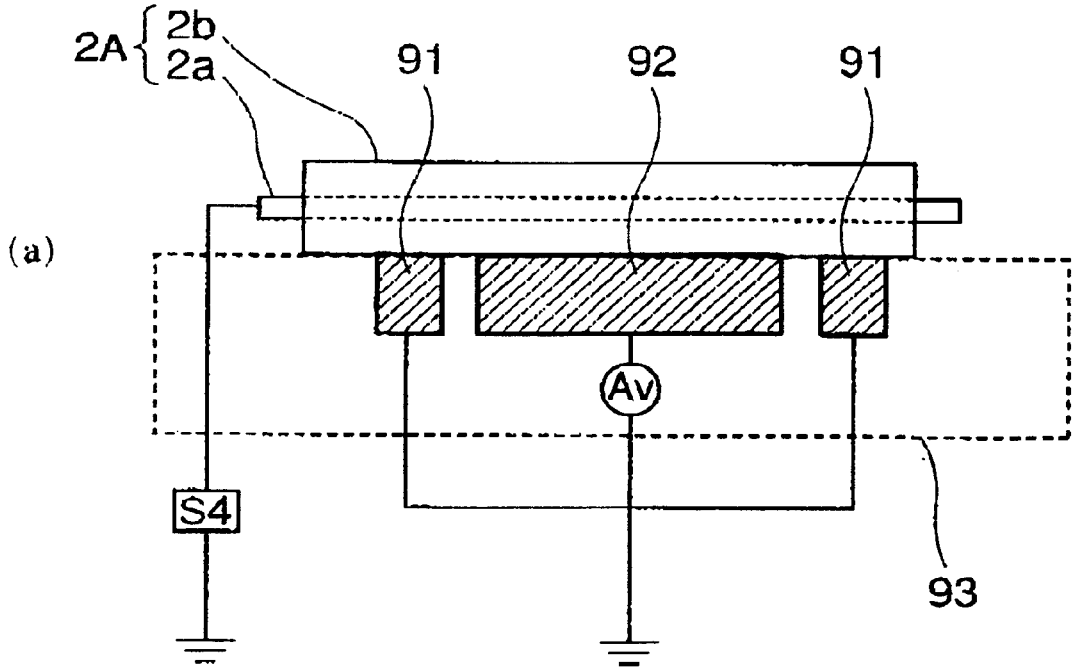
FIG. 3, consisting of FIGS. 3(*a*) and 3(*b*), are schematic drawings for depicting a method for measuring the electrical resistance value of a charge roller.
Figure 3:
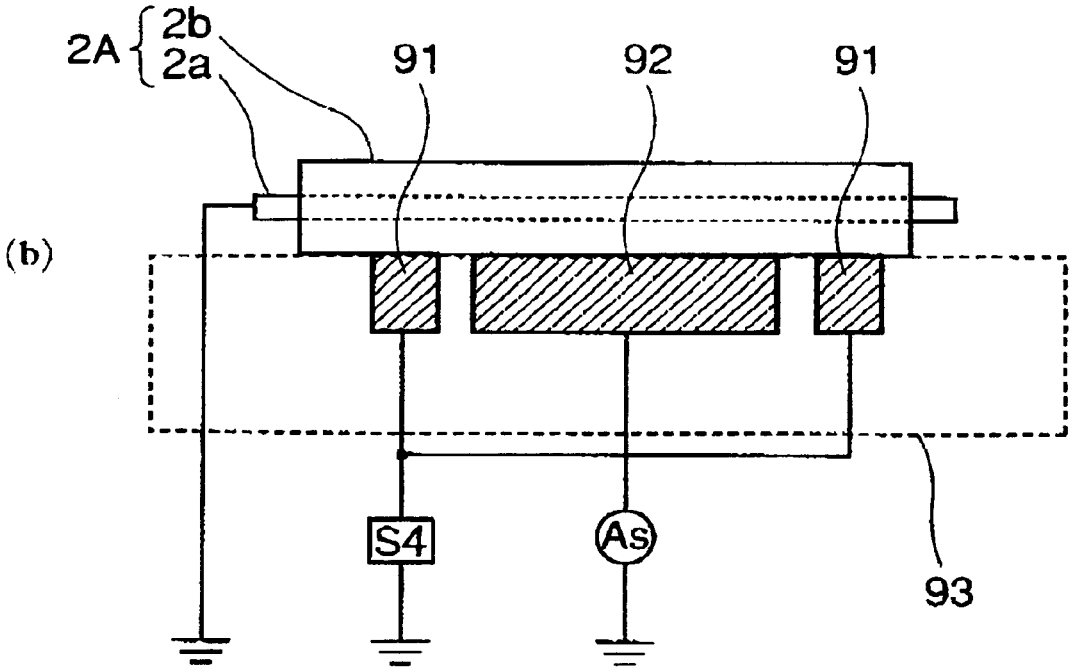

The surface electrical resistance and volumetric resistance of the charge roller 2A in this embodiment were $10^7$ ohm/□ and $10^6$ ohm/□, respectively The electrical resistance of the charge roller 2A was measured according to the following procedure. The structural arrangement for the measurement is roughly shown in FIG. 3. A dielectric drum 93 with an external diameter of 24 mm is placed in contact with the charge roller 2A so that an overall load of 9.8 N (1 kgf) acts on the metallic core 2*a* of the charge roller 2A, and an electrode was attached to the drum 93. The electrode comprised a main electrode 92, and a pair of guard electrodes 91 disposed in a manner to sandwich the main electrode 92, which were wired as shown in FIGS. 3(*a*) and 3(*b*). The distance between the main electrode 92 and each guard electrode 91 was adjusted to be approximately equal to the thickness of the elastic layer 2*b* with the medium resistance. The main electrode 92 was made substantially wider than the electrodes 91. The volumetric resistance and surface resistance were obtained by measuring the amount of the current which flowed through ammeters Av and As, respectively, while applying a voltage of +100 V to the main electrode 92 from a power source S4.

As described above, the charge roller 2A as a contact type charging member in accordance with the present invention must have the following characteristics:

1. Its surface is rough enough to bear charging particles at a high density.

2. Its resistance (volumetric resistivity, surface resistance) is within a range suitable for direct charge injection.

(3)-3 Other Characteristics of Charge Roller

In a direction charge injection method, it is important that a contact type charging member functions as a flexible electrode.

In the case of a magnetic brush, this mandatory flexibility is provided by the flexibility of the magnetic particles layer itself.

In the charging apparatus 2 in this embodiment, the flexibility is provided by adjusting the elasticity of the medium electrical resistance elastic layer 2*b* of the charge roller 2A. The hardness of the surface of the charge roller 2A is desired to be in a range of 15–50 degrees, preferably, in a range of 20≧40 degrees, in Asker C scale.

If the surface of the charge roller 2A is harder than a certain level, the charge roller 2A cannot hypothetically penetrate into the photoconductive drum 1 by a necessary distance, failing to form a charge nip n large enough for satisfactory charging performance. Further, at a molecular level, the charge roller 2A can make virtually no contact with the photoconductive drum 1, and therefore, if a stray particle enters the charging nip n, no contact will be made between the charge roller 2A and photoconductive drum 1, in the immediate area of the stray particle.

On the other hand, if the surface of the charge roller 2A is softer than a certain level, the charge roller 2A is unstable in shape, and therefore, the contact pressure between the charge roller 2A and photoconductive drum 1 becomes unstable, which causes the peripheral surface of the photoconductive drum 1 to be nonuniformly charged. Further, if the surface of the charge roller 2A is softer than a certain level, the charge roller 2A permanently deforms if it is left unused for an expended period of time, and the permanent deformation of the charge roller 2A results in the unsatisfactory charging of the photoconductive drum 1.

In this embodiment, the charge roller 2A had a hardness of 22 degrees in Asker C scale, and was disposed so that the charge roller 2A hypothetically penetrated into the photoconductive drum 1 by a distance of 0.3 mm, to form an approximately 2 mm wide charging nip n.

(3)-4 Material, Structure, and Measurements of Charge Roller

As for the material for the elastic and medium resistance layer 2*b* of the charge roller 2A, EPDM, urethane, NBR, silicone rubber, or a rubbery Material made by dispersing electrically conductive substance such as carbon black or metallic oxide in IR or the like to adjust electrical resistance, may be listed. It is possible to adjust electrical resistance by using ion conductive substance, instead of dispersing electrically conductive substance. If necessary, the charge roller 2A is polished to adjust its surface roughness and/or correct its shape. The charge roller 2A may be given a laminar structure comprising a plurality of layers different in function.

However, it is preferable that the material for the elastic and medium resistance layer 2*b* of the charge roller 2A is porous, because the porous material is advantageous from the standpoint of manufacture in that it can provide the charge roller 2A with the aforementioned surface roughness at the same time as the charge roller 2A is molded. A range of 1–500 μm. is proper as a range for the cell diameter of the porous material. The charge roller 2A can be provided with the above described surface roughness by exposing the pore walls by polishing the surface of the elastic and medium resistance layer 2*b* after the foam molding of the layer 2*b*.

Finished through the above described steps is the charge roller 2A comprising a metallic core 2*a*, which is 6 mm in external diameter and 240 mm in length, and an elastic and medium resistance layer 2*b*, which covers virtually the entirety of the peripheral surface of the metallic core 2*a*, is 3 mm in thickness, 12 mm in external diameter, 220 mm in length, and has a porous surface.

In this embodiment, the charge roller 2A is disposed so that it hypothetically penetrates into the photoconductive drum 1 as an object to be charged by a distance of 0.3 mm to form the contact nip n which is approximately 2 mm in terms of the circumferential direction of the charge roller 2A.

(4) Charging particle m

In this embodiment, zinc oxide particles, that is, electrically conductive particles, which are $10^6$ ohm.cm in specific resistivity, and 3 μm in average particle diameter, are used as the charging particles m.

The charging particles m are stored in the housing 3*a* of a charging particle supplying device 3.

As for the materials for the charging particles m, various inorganic and organic materials can be used in addition to zinc oxide; for example, electrically conductive inorganic particles such as particles of metallic oxide other than zinc oxide, a mixture of electrically conductive inorganic particles and organic particles, or the preceding particles, the surfaces of which have been given surface treatment. Incidentally, the charging particles m in this embodiment do not need to be magnetically confined, and therefore, they do not need to be magnetic.

Since electrical charge is passed through the charging particles m, the specific resistance of the charging particles m needs to be no mere than $10^{12}$ ohm.cm, preferably, no more than $10^{10}$ ohm.cm. Further, the electrical resistance of the charging particle m is desired to be no less than $10^{-1}$ ohm.cm.

The electrical resistance of the charging particles m was measured by a tablet method, and the obtained resistance was normalized. More specifically, an approximately 0.5 g of the charging particles m was placed in a cylinder with a bottom area size of 2.26 $cm^2$, and the resistance value of the charging particles m was measured by applying a voltage of 100 V between top and bottom electrodes, with the charging particles m compacted by top and bottom electrodes with the application of a load of 147 N (15 kgf). The thus obtained values were normalized to calculate the specific resistivity of the charging particles m.

In order to achieve charging efficiency and uniformity higher than those of a magnetic brush type charging apparatus, particle diameter is desired to be no more than 10 $\mu$m. In this embodiment, when each charging particle is composed of agglutinated sub-particles (primary particles), the average particle diameter was defined as the average particle diameter of charging particles in the agglutinated form. The charging particle diameter was obtained in the following manner. No less than 100 charging particles were randomly chosen, and their maximum horizontal chord lengths were measured, by looking through a microscope. Then, the volumetric particle diameter distribution was obtained from the chord lengths. Then, the value corresponding to the fiftieth percentile of the distribution was designated as the average particle diameter.

The charging particles m may be in the form of a primary particle as well as a secondary particle, that is, a particle composed of a plurality of agglutinated primary particles. As long as the charging particles m satisfactorily function as charging particles, their constitution does not matter.

When the charging particle m are used for charging a photoconductive member, they are desired to be white or almost transparent so that they do not interiors with the exposure of the photoconductive drum for the formation of a latent image. For the same reason, the charging particles m are desired to be nonmagnetic. Further, in consideration of the fact that a certain amount of the charging particles m is transferred from the photoconductive drum onto a recording medium, the charging particles m used for color recording are desired to be colorless or white. Also, in order to prevent exposure light from being scattered by the charging particles m, the particle size of a charging particle m is smaller than the picture element size, and also is smaller than the toner particle diameter. In consideration of the physical stability of a charging particle m, the minimum size of a charging particle m is desired to be 10 nm.

(5) Amount of Charging particles on Charge Roller

In this embodiment, charging performance is improved by reducing the average particle diameter of the charging particles m. However, reduction of the particle diameter increases the amount of the charging particles m which transfer onto the photoconductive drum 1. The force which holds the charging particles m to the charge roller 2A is weak adhesive force. Therefore, even if a large amount of the charging particles m is supplied, it is difficult to hold the charging particles m to the charge roller 2A. As a result, a substantial amount of the charging particles m transfer onto the photoconductive drum 1 adversely affecting the development process, which in turn results in the formation of an unsatisfactory image. Thus, it is desired that the charging particles m are evenly coated on the peripheral surface of the charge roller 2A, in reality, it is impossible to perfectly evenly coat the charging particles m, and therefore, the amount of the charging particles m borne on the charge roller 2A is adjusted to assure that satisfactory charging performance is realised, and also that the amount of the charging particles m on the charge roller 2A is reduced to a level at which no problem is caused by the charging particles m from the charge roller 2A. The amount by which the charging particles m are borne on the peripheral surface of the charge roller 2A must be made appropriate by adjusting the average roughness Ra of the peripheral surface of the charge roller 2A. More specifically, the value obtained by dividing the amount by which the charging particles m are borne, by the average roughness Ra is desired to be no more than 1 $mg/cm^2/\mu m$, preferably, no more than 0.3 $mg/cm^2/\mu m$.

In the case of a conventional magnetic brush type charging apparatus, the value obtained by dividing the amount by which the electrically conductive magnetic particles are borne, by the average roughness Ra, is approx. 167 $mg/cm^2/\mu m$ (200 $mg/cm^2$, Ra=1.2 $\mu$m). In comparison, in the case of the nonmagnetic charging particles m according to the present invention, it is 1 $mg/cm^2/\mu$an (50 $mg/cm^2$, Ra=50 $\mu$m), more preferably, 0.3 $mg/cm^2/\mu m$ (15 $mg/cm^2$, Ra=50 $\mu$m),m which brings forth a better result. On the other hand, in consideration of the need for securing satisfactory charging performance, the value obtained by dividing the minimum amount of the charging particles m which must be borne on the charge roller 2A for securing satisfactory charging performance, by the average roughness Ra, is 0.005 $mg/cm^2/\mu m$ (0.25 $mg/cm^2$, Ra=50 $\mu$m), preferably, 0.02 $mg/cm^2/\mu m$ (1 $mg/cm^2$, Ra=50 $\mu$m). Namely, the value of the amount of the charging particles m on the charge roller 2A)/Ra is preferably in a range of 0.005–1 further preferably 0.02–0.30 $mg/cm^2/\mu m$. The details will be given later in the description of another embodiment The amount by which the charging particles m are borne on the charge roller 2A was adjusted by controlling the revolution of the fur brush 3*c* of the charging particle supplying device 3. The greater the fur brush revolution, the smaller the amount. Further, when necessary, it was adjusted by adjusting the rotational speed of the stirring blade 3*b*, density of the fur brush 3*c*, and the like.

(6) Developing Apparatus 5

The developing apparatus 5 is a two-component type developing device. Next, its structure will be described in detail. The development apparatus 5 is disposed in a manner to oppose the photoconductive drum 1. Its internal space is partitioned into a first chamber 58*a* (development chamber) and a second chamber (stirring chamber) 58*b*, by a partition wall 57 which extends in the vertical direction.

At an opening of the first chamber 58*a*, a nonmagnetic development sleeve 51, which rotates in the direction indicated by an arrow mark, is disposed in a manner to oppose the photoconductive drum 1. With the development sleeve 51, a magnet 52 is stationarily disposed. The development sleeve 51 bears and conveys a layer of two-component developer T (mixture of magnetic carrier Cd and nonmagnetic toner t), the thickness of which has been regulated by a blade 59, to a development area a, in which the development sleeve 51 opposes the photoconductive drum 1. In the development area a, the developer T is supplied from the development sleeve 51 to the photoconductive drum 1 to develop an electrostatic latent image on the photoconductive drum 1 into a toner image. To the development sleeve 51, development bias, which is a combination of DC and AC voltages, and the waveform of which is rectangular, is being applied from the power source S2.

In the first and second chambers 58*a* and 58*b*, developer stirring screws 53*a* and 53*b* are disposed, respectively. The screw 53*a* conveys the developer T within the first chamber 58*a* while stirring it. The screw 53*b* conveys the toner t, which has been delivered from the toner outlet 55 of an unshown toner supply container into the second chamber 58*b* by the rotation of a conveyance screw 56, and the developer T, which already has been in the second chamber 58*b*, while stirring them together to make toner density uniform. The partition wall 57 is provided with a pair of developer paths (unshown), which are located at the front end rear ends, one for one, connecting the first and second chambers 58*a* and 58*b*. The developer T within the first chamber 58*a*, the toner density of which has reduced due to the consumption of the toner t by the development of latent images, is moved through one of the pair of developer paths by the conveying forces of the screws 53*a* and 53*b*, into the second chamber 58*b*, in which the toner density of the developer T is restored. Then, the developer T with the normal toner density is moved into the first chamber 58*a* through the other developer path.

The toner ratio of the developer T within the developing apparatus 5 is kept constant by monitoring the magnetic permeability of the developer T by the magnetic force sensor of a developer density controlling apparatus. More specifically, since toner t is different in magnetic permeability from the magnetic carrier Cd, the magnetic permeability of the developer T varies depending upon their ratios. Therefore, the toner ratio of the developer T is kept constant by controlling the amount by which toner t is supplied, on the basis of the comparison between the magnetic sensor output having been measured in advance, and the magnetic sensor output during an image forming operation.

The developer T is a two-component developer, that is, a mixture of nonmagnetic toner particles t chargeable to negative polarity by friction, and magnetic carrier particles Cd chargeable to positive polarity by friction. The toner ratio of this developer T is adjusted so that the weight ratio of the nonmagnetic tuner particles t becomes 5%.

a) toner t: nonmagnetic toner particles t are formed of bonding resin, pigment, and electrical charge controlling agent, and are manufactured through a mixing and kneading process, a pulverizing process, and a classifying process. To the thus manufactured toner particles t, fluidizing agent or the like is added. The average particle diameter (D4) of the toner particles t was 8 $\mu$m.

b) carrier Cd: magnetic carrier is composed of ferrite particles, which are 50 $\mu$m in average particle diameter and are no less than $10^8$ ohm.cm in electrical resistance.

EMBODIMENT 2

Figure 4:
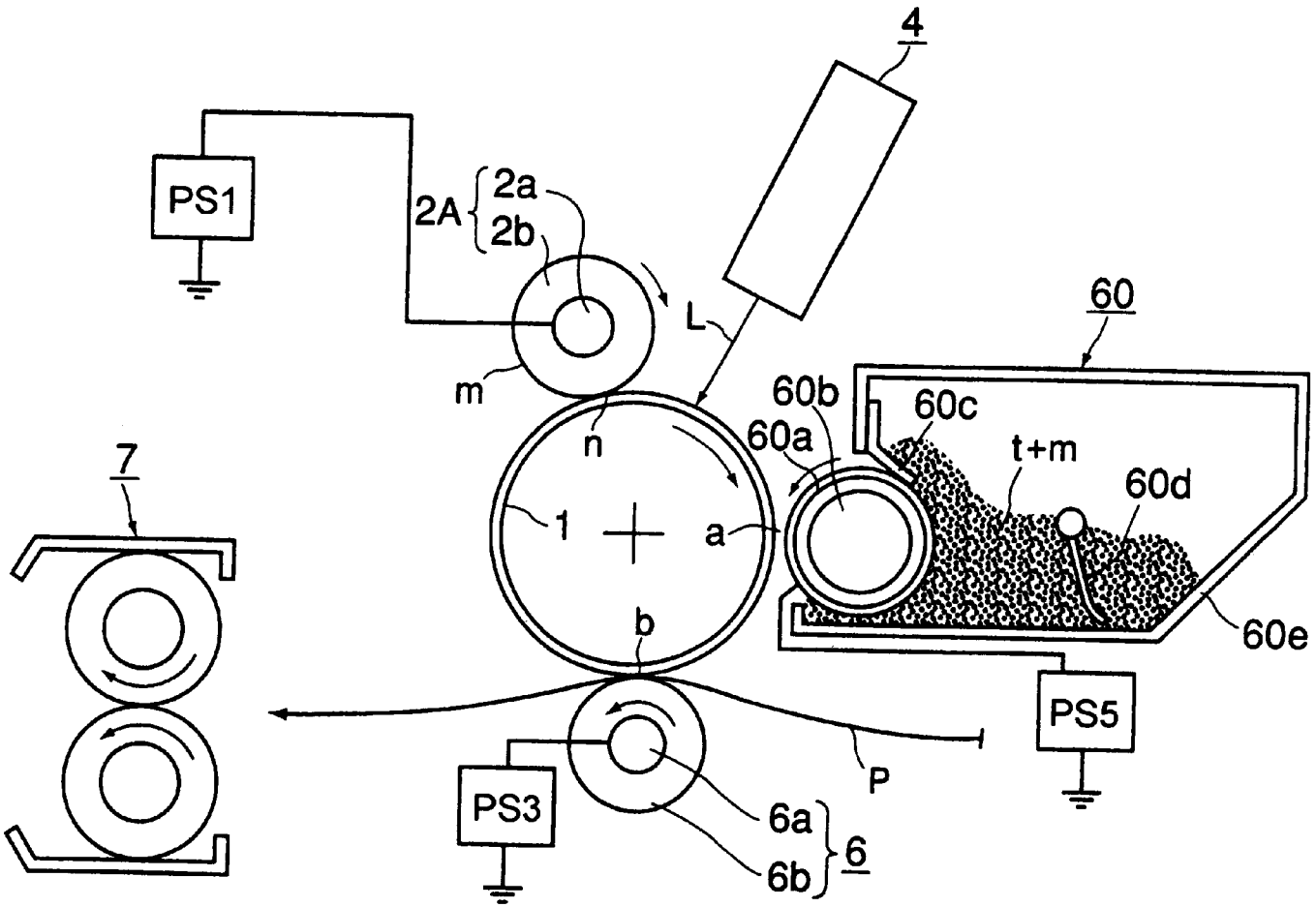
FIG. 4 is a schematic sectional view of the image recording apparatus in the second embodiment of the present invention.

FIG. 4 is a schematic sectional view of the image recording apparatus employing a charging apparatus in accordance with the present invention, in the second embodiment of the present invention, and shows the general structure thereof. The image recording apparatus in this embodiment is a laser printer, which employs a transfer type electrophotographic process, a direct injection type charging method, and a toner recycling process (cleaner-less system). The descriptions of the components and portions of this apparatus similar to those of the image recording apparatus in the first embodiment will be not given to avoid repetition, and only the different components and portions will be described.

A charging apparatus 2 is not provided with a charging particle supplying device 3 dedicated to a charge roller 2A. Instead, charging particles m are added to the developer t in a developing apparatus 60. They adhere to the peripheral surface of the photoconductive drum 1 along with toner particles during the development of an electrostatic latent image. Then, they are carried by the rotation of the photoconductive drum 1, to a charging nip n, in which they are supplied from the photoconductive drum 1 to the charge roller 2A.

The developing apparatus 60 is a reversal type developing apparatus which employs a single-component magnetic toner (negative toner). Within the developing apparatus 60, a mixture (t+m) of the developer t and charging particles m is stored. An electrostatic latent image on the peripheral surface of the rotating photoconductive drum 1 is developed into a toner image by this developing apparatus 60, in the development station a.

The image recording apparatus in this embodiment employs a toner recycling process. In other words, transfer residual toner particles, that is, the toner particles remaining on the peripheral surface of the photoconductive drum 1 after the toner image transfer, are not removed by a dedicated cleaner (cleaning apparatus). Instead, they are carried to a charging nip n as the photoconductive drum 1 rotates. In the charging nip n, the transfer residual toner particles are temporarily recovered by a charge roller 2A, being borne on the peripheral surface of the charge roller 2A. While the charge roller 2A rotates, the transfer residual toner particles on the peripheral surface of the charge roller 2A are rectified in electrical charge polarity. As they are rectified in polarity, they are expelled from the peripheral surface of the charge roller 2A, back onto the photoconductive drum 1. Then, as the photoconductive drum 1 rotates, they reach the development station a, in which they are removed from the peripheral surface of the photoconductive drum 1 by the developing apparatus 60, that is, recovered by the developing apparatus, at the same time as an electrostatic latent image on the peripheral surface of the photoconductive drum 1 is developed. The residual toner particles recovered by the developing apparatus 60 are used for the following image formation cycles.

(2) Charging Apparatus 2

The charging apparatus 2 in this embodiment is similar to the one in the first embodiment, except that it is not provided with a charging particle supply device 3.

(3) Developing Apparatus 60

Designated by a referential code 60*a* is a nonmagnetic rotational development sleeve, as a developer bearing/conveying member, in which a magnetic roll 60*b* is disposed. The tone particles t in the mixture (t+m) in the developer container 60*e* are carried in a layer on the peripheral surface of the rotational development sleeve 60*a*. As they are carried, the layer of the toner particles t on the development sleeve 60*a* is regulated in thickness by a regulating blade 60*c*, and the toner particles t becomes electrically charged. A referential code 60*d* designates a stirring member which continually conveys the toner particles in the developer container 60*e* to the adjacencies of the development sleeve 60*a* while circulating them.

The toner particles t coated on the peripheral surface of the rotating development sleeve 60*a* are conveyed by the rotation of the sleeve 60*a* to a development station a, which is where the peripheral surfaces of the photoconductive drum 1 and sleeve 60*a* virtually contact each other. To the sleeve 60*a*, development bias is applied from a development bias application power source S5.

In this embodiment, the development bias is a combination of DC and AC voltages. With the application of the development bias, an electrostatic latent image on the photoconductive drum 1 is developed in reverse by the toner particles t.

a) toner t: single-component toner t, as developer, is formed of bonding resin, pigment, magnetic particles, electrical charge controlling agent, and is manufactured through a mixing and kneading process, a pulverizing process, and a classifying process. To the thus manufactured toner t, charging particles m, fluidizing agent, and the like, are added. The average particle diameter (D4) of the toner t was 7 $\mu$m.

b) charging particles m: charging particles m are similar to those in the first embodiment.

(4) Charging Particle Amount on Charge Roller, and Coverage Ratio

The image recording apparatus in this embodiment is structured to recycle toner. Therefore, the charge roller surface is contaminated by a larger amount of toner than the amount of the toner which contaminates the charge roller surface in the first embodiment. In order for a toner particle to retain triboelectrical charge on its surface, it must be provided with an electrical resistance of no less than $10^{13}$ ohm.cm. Thus, as the charge roller 2A is contaminated by the toner particles t, the charging performance of the charge roller 2A reduces due to the electrical resistance added to the charge roller 2A by the toner particles t. Even if the electrical resistance of the charging particles t is low, as the toner particles t mix into the mixture of the charging particles and toner particles t borne on the charge roller 2A, the electrical resistance of the mixture increases, adversely affecting the charging performance of the charge roller 2A. Therefore, even if the value of (the amount by which the charging particles are borne)/the surface roughness Ra, is in a range similar to the range in the first embodiment, that is, in a range of 0.005–1, preferably, in a range of 0.02–0.3 mg/cm$^2$ $\mu$m, a large amount of toner particles are sometimes among the charging particles in this embodiment, naturally reducing the charging performance of the charge roller 2A. In such a case, the electrical resistance of the particle mixture on the peripheral surface of the charge roller 2A is higher than when the amount of the toner particles among the charging particles is smaller, and therefore, the occurrence of such a case can be detected. In other words, during an actual image forming operation, the charging particles (inclusive of toner particles, paper dust, and the like) borne on the charge roller 2A can be measured with the use of the above described method. The thus obtained value needs to be within a range of $10^{-1}$–$10^{12}$ ohm.cm, preferably, in a range of $10^{-1}$–$10^{10}$ ohm.cm.

Further, in order to grasp the effective amount of the charging particles m in a charging process, it is even more important to adjust the coverage ratio, that is, the ratio at which the peripheral surface of the charge roller 2A is covered with the charging particles m. Since a charging particles m are white, it is easy to distinguish them from toner particles, which are black. With the use of a microscope, the ratio of the white area is calculated. When the coverage ratio is no more than 0.1, even if the peripheral velocity of the charge roller 2A is increased, the charging performance of the charge roller 2A does not recover. Therefore, it is important that the coverage ratio by the charging particles m is kept within a range of 0.2–1.0.

Basically, the amount by which the charging particles m are borne on the charge roller 2A is adjusted by adjusting the amount of the charging particles m added to the developer t. If necessary, it is adjusted by placing an elastic blade in contact with a part of the peripheral surface of the charge roller 2A. This placement of the elastic blade is effective to rectify the polarity of the triboelectrical charge of a toner particle, as well as to adjust the amount by which the particles on the charge roller 2A are left on the charge roller 2A.

EMBODIMENT 3

Figure 5:
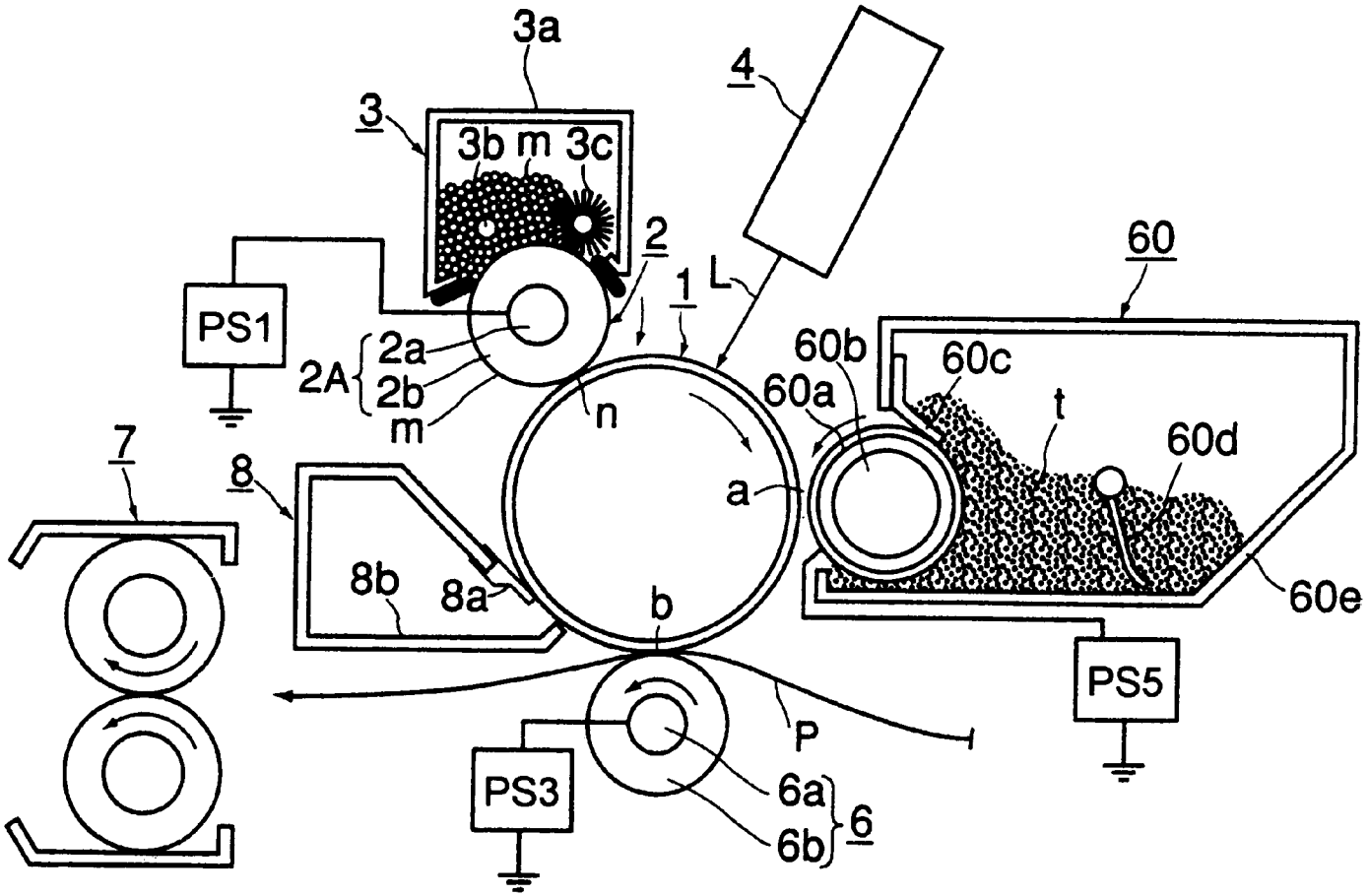
FIG. 5 is a schematic sectional view of the image recording apparatus in the third embodiment of the present invention.

FIG. 5 is a schematic sectional view of the image recording apparatus employing a charging apparatus in accordance with the present invention, in the third embodiment of the present invention, and shows the general structure thereof. The image forming apparatus in this embodiment is similar to the one in the first embodiment, except that instead of employing the two-component developing apparatus, this apparatus employs a reversal type developing apparatus 6, similar to the one in the second embodiment, which uses single-component magnetic developer. However, in the developer t for the developing apparatus 60, charging particles m are not mixed in advance. The charging particles m are coated on a charge roller 2A by the charging particle supplying device 3. The details of the various apparatuses in this embodiment are similar to the details of those in the first and second embodiments.

[Comparison between Image Forming Apparatus in Accordance with the Present Invention and Conventional Image Forming Apparatuses]

(1) EMBODIMENT 1

The image forming apparatus was similar to the one in the first embodiment, except that charging particles m having an electrical resistance of $10^4$ ohm were used as the charging particles, and were coated on the charge roller 2A by the charging particle supplying device 3. The electrical resistance of the charging particles m borne in advance on the charge roller 2A was also $10^4$ ohm. The amount by which the charging particles m are borne on the charge roller 2A was set to approximately 3 mg/cm$^2$.

(2) COMPARATIVE EXAMPLE 1

Figure 6:
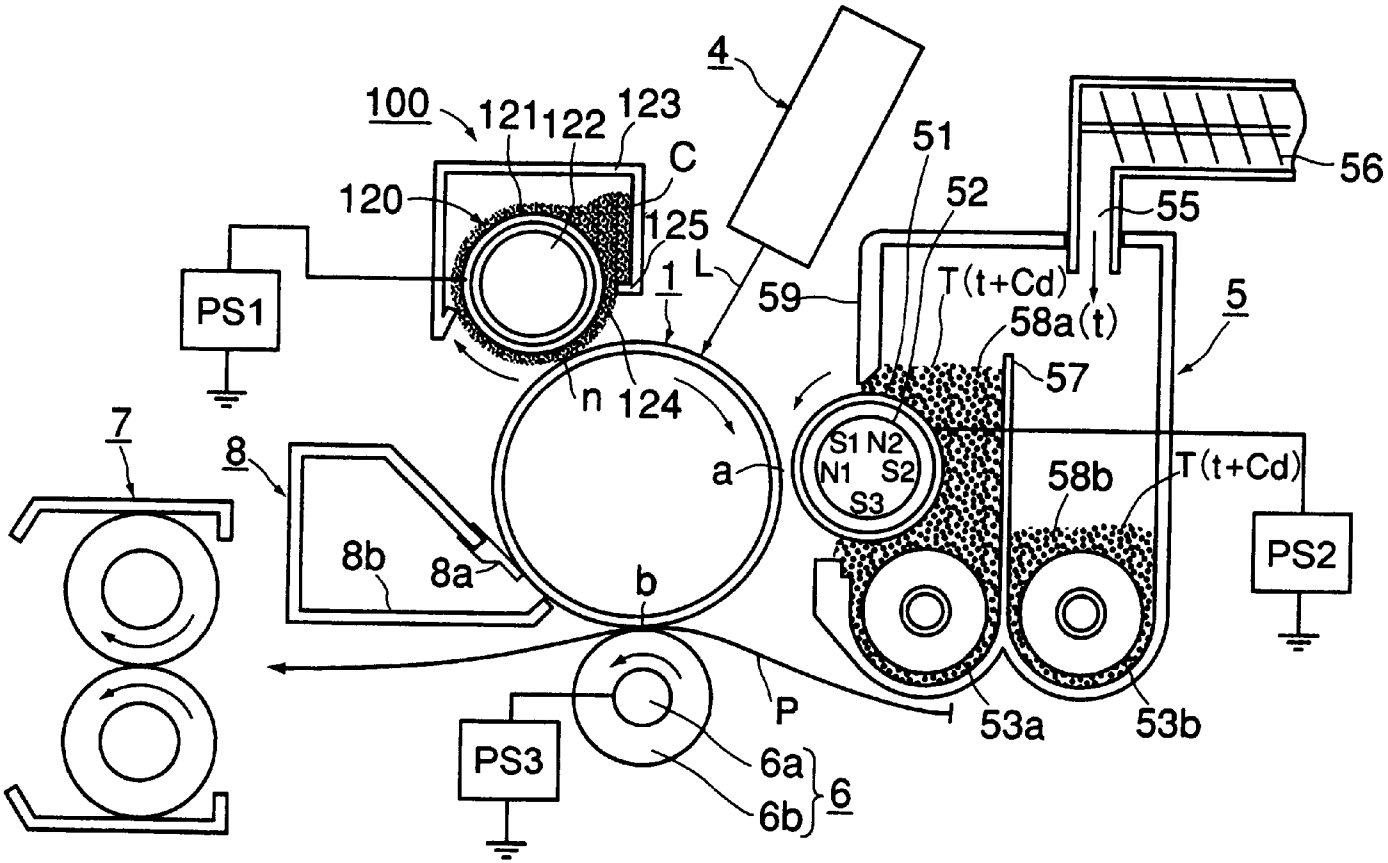
FIG. 6 PRIOR ART
FIG. 6 is a schematic sectional view of a conventional image recording apparatus.
Figure 7:
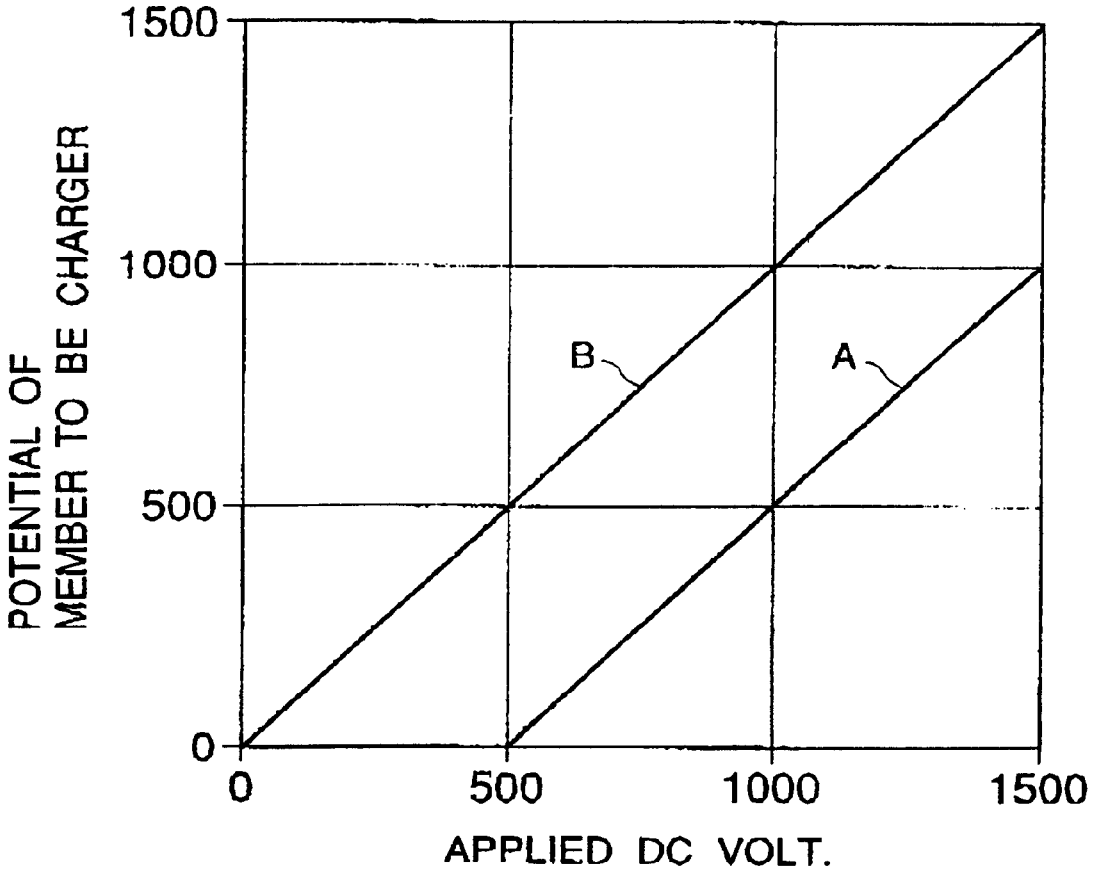
FIG. 7 is a graph for showing the charging performance characteristics of a conventional roller type charging apparatus, and a magnetic brush based charging apparatus.
Figure 8:
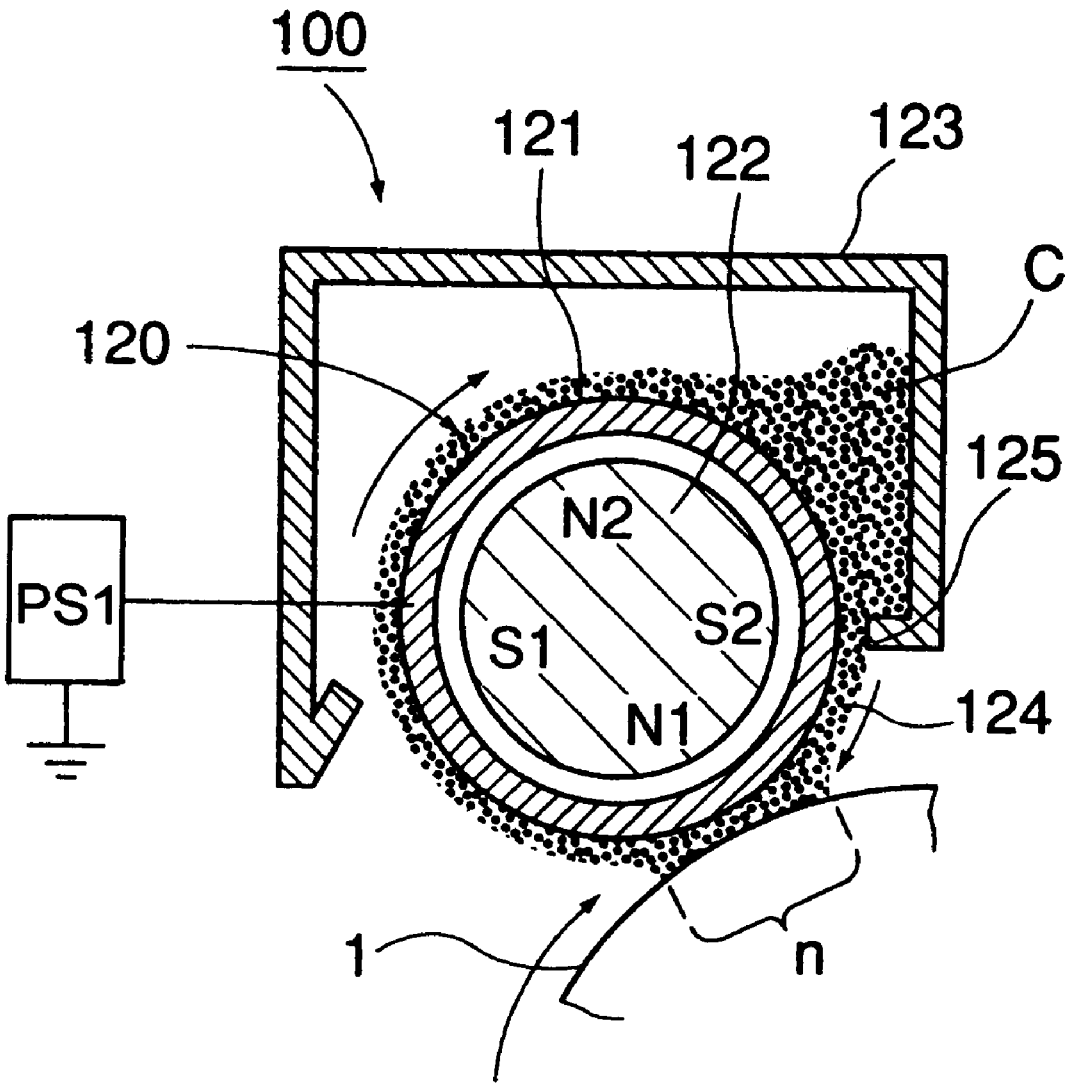
FIG. 8 PRIOR ART
FIG. 8 is a schematic sectional view of an example of a magnetic brush based charging apparatus.

A conventional image forming apparatus was used, and a magnetic brush type charging apparatus was used as a charging apparatus. FIG. 6 is a schematic sectional drawing for showing the image forming apparatus used in this first comparative example. This image forming apparatus was similar to the one in the first embodiment (FIG. 1), except that the charging apparatus 2 had been replaced with the above described magnetic brush type charging apparatus 100 in FIG. 8.

As for the electrically conductive magnetic particles C which made up the magnetic brush layer 124, ferrite particles, which are 30 $\mu$m in average particle diameter, $10^7$ ohm.cm in volumetric resistivity, and 60 A.m$^2$/kg in saturation magnetization, were used.

The average particle diameter of the electrically conductive magnetic particles C is shown in horizontal maximum chord length. It was calculated by arithmetically averaging the values obtained by actually measuring the diameters of the no less than 300 randomly selected electrically conductive magnetic particles C, with the use of a microscope.

An electrically conductive magnetic particle layer 124 was formed on a charge sleeve 121 so that the amount of the electrically conductive magnetic particles C on the charge sleeve 121 became 200 mg/cm$^2$.

(3) COMPARATIVE EXAMPLE 2

A conventional image forming apparatus employing the magnetic brush type charging apparatus 100 was employed as in the first comparative example. However, in order to improve the charging performance of the charge roller 2A, electrically conductive magnetic particles C which were 7 μm in average diameter were used. The amount of the electrically conductive magnetic particles C on the charge sleeve 121 was 200 mg/cm$^2$ which was the same as that in the first comparative example.

(4) COMPARATIVE EXAMPLE 3

An image forming apparatus similar to the one in the third embodiment was used, except that silica particles which were 0.05 μm in particle diameter and $10^{13}$ ohm.cm in electrical resistance, were used as the charging particles m to be borne on the charge roller 2A.

(5) EMBODIMENT 2

An image forming apparatus similar to the one in the third embodiment was used, except that alumina particles (alumina powder) which were 0.2 μm in average particle diameter and $10^{12}$ ohm.cm in electrical resistance was used as the charging particles m to be borne on the charge roller 2A.

(6) EMBODIMENT 3

An image forming apparatus similar to the one in the third embodiment was used, except that particles of titanium oxide doped with tin oxide, which were 0.2 μm in diameter and $10^{-1}$ ohm.cm in electrical resistance were used as the charging particles m to be borne on the charge roller 2A.

(7) COMPARATIVE EXAMPLE 4

An image forming apparatus similar to the one in the third embodiment was used, except that particles of titanium oxide doped with tin oxide, which were 0.2 μm in diameter and $10^{-2}$ ohm.cm in electrical resistance were used as the charging particles m to be borne on the charge roller 2A.

(8) EMBODIMENTS 4, 5, 6, 7 AND 8, AND COMPARATIVE EXAMPLE 5

An image forming apparatus similar to the one in the third embodiment was used, except that zinc oxide particles which were 0.01, 0.05, 0.1, 5, 10, and 30 μm in diameter, respectively, and were $10^4$ ohm.cm, respectively, in electrical resistance, were used as the charging particles m to be borne on the charge roller 2A.

(9) COMPARATIVE EXAMPLE 6, EMBODIMENTS 9, 10, 11, 12 AND 13, AND COMPARATIVE EXAMPLE 7

An image forming apparatus similar to the one in the third embodiment was used, except that zinc oxide particles which were 3 μm in diameter and $10^4$ ohm.cm in electrical resistance were used as the charging particles m to be borne on the charge roller 2A. The amounts of the charging particles m to be borne on the charge roller 2A was set to 0.05, 0.25, 1.5, 15, 50, and 100 mg/cm$^2$, respectively.

(10) COMPARATIVE EXAMPLE 8, EMBODIMENTS 13, 14, 15, 16 AND 17, AND COMPARATIVE EXAMPLE 9

An image forming apparatus similar to the image forming apparatus in the third embodiment was used, except that a charge roller, the peripheral surface of which was 10 μm in average roughness, was used in place of the charge roller 2A, and that zinc oxide particles which were 3.0 μm in diameter and $10^4$ ohm.cm in electrical resistance were used as the charging particles m to be borne on the charge roller 2A. The amounts of the charging particles m to be borne on the charge roller was set to 0.01, 0.05, 0.2, 1.3, 10, and 50 mg/cm$^2$, respectively.

(11) COMPARATIVE EXAMPLE 10

An image forming apparatus similar to the one in the second embodiment was used, except that absolutely no charging particles m were used. In other words, the image forming apparatus was not provided with the charging particle supplying device 3 for the charge roller 2A, and no charging particles m were mixed in advance into the developer t in the developing apparatus 60.

(12) EMBODIMENT 18

An image forming apparatus similar to the one in the second embodiment was used, except that the charging particles m were added to the developer t by 0.5 part in weight.

(13) EMBODIMENTS 19

An image forming apparatus similar to the one in the second embodiment, except that the charging particles m were added to the developer t by 2 parts in weight.

(13) METHOD FOR EVALUATING EMBODIMENTS AND COMPARATIVE EXAMPLES a) Measurement of Amount and Resistance of Charging particles The weight and electrical resistance of the particles on a charge roller was measured by cleansing the particles on the charge roller.

Washing liquid is concocted by mixing 1 part of ethanol and 2 parts of water, and was placed in a ultrasonic washer. Then, a charge roller was repeatedly washed in the ultrasonic washer. During the intervals of the repeated washing of the charge roller, the peripheral surface of the charge roller was examined with the use of an optical microscope to assure that the particles adhering to the peripheral surface of the charge roller were completely removed. If necessary, the peripheral surface of the charge roller was scraped by a blade or the like.

After the repeated washing of the charge roller, the washing liquid was left for one to two hours. Then, after the pure supernatant washing liquid was removed, the residue was thoroughly dried at 105 deg. to procure the particles which had been on the charge roller.

The electrical resistance of the particles was measured using the above described tablet method.

The amount of the particles which had been on each unit area of the peripheral surface of the charge roller could be calculated from the total weight of the thus procured particles and the size of the peripheral surface of the charge roller (which were calculated from the length and external diameter of the charge roller). Therefore, the amount of the particles on the charge roller was obtained as the amount of the particles per unit area of the peripheral surface of the charge roller.

The amount of the magnetic particles in the magnetic brush was directly measured. In other words, the magnetic particles on the peripheral surface of the sleeve after the coating of the magnetic particles thereon, were directly collected, and the collected amount of the magnetic particles was measured.

b) Measurement of Charging particle Coverage Ratio

The charge roller coverage ratio of the charging particles was calculated by measuring the size of the area of the peripheral surface of the charge roller covered with electrically conductive particles, with the use of a microscope, when the condition of the peripheral surface of the charge roller was close to the condition in which the charge roller was placed in contact with the photoconductive drum 1. More specifically, the application of charge bias was stopped, and the rotation of the photoconductive drum 1 and charge roller 2A was also stopped. Then, the peripheral surfaces of the photoconductive drum 1 and charge roller 2A were photographed by a video-microscope OVM1000N (Olympus Optical Co., Ltd.) and a digital still recorder SR-3100 (Deltis Co., Ltd.). The charge roller 2A was placed in contact with a slide glass in the same manner as it was placed in contact with the photoconductive drum 1, and the interface between the charge roller 2A and slide glass was photographed through the slide glass by the video-microscope fitted with an object lens with a power of 1000×. Then, the areas coated with the charging particles are identified by comparing the color or luminance of the areas with that of the charging particles obtained in advance. Then, the ratio of the total of the areas covered with the charging particles to the size of the interface was calculated, and this ratio was used as the ratio of the charging particle coverage over the peripheral surface of the charge roller 2A. When identification based on color was difficult, the substances on the peripheral surface of the roller were examined with the use of a fluorescent X-ray analysis apparatus System 3080 (Rigaku Denki Kogyo Co., Ltd.). First, a piece of adhesive tape No. 555 (#25) (Nichiban Co., Ltd.) was placed between the charge roller in the initial state, that is, the state in which only the charging particles were on the charge roller, and photoconductive drum, with the adhesive side of the tape facing the roller, and the tape was passed once through the nip between the drum and roller, by rotating the drum and roller, the roller being rotated by the rotation of the drum. While the tape was passed through the nip, the particles on the peripheral surface of the charge roller were adhered to the surface of the tape; the charging particles on the charge roller were sampled (Sample 1). Further, the particles on the charge roller were sampled in the same manner after a printing test. The coverage ratio could be obtained by determining the amount of a specific element in a charging particle. In other words, the coverage ratio could be obtained by calculating the ratio of the specific element on the sample after the printing test, relative to the specific element on Sample 1, that is, the tape holding only the electrically conductive particles.

c) Charging Performance Evaluation

The charging performance was evaluated based on a ghost. Since the printers used in the above listed embodiments and comparative examples were reversal development type image recording apparatuses, the ghost on which the evaluation was based was such a ghost that appeared for the following reason. That is, the areas of the peripheral surface of the photoconductive drum, to which toner particles have adhered during the preceding rotation of the photoconductive drum, that is, the areas, the patterns of which reflect the image pattern formed on the peripheral surface of the photoconductive drum during the preceding rotation of the photoconductive drum, are insufficiently charged during the following rotation of the photoconductive drum. Thus, if these insufficiently charged areas are exposed during the formation of a latent image during the following rotation of the photoconductive drum, an excessive amount of toner particles adheres to these areas, during the following rotation of the photoconductive drum. As a result, a subtle pattern, or a ghost, reflecting the image pattern formed during the preceding rotation of the photoconductive drum appears in the portion of an image being formed during the following rotation. In the above listed embodiments and comparative examples, images were evaluated based on the following criteria.

N (No good): ghost is visible in white areas correspondent to the solid black areas formed during the preceding rotation, F (Fiar): no ghost is visible in white areas correspondent to preceding solid black areas, but vague ghost patterns are visible in half-tone areas, G (Good): no ghost is visible either in white areas correspondent to preceding solid black areas or half-tone areas.

The images were evaluated with respect to ghost, flawed development, and fog, after the printing of the 100th and 4000th copies.

The printing tests were carried out using a print ratio of 5%, and a pattern which was uniform in print ratio in terms of the lengthwise direction was printed.

d) Unsatisfactory Development (image defect evaluation)

Half-tone images were outputted with the use of the printers connected to a laser scanner with a resolution of 600 dpi, and evaluations were made based on the number of image defects.

A half-tone image in this evaluation means an image having a uniform striped pattern formed by repeating a process in which a line is printed in the primary scanning direction, and next two rasters are skipped.

In the above listed printers, images were formed using a reversal development system. Therefore, a point on the peripheral surface of the photoconductive drum, which failed to be exposed, or through which leakage occurred, appeared as a white spot in an image. Thus, the images were evaluated with reference to the following criteria based on the number of defective spots in an image.

In the present invention, emphasis was placed on the uniformity of the half-toner portion of an image, and the number of the image defects greater in diameter than 0.3 mm was counted.

N: more than 50 white spots greater in diameter than 0.3 mm were present in a half-tone image, F: 5 to 50 white spots greater in diameter than 0.3 mm were present in a half-tone image, G: no more than 5 white spots greater in diameter than 0.3 mm were in a half-tone image.

e) Fog Evaluation

Fog is such an image defect that the portions of a latent image correspondent to the white portions of an intended image (unexposed portions of the peripheral surface of the photoconductive drum) are slightly developed by toner, appearing as if the recording paper on which an image was formed has been soiled.

The amount of fog was obtained as an optical reflectance measured by an optical reflectance meter TC-6DS (Tokyo Denshoku Co., Ltd.) fitted with a green filter. More specifically, the amount of fog was obtained as the difference obtained by subtracting the optical reflectance of a recording paper with no image, from that of the fog portion. In the following tables, the amount of fog is an average of the amounts of fog on no less than 10 spots on a recording paper.

N: fog amount exceeded 10%,

F: fog amount was within a range of 2–10%,

G: fog amount was no more than 2%.

(14) Evaluation Results

The results of the above described evaluations of embodiments and comparative examples are summarized in the following Evaluation Result Tables 1, 2, 3 and 4.

EVALUATION TABLE 1

| | Particle supply means/particle size | Dev. Device (Developer) | Res. (Ω.cm) | Particle amount (mg/cm$^2$) | Roller roughness Ra (μm) | Amount/ Ra | Cover-age ratio | Perfor-mance | Development | Fog on sheet |
|---|---|---|---|---|---|---|---|---|---|---|
| EMB. 1 | APPLICATOR/ 3 μm | TWO-COMP. NO CON. PRTCL | $10^4$ | 3 | 50 | 0.06 | 0.8 | G→G<br>G→G | G→G<br>G→G | G→G<br>F→F |
| COMP. 1 | MAG. BRUSH/ MAG. 30 μm | TWO-COMP. NO CON. PRTCL | $10^6$ | 200 | 1.2 | 167 | — | G→F<br>N | G→G<br>N<br>MAG SNSR MALFUNC | G→G<br>N |
| COMP. 2 | MAG. BRUSH/ MAG. 7 μm | TWO-COMP. NO CON. PRTCL | $10^5$ | 200 | 1.2 | 167 | — | N<br>N | N<br>N | N<br>N |
| COMP. 3 | APPLICATOR/ 0.05 μm | ONE-COMP MAG. TNR NO CON. PRTCL | $10^{13}$ | 5 | 50 | 0.1 | 0.9 | N<br>N | N<br>N | N<br>N |
| EMB. 2 | APPLICATOR/ 0.2 μm | ONE-COMP MAG. TNR NO CON. PRTCL | $10^{12}$ | 5 | 50 | 0.1 | 0.9 | G→F<br>F→N | G→G<br>F→N | G→G<br>F→N |
| EMB. 3 | APPLICATOR/ 0.2 μm | ONE-COMP MAG. TNR NO CON. PRTCL | $10^{-1}$ | 5 | 50 | 0.1 | 0.9 | G→G<br>G→G | F→F<br>F→F | F→F<br>F→F |
| COMP. 4 | APPLICATOR/ 0.2 μm | ONE-COMP MAG. TNR NO CON. PRTCL | $10^{-2}$ | 5 | 50 | 0.1 | 0.9 | G→G<br>G→G | N→N<br>N→N | F→N<br>F→N |

EVALUATION TABLE 2

| | Particle supply means/particle size | Dev. Device (Developer) | Res. (ohm.cm) | Particle amount (mg/cm$^2$) | Roller roughness Ra (μm) | Amount/ Ra | Cover-age ratio | Perfor-mance | Development | Fog on sheet |
|---|---|---|---|---|---|---|---|---|---|---|
| EMB. 4 | APPLICATOR/ 0.01 μm | ONE-COMP MAG. TNR NO CON. PRTCL | $10^4$ | 5 | 50 | 0.1 | 0.9 | G→G<br>G→G | F→F<br>F→F | F→F<br>F→F |
| EMB. 5 | APPLICATOR/ 0.05 μm | ONE-COMP MAG. TNR NO CON. PRTCL | $10^4$ | 5 | 50 | 0.1 | 0.9 | G→G<br>G→G | G→G<br>G→G | F→F<br>F→F |
| EMB. 6 | APPLICATOR/ 0.1 μm | ONE-COMP MAG. TNR NO CON. PRTCL | $10^4$ | 5 | 50 | 0.1 | 0.9 | G→G<br>G→G | G→G<br>G→G | G→G<br>G→G |
| EMB. 7 | APPLICATOR/ 5 μm | ONE-COMP MAG. TNR NO CON. PRTCL | $10^4$ | 5 | 50 | 0.1 | 0.9 | G→G<br>G→G | G→G<br>G→G | G→G<br>G→G |
| EMB. 8 | APPLICATOR/ 10 μm | ONE-COMP MAG. TNR NO CON. PRTCL | $10^4$ | 5 | 50 | 0.1 | 0.9 | G→G<br>F→F | F→F<br>F→F | G→G<br>G→G |
| COMP. 5 | APPLICATOR/ 30 μm | ONE-COMP MAG. TNR NO CON. PRTCL | $10^4$ | 5 | 50 | 0.1 | 0.9 | G→F<br>N | N→N<br>N | F→F<br>N |

EVALUATION TABLE 3

| | Particle supply means/particle size | Dev. Device (Developer) | Res. (ohm.cm) | Particle amount (mg/cm$^2$) | Roller roughness Ra (μm) | Amount/ Ra | Cover-age ratio | Perfor-mance | Development | Fog on sheet |
|---|---|---|---|---|---|---|---|---|---|---|
| COMP. 6 | APPLICATOR/ 3 μm | ONE-COMP MAG. TNR NO CON. PRTCL | $10^4$ | 0.05 | 50 | 0.001 | 0.1 | F<br>N | G<br>N | N<br>N |
| EMB. 9 | APPLICATOR/ 3 μm | ONE-COMP MAG. TNR NO CON. PRTCL | $10^4$ | 0.25 | 50 | 0.005 | 0.4 | G→F<br>F→N | G→G<br>G→G | G→F<br>F→N |
| EMB. 10 | APPLICATOR/ 3 μm | ONE-COMP MAG. TNR NO CON. PRTCL | $10^4$ | 1 | 50 | 0.02 | 0.6 | G→G<br>G→G | G→G<br>G→G | G→G<br>G→G |
| EMB. 11 | APPLICATOR/ 3 μm | ONE-COMP MAG. TNR NO CON. PRTCL | $10^4$ | 5 | 50 | 0.1 | 0.9 | G→G<br>G→G | G→G<br>G→G | G→G<br>G→G |
| EMB. 12 | APPLICATOR/ 3 μm | ONE-COMP MAG. TNR NO CON. PRTCL | $10^4$ | 15 | 50 | 0.3 | 0.9 | G→G<br>G→G | G→G<br>G→G | G→G<br>G→G |
| EMB. 13 | APPLICATOR/ 3 μm | ONE-COMP MAG. TNR NO CON. PRTCL | $10^4$ | 50 | 50 | 1 | 0.9 | G→G<br>G→G | F→F<br>F→N | F→F<br>F→N |
| COMP. 7 | APPLICATOR/ 3 μm | ONE-COMP MAG. TNR NO CON. PRTCL | $10^4$ | 100 | 50 | 2 | 0.9 | G<br>G | N<br>N | N<br>N |
| COMP. 8 | APPLICATOR/ 3 μm | ONE-COMP MAG. TNR NO CON. PRTCL | $10^4$ | 0.01 | 10 | 0.001 | 0.1 | F<br>N | G<br>N | N<br>N |
| EMB. 13 | APPLICATOR/ 3 μm | ONE-COMP MAG. TNR NO CON. PRTCL | $10^4$ | 0.05 | 10 | 0.005 | 0.3 | G→F<br>N | G→G<br>G | G→F<br>N |
| EMB. 14 | APPLICATOR/ 3 μm | ONE-COMP MAG. TNR NO CON. PRTCL | $10^4$ | 0.2 | 10 | 0.02 | 0.5 | G→G<br>G→G | G→G<br>G→G | G→G<br>G→G |
| EMB. 15 | APPLICATOR/ 3 μm | ONE-COMP MAG. TNR NO CON. PRTCL | $10^4$ | 1 | 10 | 0.1 | 0.8 | G→G<br>G→G | G→G<br>G→G | G→G<br>G→G |
| EMB. 16 | APPLICATOR/ 3 μm | ONE-COMP MAG. TNR NO CON. PRTCL | $10^4$ | 3 | 10 | 0.3 | 0.9 | G→G<br>G→G | G→G<br>G→G | G→G<br>G→G |

EVALUATION TABLE 3-continued

| | Particle supply means/particle size | Dev. Device (Developer) | Res. (ohm.cm) | Particle amount (mg/cm$^2$) | Roller roughness Ra ($\mu$m) | Amount/ Ra | Cover-age ratio | Perfor-mance | Development | Fog on sheet |
|---|---|---|---|---|---|---|---|---|---|---|
| EMB. 17 | APPLICATOR/ 3 $\mu$m | ONE-COMP MAG. TNR NO CON. PRTCL | $10^4$ | 10 | 10 | 1 | 0.9 | G→G<br>G→G | F→F<br>F→F | F→F<br>F→F |
| COMP. 9 | APPLICATOR/ 3 $\mu$m | ONE-COMP MAG. TNR NO CON. PRTCL | $10^4$ | 50 | 10 | 5 | 0.9 | G<br>G | N<br>N | F<br>F |

EVALUATION TABLE 4

| | Particle supply means/particle size | Dev. Device (Developer) | Res. (ohm.cm) | Particle amount (mg/cm$^2$) | Roller roughness Ra ($\mu$m) | Amount/ Ra | Cover-age ratio | Perfor-mance | Development | Fog on sheet |
|---|---|---|---|---|---|---|---|---|---|---|
| COMP. 10 | NO | ONE COMP MAG/NO CON. PRTCL/ SIMUL. DEV & CLN | $10^{14}$ | 10 | 50 | 0.2 | 0 | N<br>N | N<br>N | N<br>N |
| EMB. 18 | DVLPR SUPPLY/ 3 $\mu$m | ONE COMP MAG/0.5 PARTS CON. PRTCL/SIMUL. DEV & CLN | $10^5$ | 1 | 50 | 0.02 | 0.2 | G→G<br>F→F | G→G<br>G→F | G→G<br>F→F |
| EMB. 19 | DVLPR SUPPLY/ 3 $\mu$m | ONE COMP MAG/2 PARTS CON. PRTCL/SIMUL. DEV & CLN | $10^5$ | 3 | 50 | 0.06 | 0.5 | G→G<br>G→G | G→G<br>G→G | G→G<br>F→F |

Next, the results of the evaluations of the embodiments of the present invention, and comparative examples, will be described, and also the effectiveness of the present invention will be described.

In each of the embodiments and comparative examples, two different structures were evaluated. In the each row of the tables, the evaluation at the top represents the photoconductive drum 1*a* with a charge injection layer (FIG. 2(*a*)), and the evaluation at the bottom represents the photoconductive drum 1*b* with no charge injection layer (FIG. 2(*b*)).

The photoconductive drum 1*b* with no charge injection layer was higher in the electrical resistance of its peripheral surface. Therefore, it required a charging apparatus with a higher density. Thus, the state of the contact between its charging member and the correspondent photoconductive drum was evaluated under more strict conditions.

In Comparative Example 1, the image forming apparatus was an image forming apparatus equipped with a charging apparatus based on a magnetic brush, and its charging performance was inferior, in particular, when it was used for charging the photoconductive drum 1*b* with no charge injection layer. Further, the amount of the magnetic charging particles C which transferred onto the photoconductive drum 1 was large. As a result, development leakage occurred, along with the problems regarding the detection of the amount of the toner within the developer.

In Comparative Example 2, the image forming apparatus was the same as the one in Comparative Example 1, but charging particles with a diameter of 7 $\mu$m were used to improve the apparatus performance. The apparatus performance was definitely better, in particular, at the initial stage of the charge roller usage. However, the loss of the charging particles became conspicuous after the printing of merely the 100th copy. Further, the durability of the charge roller performance was insufficient even when the charge roller was used with a photoconductive drum with a charge injection layer.

On the other hand, in Embodiment 1, zinc oxide particles with an average diameter of 3 $\mu$m, which were electrically conductive particles, were used as the charging particles m to improve the contact density. Further, the zinc oxide particles were coated at a ratio (density) of 3 mg/cm$^2$. As a result, the loss of the charging particles m onto the photoconductive drum 1 reduced. The reduction in the amount by which the charging particles were coated, and the reduction in the average diameter of the charging particles m, made improvement in the apparatus performance in terms of such problems as unsatisfactory development and fog generation, for which the loss of the charging particles is responsible.

In Comparative Examples 3 and 4, and Embodiments 2 and 3, the electrical resistance of the charging particles m was in a proper range; the electrical resistance of the charging particles m borne on the charge roller 2A is desired to be in the range of $10^{12}$–$10^{-1}$ ohm. In Comparative Example 3, in which the electrical resistance of the charging particles m was $10^{13}$ ohm, it was virtually impossible for electrical charge to be given from the charge roller to the photoconductive drum, and therefore, the charging performance was insufficient. In comparison, in the case of the charging particles with an electrical resistance of $10^{-2}$ ohm, development bias leaked during the development process, resulting in an image with conspicuous defects.

In Comparative Example 5, and Embodiments 4–8, the average diameter of the charging particles m was in a proper range; a range of 0.01 $\mu$m–10 $\mu$m is the desirable range for the average diameter of the charging particles m borne on the charge roller 2A. In consideration of the fog on the recording paper, a range of 0.1–5 $\mu$m is the preferable range.

In Embodiment 4, zinc oxide particles, which were smallest in average diameter of all of the commonly used charging particles, was used as the charging particles m. The employment of zinc oxide particles was slightly disadvantageous in terms of unsatisfactory development and fog generation, but provided sufficient charging performance.

On the other hand, Comparative Example 5, in which the charging particles with an average diameter of 30 $\mu$m were employed, proved that the employment of charging particles with a larger average diameter was disadvantageous in terms of contact density, resulting in poor charging performance.

Since the charging particles larger in average diameter (30 μm) were weaker in their adhesiveness to the charge roller 2A, the charging particles were lost to the photoconductive drum 1 by a larger amount, resulting in unsatisfactory development and/or fog generation.

In Comparative Examples 6, 7, 8 and 9, and Embodiments 9–17, the charging particles m were borne by a proper amount, there were proper amounts by which the charging particles were borne according to the average roughness Ra of the peripheral surface of the charge roller. Thus, when the value of the amount of the charging particles borne on the charge roller normalized with the use of Ra, or the value of (the charging particle amount on the charge roller)/Ra, was used as an index for determining the amount by which the charging particles were coated on the charge roller, preferable images were obtained.

In Comparative Example 6, in which the charging particles were borne on the charge roller 2A by 0.05 mg, the charging performance was insufficient. In comparison, in Embodiment 13, in which the charging particles were borne also by 0.05 mg, the average roughness of the peripheral surface of the charge roller was 10 μm, and the value obtained by dividing the charging particle amount on the charge roller by Ra was 0.005, being larger than that (0.001) in Comparative Example 6. Thus, Embodiment 13 was superior to Comparative Example 6 in terms of charging performance, which is easily understandable.

In the case of Comparative Example 7, in which the amount of the charging particles borne on the charge roller was 100 mg/cm$^2$, the charging performance was satisfactory, but the amount of the charging particles was too much for all the charging particles to be kept on the charge roller 2A. Therefore, a significant amount of the charging particles was lost to the photoconductive drum 1, resulting in developmental imperfection, and/or the fog. Thus, reducing to 50 mg/cm$^2$ the amount by which the charging particles were borne, in other words, reducing the value of (the charging particles amount)/R1 to 1, a proper amount of the charging particles was borne on the peripheral surface of the charge roller. However, even when the amount of the charging particles on the charging roller was 50 mg, when the value of (charging particle amount)/Ra was 5 as was in Comparative Example 9, the amount of the charging particles was too much for the average roughness of the peripheral surface of the charge roller. As a result, immoderate developmental imperfection occurred. This proved that there is a proper range for the amount by which charging particles should be coated on a charge roller according to the average roughness of the peripheral surface of the charge roller. Simply stated, by making adjustments so that the value of (charging particle amount on charge roller)/Ra falls within a range of 0.005–1.00, preferably, a range of 0.02–0.30, both charging performance and developing performance can be made excellent.

Further, regarding the cleanerless apparatus in Embodiment 2, the evaluations of Comparative Example 10 and Embodiments 18 and 19 show that there is available a structural arrangement for providing the charge roller 2A with an optimal charging particle coverage ratio when two or more types of particles are coated on the charge roller 2A.

In Comparative Example 10, the charge roller was charged without using charging particles. The amount of the particles was 10 mg/cm$^2$, but all were toner particles. Further, the electrical resistance of the particles was $10^{14}$ ohm.cm, which was relatively high. Consequently, the charging performance was unsatisfactory.

In comparison, in Comparative Examples 18 and 19, the particle resistance and particle amount were both in the above described proper ranges, and the charging and developing performances, as well as image quality in terms of fog, were satisfactory, although the coverage ratio was slightly low.

As is evident from the above description, the coverage ratio is desired to be in a range of 0.2–1.0.

Next, the embodiments of the present invention other than those described above will be described.

[Charging Method Using Nonmagnetic Charging Particles, and Toner Recycling System]

Regarding an image forming apparatus, an image formation process, which does not involve electrical discharge and does not produce waste toner, being therefore environmentally advantageous, can be realized by combining a charging particles based charging method and a toner recycling system.

In particular, by combining a method for charging a photoconductive member with the use of nonmagnetic charging particles, and a toner recycling system, it became possible to supply the charging particles to a charging nip, by supplying the charging particles, along with toner particles, from a developing apparatus to a photoconductive member.

In other words, in a charging method using nonmagnetic charging particles, the amount of the charging particles in the charging nip decreases as the particles are gradually carried away by a photoconductive member as they adhere to the photoconductive member. Therefore, it is necessary to supply charging particles to the adjacencies of the charging member with the use of a method of some type. As for such a method, there are a method for directly coating the charging member with charging particles, a method for supplying the charging member with charging particles, by coating charging particles on the photoconductive member, and the like methods. However, in consideration of the compatibility of such a method with a toner recycling system, charging particles are mixed in advance into the developer in a developing apparatus, so that the charging particles are supplied, along with the developer, to a photoconductive member from the developing apparatus, and then, are delivered to a charging nip by the rotation of the photoconductive member.

More specifically, the charging particles are developed (adhered or supplied), along with toner particles, onto the photoconductive member, through the developing process, and then, are supplied to the charging member from the photoconductive member. This method is advantageous in that it allows the elimination of a cleaner for a photoconductive member (drum cleaner) and also makes it possible to circulate toner particles while supplying charging particles.

[Noncontact Developing Method Employing Magnetic Toner]

Since charging particles are nonmagnetic, it is possible to construct a system superior in image quality, by employing a developing apparatus, which employs a noncontact developing method which uses single-component magnetic toner (noncontact developing apparatus employing magnetic toner).

Because of the effects of the application of a combination of DC and AC voltage as bias, as well as other effects, a noncontact developing method which uses magnetic toner is widely in use as a highly reliable, high resolution developing method, from low speed machines to medium to high speed machines. It is used with a developing apparatus (developing device) and comprises a nonmagnetic development sleeve in the form of a rotational cylinder, which contains a magnet, and a blade. It develops a latent image by coating a layer of magnetic toner having predetermined electrical charge, on the nonmagnetic sleeve with the use of magnetic force; the thickness of the magnetic toner layer is regulated by the blade.

A noncontact developing method which uses magnetic toner is characterized in that fog reduction effect is provided by the magnetic force; the effect that toner particles are adhered to the non-image portions because of the improper electrical charge of toner particles (over- or undercharged, or reversed in polarity) is suppressed by some degree, by the magnetic force.

However, a toner recycling type image forming apparatus, which employs the above described charging method using nonmagnetic charging particles, and a noncontact developing method using magnetic toner, suffers from a problem that as the cumulative usage of the developing apparatus increases, fog increases while density decreases.

To concisely state again the characteristics of a noncontact developing method which uses magnetic toner, magnetic toner is uniformly subjected to magnetic force in addition to coulomb force generated by the toner charge and development bias. Therefore, the amount of the fog caused by toner particles improper in potential level or polarity is smaller.

However, as the cumulative usage of the toner recycling system increases, the amount of fog increases. It is speculated that this is caused by the accumulation of deteriorated toner particles in the developing apparatus.

In a toner recycling process, transfer residual toner particles are charged again by friction, and recovered by the developing apparatus to be reused. However, when toner particles are magnetic, toner particles improper in potential level are also recovered, continuously deteriorating the toner within the developing apparatus. Eventually, the deterioration of the toner manifests as developmental flaws such as fog increase or density decrease.

Of course, it is possible to control development bias in order to control what type of toner particles are taken into the developing apparatus, and also there are ways to compensate for the occurrence of the developmental flaws. However, modification of development bias affects image resolution or image quality such as sharpness, creating a difficult problem of balancing development bias modification against image quality.

Further, in the early stage of a printing operation, problems occur because an excessive amount of charging particles is supplied to a photoconductive member. This problem is sometimes recognized as the presence of unevenly distributed toner particles across an outputted copy. It is speculated that this occurs for the following reason. That is, charging particles are nonmagnetic, whereas toner particles are magnetic and are attracted by magnetic force. Therefore, in the early stage of a printing operation, in which the amount of charging particles is substantially larger, a large amount of charging particles is developed (adhered) onto the peripheral surface of the photoconductive member, and toner particles are adhered (developed) onto the charging particles on the peripheral surface of the photoconductive member. Thus, as a toner image is transferred onto a recording medium (recording paper), the charging particles are unevenly distributed across the toner image on the recording medium.

The following embodiments of the present invention solve the above described problems of an image forming apparatus, which employs a charging method using nonmagnetic charging particles, as a means for charging an image bearing member, a transfer type image forming method, and a toner recycling type.

EMBODIMENT 20

Figure 9:
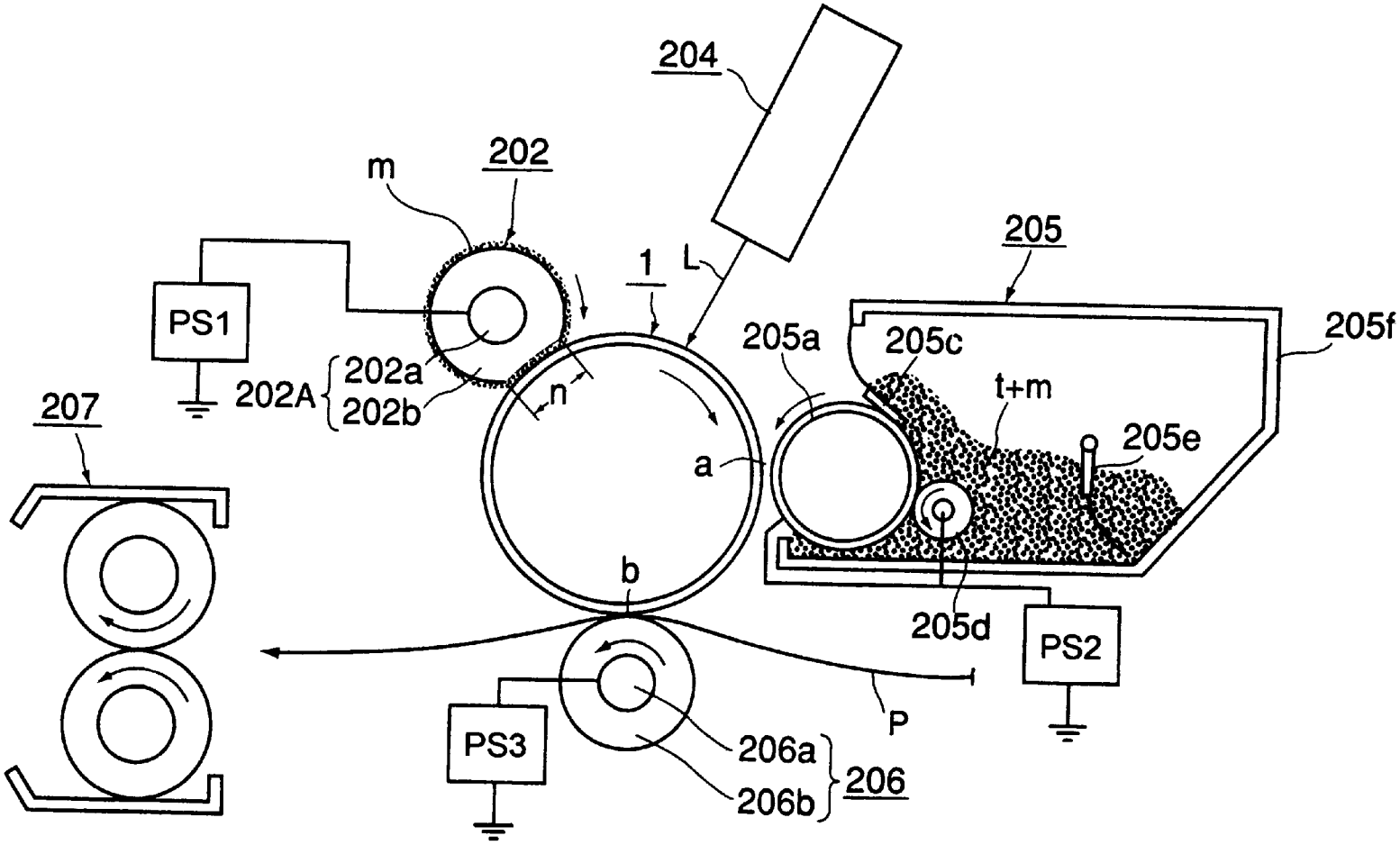
FIG. 9 is a schematic sectional view of the image forming apparatus in one of the additional embodiments of the present invention.
Figure 10:
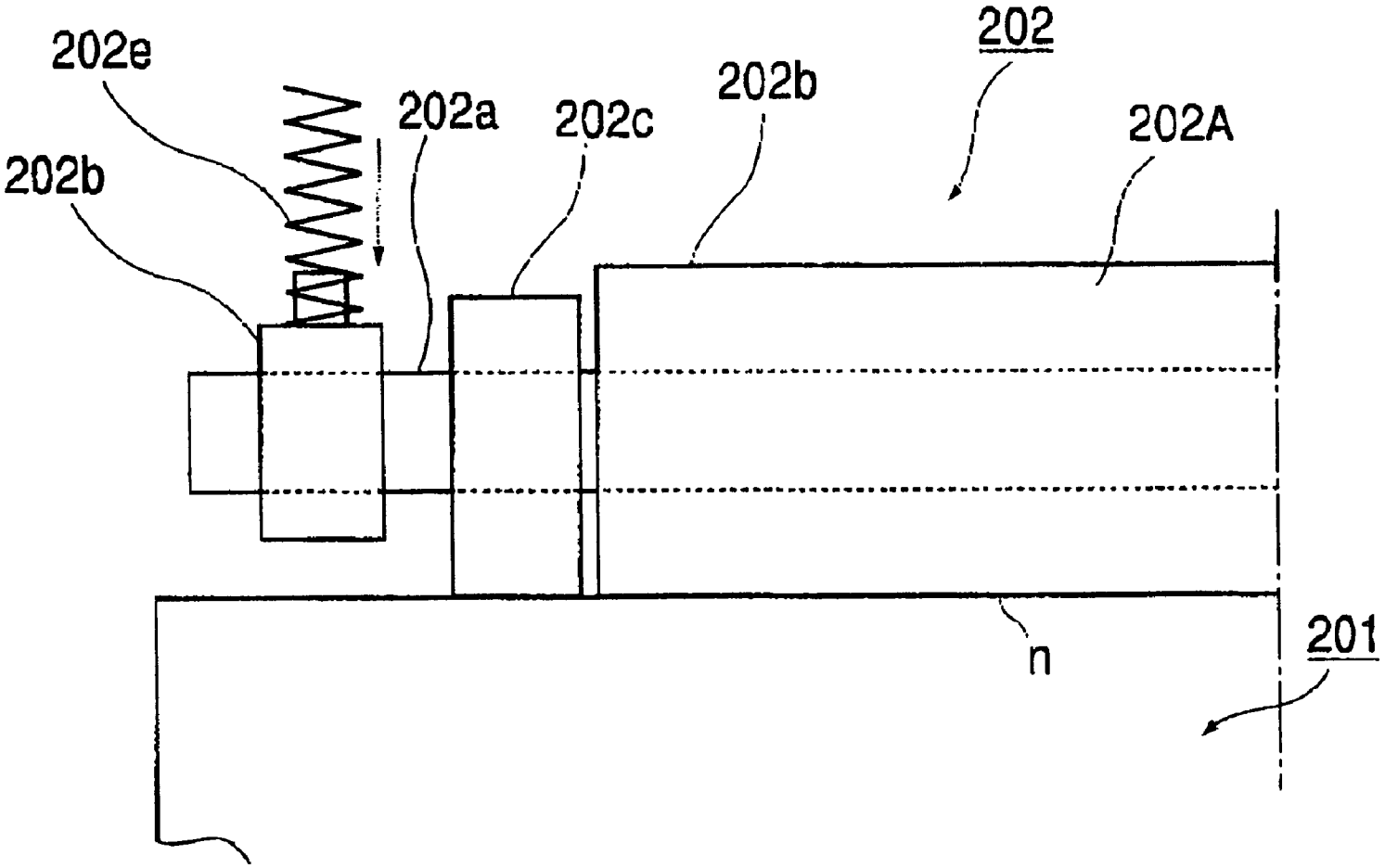
FIG. 10 is an enlarged schematic view of one of the lengthwise ends of a charge roller.
Figure 11:
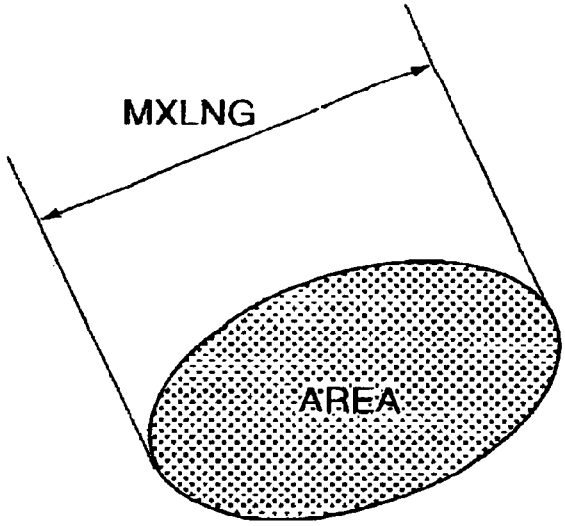
FIG. 11, consisting of FIGS. 11(*a*) and 11(*b*) are the pictorial definitions of the shape coefficients SF-1 and SF-2 of a toner particle.
Figure 11:
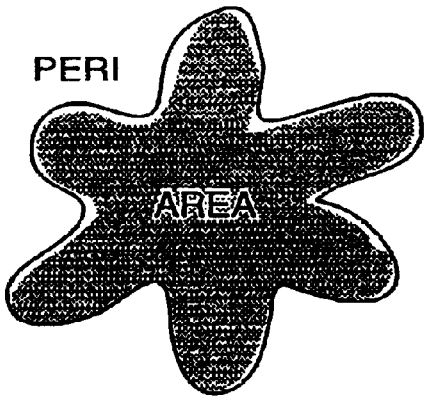

FIG. 9 is a schematic sectional view of the image forming apparatus in this embodiment of the present invention, and shows the general structure thereof. This image forming apparatus is a laser printer which employs a transfer type electrophotographic process, a direct injection type charging method which uses nonmagnetic charging particles, a noncontact developing method using nonmagnetic toner, and a toner recycling process (cleanerless system).

[General Structure of Printer]

A referential code 201 designates an image bearing member. In this embodiment, it is a negatively chargeable organic photoconductive member (negative photoconductive member which hereinafter will be referred to as "photoconductive drum") in the form of a rotational drum with an external diameter of 30 mm, and is rotationally driven in the clockwise direction indicated by an arrow mark at a constant peripheral velocity of 100 mm/sec (process speed PS; printing speed).

Designated by a referential code 202 is a charging apparatus, which is a contact charging apparatus employing nonmagnetic charging particles. This charging apparatus 202 has a charge roller 202A as a contact type charging member, and a charge bias application power source S1 for the charge roller 202A.

The charge roller 202A comprises a metallic core 202*a,* an elastic layer as a charging particle bearing member 202*b*, and a layer of charging particles m (electrically conductive nonmagnetic particles) held to the peripheral surface of the elastic layer. The charging particle bearing member 202*b* is in the form of a roller, and is formed of rubber or foamed substance. It is integrally and coaxially fitted around the metallic core 202*a*. Its electrical resistance is in the middle range.

The charge roller 202A is placed in contact with the photoconductive drum 201 in such a manner that it appears as if the charge roller 202A penetrates a predetermined distance into the photoconductive drum 201, and that a predetermined amount of contact pressure is generated between the charge roller 202A and photoconductive drum 201. As a result, a charging nip n with a predetermined width (in terms of the circumferential direction of the charge roller 202A) is formed. More precisely, the charging particles m held to the peripheral surface of the charge roller 202A contact the peripheral surface of the photoconductive drum 201, in the charging nip n.

The charge roller 202A is rotationally driven in the clockwise direction indicated by the arrow mark, as is the photoconductive drum 201. Thus, in the charging nip n, the peripheral surface of the charge roller 202A rotates in the direction opposite (counter) to that in which the photoconductive drum 201 rotates. Therefore, there is a difference in peripheral velocity between the peripheral surface of the elastic layer 202*b* and the peripheral surface of the photoconductive drum 201, with the presence of charging particles m between the two surfaces.

The speed differences between the peripheral surface of the charge roller 202A relative to the peripheral surface of the photoconductive drum 201 can also be provided by rotating the charge roller 202A in the direction opposite to the direction in which the charge roller 202A is rotated in this embodiment (the same direction as the rotational direction of the photoconductive drum 201). However, the charging performance in a direct injection type charging method is dependent upon the ratio between the peripheral velocities of the photoconductive drum 201 and charge roller 202A. Therefore, rotating the charge roller 202A in the same direction as the photoconductive drum 201 is advantageous in terms of revolution. In other words, it is preferable that an image forming apparatus in accordance with the present invention is structured so that the charge roller 202A is rotated in the same direction as the photoconductive drum 201.

While an image is recorded by the image forming apparatus, a predetermined charge bias is applied to the metallic core 202A of the charge roller 202A from the charge bias application power source S1.

As a result, electrical charge is directly injected into the peripheral surface of the photoconductive drum 201, uniformly charging the peripheral surface of the photoconductive drum 201 to predetermined polarity and potential level. In this embodiment, a DC voltage of −700 V was applied to the metallic core 202*a* of the charge roller 202A from the charge bias application power source S1. As a result, the peripheral surface of the photoconductive drum 201 was charged to a potential level virtually identical to the potential level of the charge bias applied to the metallic core 202*a*.

A referential code 204 designates a laser scanner (exposing apparatus) comprising a laser diode, a polygon mirror, and the like. The laser scanner 204 outputs a beam of laser light L modulated with sequential electrical digital signals reflecting the data of an intended image, in such a manner that the laser beam L scans, exposing thereby, the uniformly charged peripheral surface of the photoconductive drum 201 being rotationally driven.

As the result of the exposure of the peripheral surface of the rotating photoconductive drum 201 by the scanning laser beam L, an electrostatic latent image in accordance with the data of the intended image is formed on the peripheral surface of the photoconductive drum 201.

A referential code 205 designates a developing apparatus, which is a reversal type developing apparatus which uses single-component nonmagnetic toner (negative toner). The electrostatic latent image on the peripheral surface of the photoconductive drum 201 is developed into a toner image, in a development station a, by this developing apparatus 205. In the developing apparatus 205, a mixture of toner t, as developer, and charging particles m, is stored.

Designated by a referential code 206 is a transfer roller as a contact type transferring means (transfer charging device), the electrical resistance of which is in the medium range. It is placed in contact with the photoconductive drum 201 with the application of a predetermined amount of pressure, forming a transfer nip b. To this transfer nip b, a transfer medium p (recording paper) is fed from an unshown sheet feeding station, with a predetermined timing, while a predetermined transfer bias is applied to the transfer roller 206 from a transfer bias application power source S3. As a result, the toner image on the photoconductive drum 201 is continually transferred onto the transfer medium p being passed through the transfer nip b.

The transfer roller 206 in this embodiment comprises a metallic core 206*a,* and a surface layer 206*b*. The surface layer 206*b* is formed of foamed substance, and its electrical resistance is in the medium range. The electrical resistance of the transfer roller 206 is $5\times10^8$ ohm. In order to transfer the toner image on the photoconductive drum 201 onto the transfer medium p, a voltage of +2.0 kV is applied to the metallic core 206*a*. After being introduced into the transfer nip b, the transfer medium p is conveyed through the transfer nip b, while being sandwiched by the top and bottom portions of the transfer nip b. While the transfer medium p is conveyed through the transfer nip b, the toner image, which has been formed, and borne, on the peripheral surface of the photoconductive drum 201, is continually transferred onto the transfer medium p by the electrostatic force and mechanical pressure.

A referential code 207 designates a fixing apparatus employing a thermal fixing method or the like. After the transfer medium p is fed into the transfer nip and the toner image on the photoconductive drum 201 is transferred onto the recording medium p, the recording medium p is separated from the peripheral surface of the photoconductive drum 201, and is introduced into the fixing apparatus 207, in which the toner image is permanently fixed to the recording medium p. Thereafter, the recording medium p with the permanently fixed toner image is discharged as a print or copy from the apparatus main assembly.

(3) Charge Roller 202A

As described above, the charge roller 202A as a contact type charging member of the charging apparatus 202, comprises a metallic core 202*a,* an elastic layer 202*b* as a charging particle bearing member, and a layer of charging particles m (electrically conductive particles) coated in advance on the peripheral surface of the elastic layer 202*b*. The charging particle bearing member 202*b* is in the form of a roller, and is formed of rubber or foamed material. It is integrally and coaxially fitted around the metallic core 202*a*. Its electrical resistance is in the middle range.

The elastic layer 202*b* with an medium electrical resistance is formed of a mixture of resin (for example, urethane), electrically conductive particles (for example, carbon particles), sulfurizing agent, foaming agent, and the like; it is in the form of a roller fitted around the metallic core 202*a*. The peripheral surface of the charge roller 202A is polished. More precisely, the charge roller 2A is an electrically conductive elastic roller comprising: a metallic core 2*a,* which is 6 mm in external diameter and 240 mm in length, and a sponge layer which is 12 mm in external diameter and 220 mm in length.

The measured electrical resistance of the charge roller 202A in this embodiment was 100 k.ohm. As for the method used for measuring the electrical resistance of the charge roller 202A, the charge roller 202A was directly pressed upon an aluminum drum with an external diameter of 30 mm so that an overall load of 9.8 N (1 kg) acted upon the charge roller 202A, and the electrical resistance of the charge roller 202A was measured by applying a voltage of 100 V between the metallic core 202A and aluminum drum.

It is important that the charge roller 202A, which is a contact type charging member, also functions as an electrode. Thus, not only must the charge roller 202A be provided with elasticity to be kept optimally in contact with an object to be charged, but it also must have an electrical resistance low enough to charge a moving object. On the other hand, in consideration of possibility that an object to be charged may have a pinhole or the like, that is, a portion defective in terms of voltage resistance, the electrical resistance of the charge roller 202A is desired to be in a range of $10^4$–$10^7$ ohm so that satisfactory charging performance as well as leak resistance can be realized.

The peripheral surface of the charge roller 202A is desired to be provided with microscopic irregularities so that the charging particles m can be retained by the charge roller 202A.

As for the hardness of the charge roller 202A, if it is too low, the charge roller 202A is unstable in its shape, and therefore, the charge roller 202A fails to remain properly in contact with an object to be charged. On the other hand, if it is too high, not only is it impossible to form a charging nip n between the charge roller 202A and the object to be charged, but also the charge roller 202A is undesirable in terms of the microscopic contact between the charge roller 202A and the object to be charged. Further, from the viewpoint of the mechanical stress upon toner particles, the state of contact between the charge roller 202A and the object to be charged, is desired to be uniform and soft. More concretely, the hardness of the charge roller 202A is desired to be in a range of 15 degrees to 50 degrees, preferable, in a range of 20 degrees to 40 degrees, in Asker C scale. In this embodiment, a charge roller with a hardness of 30 degrees in Asker C scale was used as the charge roller 2A.

As for the material for the charge roller 202A, it does not need to be limited to foamed elastic material. It may be EPDM, urethane, NBR, silicone rubber, or a rubbery material made by dispersing electrically conductive substance such as carbon black or metallic oxide in IR or the like to adjust electrical resistance. Further, it may be the materials created by foaming the above listed materials. The electrical resistance can be adjusted by using an ion conductive substance, instead of dispersing an electrically conductive substance.

The charge roller 202A is directly pressed upon the photoconductive drum 201 against the elasticity of the photoconductive drum 201, with the application of a predetermined pressure, so that the charging nip n, which is several millimeters wide in this embodiment, is formed.

FIG. 2 is a side view of one end of the charge roller 202A and its adjacencies, for showing in detail the relationship between the charge roller 202A and photoconductive drum 201. The charge roller 202A is provided with a pair of rotational members 202*c* (spacer rings), which are rotationally fitted around the lengthwise end portions of the charge roller 202A to regulate the distance between the metallic core 202*a* and the peripheral surface of the photoconductive drum 1. These rotational members 202*c* are 5.7 mm in radius. There is a difference of 0.3 mm between the radius of the rational member 202*c,* or 5.7 mm, and that of the charge roller 202A, or 6.0 mm, before the rotational members are fitted.

The charge roller 202A is disposed in parallel with the photoconductive drum 201, with the lengthwise ends of the charge roller 202A being rotationally supported by a pair of bearings 202*d,* one for one. The pair of bearings 202*d* are kept under the pressure from a pair of springs 202*e*, one for one, so that the charge roller 202A is pressed upon the photoconductive drum 201 against the elastic and medium resistance layer 202*b* of the charge roller 202A to cause the pair of rotational members 202*c* to be kept in contact with the photoconductive drum 201.

With the provision of the above structural arrangement, the difference between the radius of the rotational member 202*c,* or 5.7 mm, and the radius of the charge roller 202A, or 6.0 mm becomes the depth by which the charge roller 202A hypothetically penetrates into the photoconductive drum 201, and the charging nip n with a predetermined width is formed.

In this embodiment, the charge roller 202A is rotationally driven in the clockwise direction indicated by an arrow mark at approximately 160 rpm so that the peripheral surfaces of the charge roller 202A and photoconductive drum 201 move at a constant speed in the mutually opposing directions, in the charging nip n. In other words, it is arranged so that the peripheral surface of the charge roller 202A as a contact type charging member moves relative to the peripheral surface of the photoconductive drum 201 with the presence of velocity difference between the two. The charge roller 202A as a contact charging member in accordance with the present invention is required to bear the charging particles m at a high density, and therefore, it is necessary for the peripheral surface of the charge roller 202A to be rough to a certain degree. More concretely, the average roughness Ra of the peripheral surface of the charge roller 202A is desired to be in a range of 1 $\mu$m to 500 $\mu$m.

If the average surface roughness Ra of the charge roller 202A is no more than 1 $\mu$m, the surface area of the charge roller 202A will not be large enough to satisfactorily bear a proper amount of the charging particles m. Also in such a case, if an electrically insulative particle (for example, toner particle) adheres to the peripheral surface of the charge roller 202A, the portion of the peripheral surface of the charge roller 202A, immediately adjacent to the electrically insulative particle, falls to contact the photoconductive drum, reducing the charging performance.

Further, in consideration of the particle bearing capacity of the charge roller 202A, the average surface roughness Ra of the charge roller 202A is desired to be greater than the average particle diameter of the charging particles.

On the contrary, if the average surface roughness Ra of the charge roller 202A is no less than 500 $\mu$m, the roughness of the peripheral surface of the charge roller 202A reduces the degree of uniformity with which the peripheral surface of the photoconductive drum is charged. The average surface roughness Ra in this embodiment was 50 $\mu$m.

The configuration and average roughness Ra of the peripheral surface of the charge roller 202A are indirectly measured with the use of surface shape measurement microscopes VF-7500 and VF-7510 (Keyence, Co. Ltd.), along with an object lens with a power range of 250 times to 1250 times.

(3) Charging Particle Amount and Coverage Ratio

The amount by which the charging particles m are borne on the peripheral surface of the charge roller 202A must be made appropriate by adjusting the average roughness Ra of the peripheral surface of the charge roller 202A. More specifically, the value obtained by dividing the charging particle amount on the charge roller 202A by the average roughness Ra of the charge roller 202A is desired to be in a range of 0.05 to 1.00 mg/cm$^2$/$\mu$m, preferably, in a range of 0.02 to 0.3 mg/cm$^2$/$\mu$m.

However, the image recording apparatus in this embodiment is structured to recycle toner. Therefore, a larger amount of toner contaminates the charge roller surface. In order for a toner particle to retain triboelectrical charge on its surface, it must be provided with an electrical resistance of no less than $10^{13}$ ohm.cm. As the charge roller 202A is contaminated by the toner particles, the charging performance of the charge roller 202A reduces due to the increase in the electrical resistance of the particles on the charge roller 202A. Thus, even if the electrical resistance of the charging particles is low, as the toner particles t mix into the mixture of the charging particles and toner particles t borne on the charge roller 202A, the electrical resistance of the mixture increases, adversely affecting the charging performance of the charge roller 202A. Therefore, even if the value obtained dividing the charging particle amount on the charge roller 202A by the surface roughness Ra is in a range of 0.005–1.00, preferably, in a range of 0.02–0.30 mg/cm$^2$/$\mu$m, a large amount of toner particles is sometimes among the charging particles, naturally reducing the charging performance of the charge roller 202A. In such a case, the electrical resistance of the particle mixture on the peripheral surface of the charge roller 202A is higher than when the amount of the toner particles among the charging particles is smaller, and therefore, the occurrence of such a case can be detected. In other words, during an actual image forming operation, the charging particles (inclusive of toner particles, paper dust, and the like) borne on the charge roller 202A can be measured with the use of the above described method. The thus obtained value needs to be within a range of $10^{-1}$–$10^{12}$ ohm.cm, preferably, in a range of $10^{-1}$–$10^{10}$ ohm.cm.

Further, in order to grasp the amount of the charging particles m effective during a charging process, it is even more important to adjust the coverage ratio of the charging particles m. Since a charging particle m is white, it is easy to distinguish from a magnetic toner particle which is black. Thus, the ratio of the white area is calculated with the use of a microscope. When the coverage ratio is no more than 0.1, even if the peripheral velocity of the charge roller 202A is increased, the charging performance of the charge roller 202A does not recover. Therefore, the coverage ratio by the charging particles m should be kept within a range of 0.2–1.0.

Basically, the amount by which the charging particles m are borne on the charge roller 202A is adjusted by adjusting the amount of the charging particles m added to the developer t within the developing apparatus 205. If necessary, it is adjusted by placing an elastic blade in contact with a part of the peripheral surface of the charge roller 202A. This placement of the elastic blade is effective to rectify the polarity of the tribo-electrical electrical charge of a toner particle, as well as to adjust the amount by which the particles on the charge roller 202A are left on the charge roller 202A.

a) Particle Amount and Resistance Measurement

Washing liquid was concocted by mixing ethanol and water at a ratio of 1:2, and was placed in a ultrasonic washer. Then, a charge roller was repeatedly washed in the ultrasonic washer. During the intervals of the repeated washing of the charge roller, the peripheral surface of the charge roller was examined with the use of an optical microscope to assure that the particles adhering to the peripheral surface of the charge roller were completely removed. If necessary, the peripheral surface of the charge roller was scraped by a blade or the like.

After the repeated washing of the charge roller, the washing liquid was left for one to two hours. Then, after the pure supernatant washing liquid was removed, the residue was thoroughly dried at 105 deg. to procure the particles which had been on the charge roller.

The electrical resistance of the particles was measured using the tablet method described previously.

The amount of the particles which had been on the peripheral surface of the charge roller was obtained as the amount of the particles per unit area of the peripheral surface of the charge roller, from the total weight of the thus procured particles and the size of the peripheral surface of the charge roller 202A (which were calculated from the length and external diameter of the charge roller).

b) Measurement of Coverage Ratio

Coverage ratio was measured as the size of the total area of the peripheral surface of the charge roller covered with charging particles, with the use of a microscope, while keeping the charge roller under a condition similar to when the charge roller was placed in contact with the photoconductive member. More specifically, the application of charge bias was stopped, and the rotation of the photoconductive drum 1 and charge roller 202A was also stopped. Then, the peripheral surfaces of the photoconductive drum 201 and charge roller 202A were photographed by a video-microscope OVM1000N (Olympus Optical Co., Ltd.) and a digital still recorder SR-3100 (Deltis Co., Ltd.). The charge roller 202A was placed in contact with a slide glass in the same manner as it was placed in contact with the photoconductive drum 201, and the interface between the charge roller 202A and slide glass was photographed through the slide glass by the video-microscope fitted with an object lens with a power of 1000×. Then, the areas coated with the charging particles are identified by comparing the color or luminance of the areas covered with the particles, with the color and luminance of the charging particles obtained in advance. Then, the ratio of the total area covered with the charging particles to the size of the interface was calculated, and this ratio was used as the ratio of the charging particle coverage over the peripheral surface of the charge roller 202A. When color based identification was difficult, the substances on the peripheral surface of the roller were examined with the use of a fluorescent X-ray analysis apparatus System 3080 (Rigaku Denki Kogyo Co., Ltd.). First, a piece of adhesive tape No. 555 (#25) (Nichiban Co., Ltd.) was placed between the charge roller in the initial state in which only the charging particles were on the charge roller, and photoconductive drum, with the adhesive side of the tape facing the roller, and the tape was passed once through the nip between the drum and roller, by rotating the drum and roller, the roller being rotated by the rotation of the drum. While the tape was passed through the nip, the particles on the peripheral surface of the charge roller were adhered to the surface of the tape; the charging particles on the charge roller were sampled (Sample 1). Further, the particles on the charge roller were sampled in the same manner after a printing test. The coverage ratio was obtained by determining the amount of a specific element in a charging particle. In other words, the coverage ratio was obtained by calculating the ratio of the specific element on the sample obtained after the printing test, relative to the specific element on Sample 1, that is, the tape holding only the electrically conductive particles.

(4) Developing Apparatus 205

The developing apparatus 205 in this embodiment is a reversal type developing apparatus which employs a non-contact developing method which uses nonmagnetic toner, as described before. Within the developer container 205*f* of the developing apparatus 205, a mixture of single-component nonmagnetic toner particles t and charging particles m is stored as developer.

Designated by a referential code 205*a* is a rotational development sleeve (development roller) as a toner bearing/conveying member. The developer (t+m) in the developer container 205*f* is borne in a layer on the rotational development sleeve 205*a*, and conveyed thereby. As the layer of developer (t+m) is conveyed on the development sleeve 205*a*, it is regulated in thickness by a regulating blade 205*c* while being electrically charged by friction.

As the development sleeve 205*a* further rotates, the developer (t+m) coated on the development sleeve 205*a* is conveyed to a development station a (development area), or the area in which the photoconductive drum 201 and development sleeve 205*a* oppose each other.

A referential code 205*d* designates a supply roller, which recovers the toner particles remaining on the development sleeve 205*a* after going through the development station a. The supply roller 205*d* also plays the role of supplying a development sleeve 205*a* with a fresh supply of developer (t+m). The supply roller 205*d* is rotationally driven so that the movement of the peripheral surfaces of the supply rollers 205*d* and development sleeve 205*a* becomes opposite to each other, at the location where the two peripheral surfaces face each other. It is desired to be formed of foamed material, for example, urethane foam. From the viewpoint of the removal and supply of the developer (t+m), the cell size of the foamed material is desired to be in a range of 100–700 μm.

Of the various problems which must be dealt with by the present invention, toner deterioration in terms of its chargeability, which occurs due to the mechanical stress upon toner particles, is of particular concern. Toner deterioration is sometimes caused by what occurs at the location where the development sleeve and supply rollers rub against each other. Thus, a supply roller is desired to have a proper degree of hardness. The proper degree of hardness for the supply roller is related to the mechanical characteristic of toner particles as well as other factors, and therefore, is difficult to set as an absolute hardness. However, it is desired that an uncompromising effort is made to assure that the hardness of a supply roller is set so that the mechanical stress caused to toner particles by the supply roller is the same as, or less than, that caused in the other parts of the apparatus. In particular, the relationship between the stress to which toner particles are subjected when a photoconductive drum is charged, and the stress to which toner particles are subjected in the interface between the charge roller and supply roller, is important. In other words, in order to prevent toner particles from being deteriorated in a developing apparatus, it is necessary to assure that the stress to which toner particles are subjected in the interface between the charge roller and supply roller is less than the stress to which toner particles are subjected when the photoconductive drum is charged. Thus, the hardness of a supply roller must be set lower than the hardness of a charge roller must be set lower than the hardness of a charge roller. More specifically, it is desired to be in a range of 5 degrees to 30 degrees, preferably, a range of 8 degrees to 15 degrees, in a rubber hardness scale (Asker C), while satisfying a mandatory condition that the hardness of a given supply roller will not exceed the hardness of the charge roller with which the supply roller is used. Designated by a referential code 205*e* is a rotational stirring member for stirring the developer (t+m) in the developer container 205*f*.

To the development sleeve 205*a*, development bias is applied from a development bias application power source S2. The development bias in this embodiment was combination of a DC voltage of −500 V, and an AC voltage which is 1,600 V in peak-to-peak voltage, 1.8 kHz in frequency, and rectangular in wave-form.

With the application of this development bias, an electrostatic latent image on the photoconductive drum 201 is developed in reverse by the toner t.

a) toner t: single-component magnetic toner, which was manufactured using an ordinary pulverization method, was used. For example, single-component magnetic toner was manufactured from a combination of styrene-acrylic resin as bonding agent, and negative charge controlling agent, through a mixing/kneading process, a pulverizing process, and a classifying process. To the thus manufactured toner, charging particles m, fluidizing agent, and the like, were added. The average particle diameter (D4) of the toner t was 7 μm.

b) charging particle m: in this embodiment, electrically conductive zinc oxide particles, which were $10^6$ ohm.cm in specific resistivity, and were 3 μm in average particle diameter, were used as charging particles (electrically conductive nonmagnetic particles). The zinc oxide particles as the charging particles m were evenly dispersed into the classified toner t at a weight ratio of 3 parts to 100 parts, with the use of a mixer, and then, the mixture was placed in the developing apparatus.

As for the materials for the charging particles m, various inorganic and organic materials, which are electrically conductive, can be used in addition to zinc oxide; for example, electrically conductive inorganic particles such as particles of metallic oxide other than zinc ozide particles, a mixture of electrically conductive inorganic particles and organic particles, or particles created by given a surface treatment to the preceding particles.

Since electrical charge is passed through the charging particles m, the specific resistance of the charging particles m needs to be no more than $10^{12}$ ohm.cm, preferably, no more than $10^{10}$ ohm.cm.

The electrical resistance of the charging particles m was measured by a tablet method, which was described before, and the obtained resistance was normalized.

In order to uniformly charge a photoconductive drum, particle diameter is desired to be no more than 10 μm. In this embodiment, when each charging particle was composed of agglutinated sub-particles (primary particles), the average particle diameter was defined as the average particle diameter of charging particles in the agglutinated form. The charging particle diameter was obtained in the following manner. No less than 100 charging particles were randomly picked out, and their maximum horizontal chord lengths were measured, by looking through a microscope. Then, the volumetric particle diameter distribution was obtained from the chord lengths. Then, the value corresponding to the fiftieth percentile of the distribution was designated as the average particle diameter.

The charging particles m may be in the form of a primary particle as well as a secondary particle, that is, a particle composed of a plurality of agglutinated primary particles. As long as the charging particles m satisfactorily function as charging particles, their constitution does not matter.

When a charging particle m is used for charging a photoconductive member, it is desired to be white or almost transparent so that it does not interfere with the exposure of the photoconductive drum for the formation of a latent image. Further, in consideration of the fact that a certain amount of the charging particles m is transferred from the photoconductive drum onto a recording medium, a charging particle m used for color recording is desired to be colorless or white. Also, in order to prevent exposure light from being scattered by the charging particles m, the particle size of a charging particle m is desired to be smaller than the picture element size. In consideration of the physical stability of the charging particle m, it is thought that the minimum size of a charging particle m should be 10 nm.

(5) Direct Injection Charging Method

The charging particles m in the mixture of the toner particles t and charging particles m, in the developing apparatus 205, transfer by an appropriate amount onto the photoconductive drum 201 during the development of an electrostatic latent image on the photoconductive drum 201.

In the transfer nip b, the toner particles, which make up the toner image on the photoconductive drum 201, aggressively transfer onto the transfer medium p by being attracted thereto by the effect of the transfer bias. However, virtually all the charging particles m on the photoconductive drum 201 remain adhered to the photoconductive drum 201. The presence of these charging particles m remaining adhered to the peripheral surface of the photoconductive drum 201 improves the efficiency with which the toner image on the photoconductive drum 201 is transferred onto the transfer medium p.

Since an image forming apparatus employing a toner recycling process does not have a cleaner, the toner particles remaining on the photoconductive drum 201 after toner image transfer, and the above described charging particles m remaining adhered to the peripheral surface of the photoconductive drum 201, are conveyed by the rotation of the photoconductive drum 201 to the charging nip n between the photoconductive drum 201, and the charge roller 202A as a contact charging member, and mix into the particles layer on the peripheral surface of the charge roller 202A.

Consequently, the photoconductive drum 201 is charged by a contact charging method, with the presence of these charging particles m in the charging nip n between the photoconductive drum 201 and charge roller 202A. Incidentally, at the beginning of a printing operation, no charging particles are supplied to the peripheral surface of the charge roller 202A, and therefore, charging performance is low. Therefore, the peripheral surface of the charge roller 202A may be coated in advance with charging particles.

With the presence of these charging particles m, even after the adhesion of toner particles to the peripheral surface of the charge roller 202A, the charge roller 202A can be kept satisfactorily in contact with the peripheral surface of the photoconductive drum 201 in terms of contact density and contact resistance. Thus, in spite of the fact that the contact charging member is a simple member such as a roller, and that the charge roller is contaminated by the transfer residual toner particles, electrical charge can be directly and satisfactorily injected into the photoconductive drum 201 by the charge roller 202A to charge the photoconductive drum 201.

More specifically, with the presence of the charging particles m on the peripheral surface of the charge roller 202A, "dense" contact is established between the charge roller 202A and photoconductive drum 201, and the charging particles m in the charging nip n between the charge roller 202A and photoconductive drum 201, rub the peripheral surface 201, leaving virtually no gap between the peripheral surfaces of the charge roller 202A and photoconductive drum 201, in the charging nip n. Thus, the process in which the photoconductive drum 201 is charged by the charge roller 202A is dominated by safe and stable direction injection, instead of electrical discharge. As a result, a high level of charging efficiency unattainable by an ordinary charge roller based charging method is attained; the photoconductive drum 201 is charged to a potential level virtually equal to the potential level of the voltage applied to the charge roller 202A.

As for the transfer residual toner particles having adhered to, or mixed into, the charge roller 202A are gradually expelled from the charge roller 202A onto the photoconductive drum 201, and reach the development station a due to the movement of the peripheral surface of the photoconductive drum 201, in which they are recovered (photoconductive drum 201 is cleaned) by the developing apparatus 205 at the same time as a latent image on the photoconductive drum 201 is developed (toner recycling process).

To describe in more detail the development/cleaning process mentioned above, the toner particles remaining on the peripheral surface of the photoconductive drum 201 after toner image transfer are recovered by fog removal bias Vback, that is, difference in potential level between the DC voltage applied to the developing apparatus 205 and the surface potential of the photoconductive drum 201, while the latent image formed by charging and exposing the photoconductive 201 during the immediately following rotation of the photoconductive drum 201 is developed during the same rotation of the photoconductive drum 201.

In the case of a printer such as the printer in this embodiment, which employs a reversal developing method, the development/cleaning process is carried out by the electrical field for recovering the toner particles on the dark potential areas of the photoconductive drum 201 onto the development sleeve 205*a*, and the electrical field for adhering the toner particles on the development sleeve 205*a* onto the light potential areas of the photoconductive drum 201.

Even if a certain amount of charging particles m fall off from the charge roller 202A, as the image forming apparatus is operated, the charging particles m contained in the developer (t+m) in the developing apparatus 205 move onto the peripheral surface of the photoconductive drum 201, and then are carried to the charging nip n through the transfer nip b by the rotation of the photoconductive drum 201. In other words, the charge roller 201A is continuously supplied with the charging particles m. Therefore, the excellent charging performance of the charge roller 202A for which the presence of the charging particles m is responsible, remains stable.

Thus, it is possible to provide an image forming apparatus, which employs a direct injection type charging method, a transfer type image forming method, a toner recycling process, and such a contact charging member as the charge roller 202A, and yet is capable of directly and satisfactorily injecting electrical charge into such a photoconductive drum as the photoconductive drum 201 with the application of low voltage and without generating ozone, for a long period of time, in spite of the contamination of the charge roller by the transfer residual toner particles. In other words, it is possible to provide an image forming apparatus which is simple in structure, inexpensive, and yet is capable of uniformly charging a photoconductive member, and does not cause problems associated with ozone products or faulty charging of the photoconductive member.

In particular, in this embodiment, the charging performance of the charge roller 202A is stabilized by supplying the charging particles m from the developing apparatus 205 to the charge roller 202A by way of the photoconductive drum 201. In other word, by employing such toner particles t that are nonmagnetic as the charging particles m, the imbalance, which occurs between the amounts of the charging particles m and toner particles t, is reduced; in particular, the charging particles m are prevented from being excessively supplied during the initial stage of a printing operation.

By providing velocity difference between the peripheral surfaces of the charge roller 202A and photoconductive drum 201, the frequency with which the charging particles m come in contact with the peripheral surface of the photoconductive drum 201, in the charging nip n between the charge roller 202A and photoconductive drum 201, can be drastically increased, improving the state of contact between the peripheral surfaces of the charge roller 202A and photoconductive drum 201, so that electrical charge can be easily injected.

Regarding the structure for providing the velocity difference, in order to make the transfer residual toner particles on the peripheral surface of the photoconductive drum 201, which are being carried to the charging nip n, to be temporarily recovered by the charge roller 202A, it is desired that the charge roller 202A be rotationally driven in such a direction that the moving direction of its peripheral surface becomes opposite to the moving direction of the peripheral surface of the photoconductive drum 201, in the charging nip n. This is because by temporarily tearing away the transfer residual toner particles on the photoconductive drum 201 by rotating the charge roller 202A in the direction opposite to the rotational direction of the photoconductive drum 201, in the charging nip n, electrical charge can be directly injected at a superior level.

(6) preservation of Development Characteristic

In a toner recycling process, the transfer residual toner particles, that is, the toner particles which moved onto the peripheral surface of a photoconductive drum and remained there, are rejuvenated through the charging apparatus 202 to be used for the following development process. Development performance sometimes declines due to the accumulation of deteriorated toner particles in the developing apparatus. However, according to the present invention, in order to prevent the recovery of deteriorated toner particles, the recovery of the toner particles t by magnetic force into the developing apparatus, and the resultant deterioration of the toner in the developing apparatus, are prevented by the employment of nonmagnetic toner t. Therefore, the performance of the developing apparatus 5 is kept at a satisfactory level for a long period of time. In particular, in the case of a developing device employing nonmagnetic single-component toner, its performance can be maintained at a satisfactory level by preventing toner from deteriorating in the developing device, by setting the hardness of the rubber portion of a supply roller to a level no higher than the hardness of the charge roller.

EMBODIMENT 21

This embodiment is similar to Embodiment 20, except that the toner t in this embodiment is different from the toner t in Embodiment 20.

According to the present invention, toner particles t are desired to be smooth in shape, that is, perfectly spherical or approximately spherical.

By being spherical, even if the toner particles t enter the pores of the foamed, elastic, and medium resistance layer 202*b* of the charge roller 202A as the charging particle bearing member, in the charging nip n, the toner particles t can smoothly flow within or between the pores. Therefore, even after entering the pores, the toner particles t can be easily expelled from the pores by the elastic deformation of the charge roller 202A in the charging nip n, being prevented from remaining packed in the pores. Therefore, after being supplied to the peripheral surface of the charge roller 202A by way of the peripheral surface of the photoconductive drum 201, the charging particles m can be retained in the pores by a sufficient amount. In addition, it does not occur that the hardness of the charge roller 202A is changed by the packing of the toner particles into the pores. Therefore, the fluctuation of the torque of the charge roller 202A or the fusing of the toner particles to the charge roller 202A does not occur.

Further, spherical toner particles roll very easily due to their shape. Thus, in the charging nip n, they mix with the charging particles m, being rubbed thereby, while rolling. Consequently, they are uniformly charged to negative polarity by friction. For this reason, as the toner particles on the photoconductive drum 201 reach the development area a after passing through the charging nip n, they follow the electrical field formed between the photo-conductive drum 201 and development sleeve 205*a*; when a latent image is present, they can move onto the photoconductive drum 201, whereas when no latent image is present, they can move onto the development sleeve 205*a*. In other words, the development process is carried out solely by electrical charge, that is, with no influence from magnetic force.

In addition to the above described effects, by employing toner particles uniform in shape, more concretely, spherical toner particles, a transfer efficiency of approximately 100% can be attained, reducing the absolute amount of the transfer residual toner particles which reach the charging nip n.

Further, even when a large amount of uncharged toner particles reaches the charging nip n as it does immediately after the driving of the photoconductive drum 201 begins, the toner particles do not become packed in the pores in the charge roller 202A, and by allowing the photoconductive drum 201 to be rotated a predetermined length of time prior to the beginning of an actual image forming operation (by executing a pre-rotation process for a predetermined length of time), the uncharged toner particles can be charged to negative polarity and returned to the developing apparatus 205.

Even if the uncharged toner particles are expelled, they are not recovered in the development area a, and are frictionally charged by the charging apparatus. Therefore, it is assured that the developing/cleaning process is carried out at an optimal performance level for a long period of time.

In this embodiment, SF-1 and SF-2 were used as the shape factors for representing the sphericity of the toner particles.

SF-1 shows how close to being perfectly spherical the toner particles are. It is 100 when the toner particles are perfectly spherical, and the greater the value of SF-2, the farther from being perfectly spherical, that is, the more irregular in shape.

SF-2 shows how irregular the toner particles are on their surfaces. It is 100 when the toner particles are perfectly smooth on their surfaces, and the greater the value of SF-2, the more irregular the toner particles on their surfaces.

According to the results of the tests (Table 1) which will be described later, the values of SF-1 and SF-2 which are desirable for the present invention are:

$$SF\text{-}1=100-160$$

$$SF\text{-}2=100-140$$

preferably, $$SF\text{-}1=100-140$$

$$SF\text{-}2=100-120.$$

How easily the toner particles become packed is affected more by the surface irregularity of the toner particles than by the sphericity of the toner particles. Therefore, the value of (SF-2)/(SF-1) is desired to be no more than 1.0, while satisfying the above given conditions.

The values of SF-1 and SF-2 were obtained in the follow manner. One hundred toner particles were randomly sampled from a toner image using a microscope FE-SEM (S-800)(Hitachi Co., Ltd.) cretely, sphex, and their image data were fed to an image analyzer (Luzex 3) (NIKORE Co., Ltd.) through an interface to analyze the data. Then, the values of SF-1 and SF-2 were calculated from the following formulas:

$$SF\text{-}1=\{(MXLGN)^2/AREA\}\times(\pi/4)\times 100$$

$$SF\text{-}2=\{(PERI)^2/AREA\}\times(\pi/4)\times 100$$

AREA: projected area size of a toner particle,

MXLG: absolute maximum length,

PERI: circumference.

In order to charge the toner particles as uniformly as possible so that as high as possible transfer efficiency can be attained, the coefficient of variance (A) in number basis distribution is desired to be no more than 30%. The following is the definition of coefficient of variance (A):

$$\text{coefficient of variance}=(S/D1)\times 100$$

S: standard deviation value,

D1: number basis average particle diameter of toner ($\mu$m).

In order to develop microscopic dots with high fidelity to improve image quality, toner particle diameter is desired to be no more than 10 $\mu$m, preferably, in a range of 4–8 $\mu$m, in weight average particle diameter.

The number basis distribution was obtained with the use of a Coulter counter TAII (Coulter Co., Ltd.).

There are various methods for manufacturing spherical toner such as the above described one. Of those methods, methods using polymerization, for example, emulsion polymerization, suspension polymerization, dispersion polymerization, or the like, are frequently used. In addition to the methods using polymerization, there are methods in which toner particles manufactured by pulverization are made spherical by dissolving them with the use of solvent. In other words, the method for manufacturing spherical toner does not need to be limited to a specific one.

In this embodiment, a suspension polymerization was used for manufacturing the toner, a raw material comprising monomers, waxes, charger controlling agent, initiator, and the like, was suspended in a dispersing medium (usually, water) containing dispersant, to produce the toner through polymerization.

Also in this embodiment, in order to make it easier to improve and control the chargeability of the toner particles, additives other than the charging particles m were added to the toner to coat the toner surfaces. As the additives, metallic oxides (aluminum oxide, titanium oxide, strontium titanate, magnesium oxide, tin oxide, and the like), carbides (silicon carbide, and the like), metallic salts (calcium sulfide, barium sulfide, calcium carbide, and the like), fatty acid metallic salts (zinc stearate and the like), carbon black, silica, or the like, can be used. These additives may be used alone, or in a combination of two or more. In either case, each additive is desired to be made hydrophobic. In this embodiment, in addition to the charging particles m, hydrophobic silica particles were added to toner t at a weight ratio of 2 parts to 100 parts.

EMBODIMENT 22

This embodiment is similar to Embodiment 21, except that the structure of the printer 205 was changed to the following one. Otherwise, the printer structure is the same as that in Embodiment 20 or 21. Therefore, its description will be not be given here.

Figure 12:
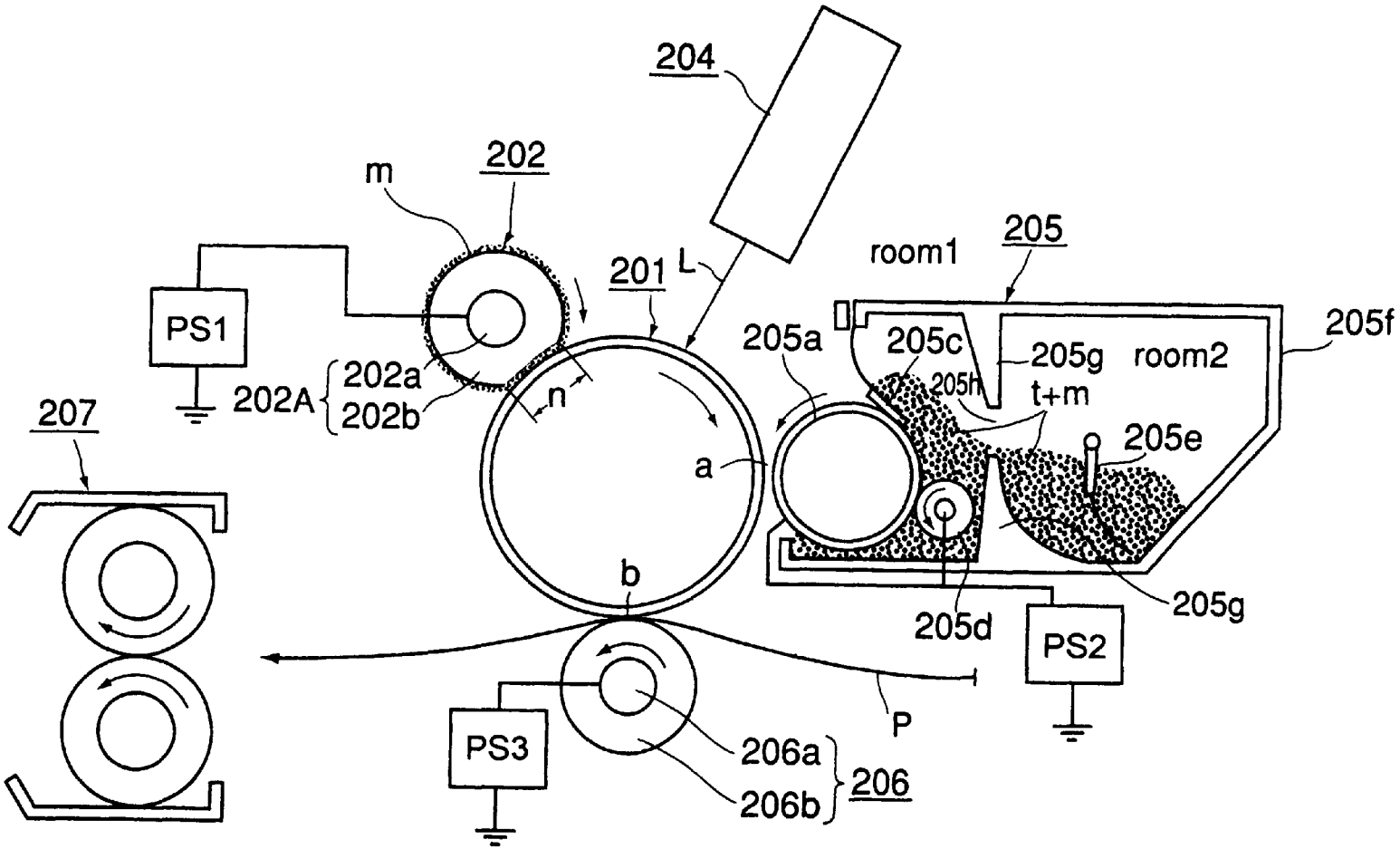
FIG. 12 is a schematic sectional view of the image forming apparatus in the third embodiment of the present invention.

Referring to FIG. 12, in this embodiment, the internal space of the developer container 205*f* is partitioned by a partitioning wall 205*g* into a first chamber (development changer), on the front side, in which a development sleeve 205*a*, a regulating blade 205*c*, and a supply roller 205*d* are disposed, and a second chamber (toner chamber) in which a stirring member 305*c* is disposed, so that the developer (t+m) in the second chamber 2 is gradually sent, by an appropriate amount, into the first chamber 1 by the movement of the stirring member 205*e*, through a passage 205*h*. Otherwise, the developing apparatus structure is the same as that of the developing apparatus 205 of the printer in Embodiment 20 or 21.

As a printing operation continues, the amount of the developer (t+m) in the first chamber 1 decreases. In coordination with the decreases, the developer (t+m) in the second chamber 2 is supplied into the first chamber 1 by rotating the stirring member 205*e*, so that the amount of the developer (t+m) in the first chamber 1 remains within a predetermined range. With this arrangement, the ratio of the charging particles m in the developer (t+m) can be kept constant.

EMBODIMENT 23

Figure 13:
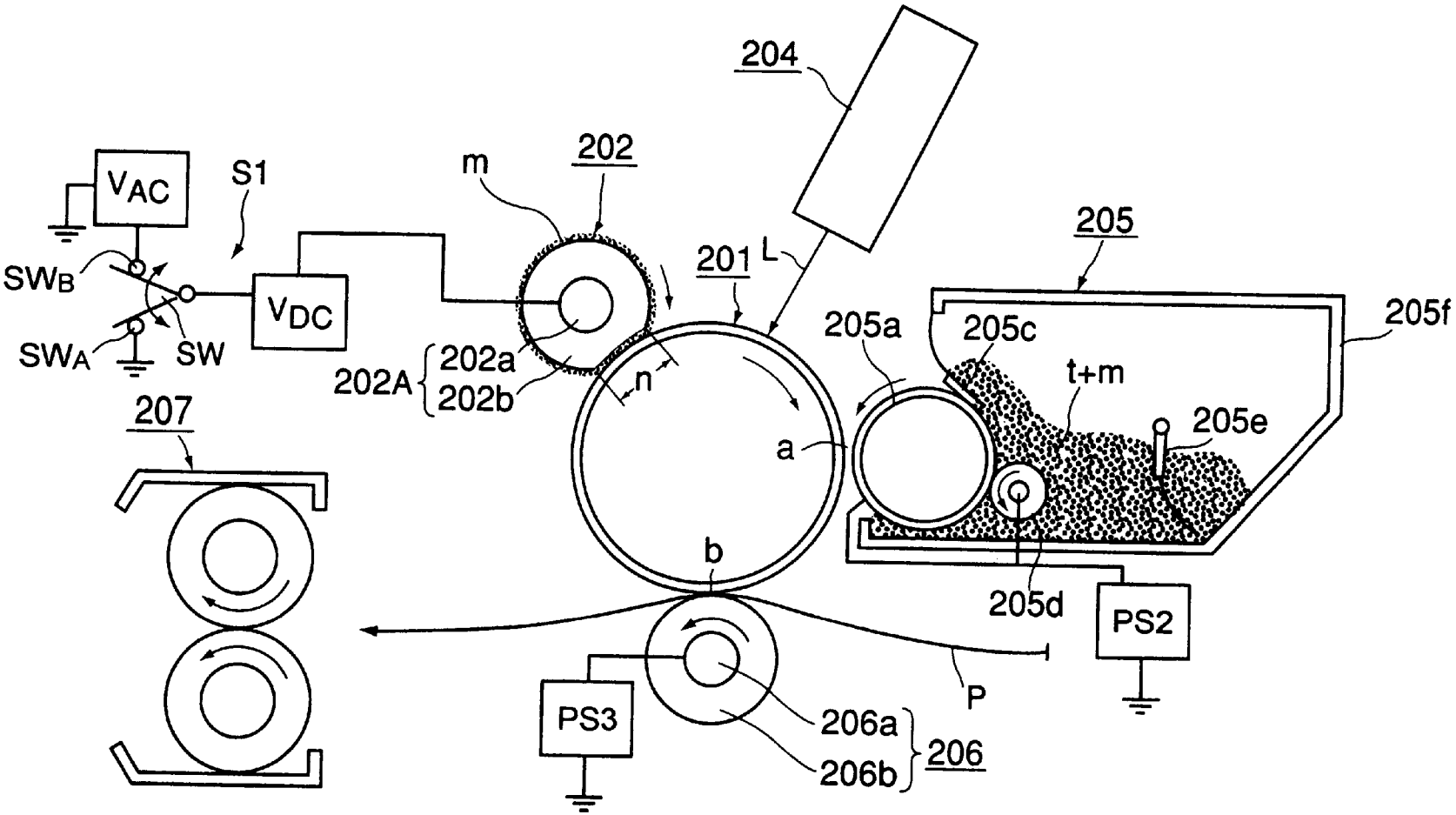
FIG. 13 is a schematic sectional view of the image forming apparatus in the fourth embodiment of the present invention.

This embodiment is also similar to Embodiment 20, except that it is provided with "charge roller cleaning mode". Referring to FIG. 13, a bias application power source S1 for the charge roller 202A comprises a DC power source Vdc, an AC power source Vac, and a circuit changing switch SW. When the switch is in connection with a contact $SW_B$, a combination of predetermined DC and AC voltages is applied to the charge roller 202A from the DC and AC power sources Vdc and Vac (B mode, charge roller cleaning mode). Otherwise, the printer structure is the same as that in Embodiment 20.

The culprits in the faulty charging of the photoconductive drum 201 are toner particles. Thus, an image forming apparatus is provided with a charge roller cleaning mode in which the transfer residual toner particles, which have adhered to, or entered, the charge roller 202A during an image forming operation, are efficiently removed from the charge roller 202A during the periods in which no image is formed, for example, during sheet intervals, so that the contamination of the charge roller 202A by the transfer residual toner particles is kept at a low level to maintain the charging performance of the charge roller 202A at a satisfactory level for a long period of time, to maintain the image forming performance of the image forming apparatus for a long period of time.

More specifically, the image forming apparatus is provided with two voltage application modes in which voltage is applied to the charge roller 202A as a contact charging member: A mode (non-cleaning mode) in which DC voltage is applied to uniformly charge the photoconductive drum 201 as an image bearing member, during periods in which an image is actually formed, and B mode (charge roller cleaning mode) in which a combination of DC and AC voltages is applied during periods in which no image is formed. The frequency of the AC voltage applied in B mode is set to be in a range of 5–500 Hz.

a) A Mode

In this mode, control is executed by an unshown sequence control circuit so that during an image forming operation of the printer, the switch SW of the charging bias application power source S1 is connected to a contact $SW_A$ to apply a DC voltage of −700 V to the metallic core 202*a* of the charge roller 202A from the DC power source Vdc. Therefore, the peripheral surface of the rotating photoconductive drum 201 is directly charged to a potential level of approximately −700 V which is virtually equal to the potential level of the DC voltage applied to the charge roller 202A, being prepared for image formation.

b) B Mode

In this mode, control is executed by the unshown sequence control circuit so that during sheet intervals, that is, periods in which no image is formed, the switch SW of the charging bias application power source S1 is connected to a contact B, to connect the DC and AC power sources Vdc and Vac in series. Therefore, a combination of a DC voltage of −700 V and an AC voltage, which is 200 V in peak-to-peak voltage, 50 Hz in frequency, and rectangular in waveform, is applied to the metallic core 202*a* of the charge roller 202A.

Also in this B mode, a combination of a DC voltage of −500 V and an AC voltage, which is 1,600 V in peak-to-peak voltage, 1.8 kHz in frequency, and rectangular in waveform, is applied to the development sleeve 205*a* of the developing apparatus 205.

By maintaining the above described bias relationship, the toner particles having been negatively charged by friction are developed onto the photoconductive drum 201 (expelling of the toner particles on the charge roller 202A onto the photoconductive drum 201), and then, the toner particles having been expelled onto the photoconductive drum 201 can be recovered by the back contrast of the developing apparatus 205.

In other words, the charging performance of the charge roller 202A is kept at a satisfactory level by effectively removing the toner particles adhering to the charge roller 202A, which are the culprits in the faulty charging of the photoconductive drum 201, during the periods in which no image is formed.

EVALUATION

(1) EMBODIMENT 20-2

Figure 14:
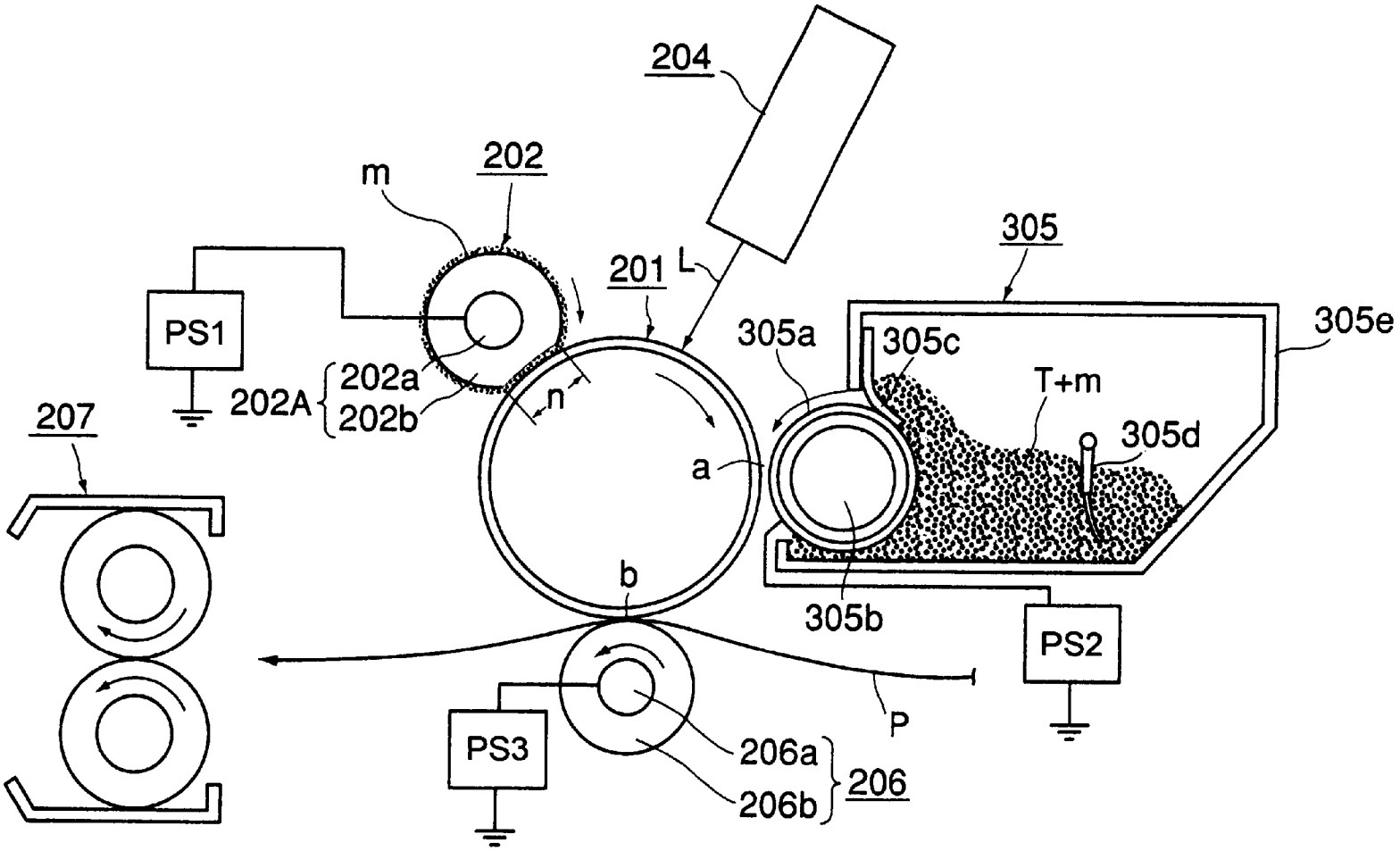
FIG. 14 is a schematic sectional view of the first comparative example of an image forming apparatus.

This embodiment is different from Embodiment 20 on the following points. FIG. 14 is a schematic sectional view of the printer in this embodiment, and shows the general structure thereof.

The printer in this embodiment is provided with a reversal type developing apparatus 305, which uses magnetic single-component toner T (negative toner) as developer, unlike the printer in Embodiment 20, which is provided with the reversal type developing apparatus 205 which uses a non-contact developing method using nonmagnetic toner. In the developer container 305*e,* a mixture of this developer T and charging particles m Is stored.

Designated by a referential code 305*a* is a nonmagnetic rotational development sleeve as a toner bearing/conveying member, in which a magnetic roll 305*b* is disposed. The developer (T+m) in the developer container 305*e* is borne in a layer on the rotational development sleeve 305*a,* and conveyed thereby. As the layer of developer (T+m) is conveyed on the development sleeve 305*a,* it is regulated in thickness by a regulating blade 305*c* while being electrically charged by friction. Designated by a referential code 305*d* is a stirring member, which gradually conveys the developer (T+m) to the adjacencies of the development sleeve while circulating the developer (T+m) in the developer container 305*e.*

The developer (T+m) coated on the rotational development sleeve 305*a* is conveyed to a development station a (development area), or the area in which the photoconductive drum 201 and development sleeve 305*a* oppose each other. To the development sleeve 305*a,* development bias is applied from a development bias application power source S2.

In this Embodiment 20-2, the development bias voltage is a combination of DC and AC voltages.

With the provision of the above arrangement, an electrostatic latent image on the photoconductive drum 201 is developed in reverse by the toner T.

a) toner T: magnetic single-component toner particles T are formed of bonding resin, magnetic particles, pigment, and electrical charge controlling agent, and are manufactured through a mixing/kneading process, a pulverizing process, and a classifying process. To the thus manufactured toner T, fluidizing agent or the like is added. The average particle diameter (D4) of the toner particles t was 7 $\mu$m.

b) charging particles m: similar to those in Embodiment 20. Mixed into the developer by weight ratio of 2 parts.

(2) EMBODIMENT 20-3

Figure 15:
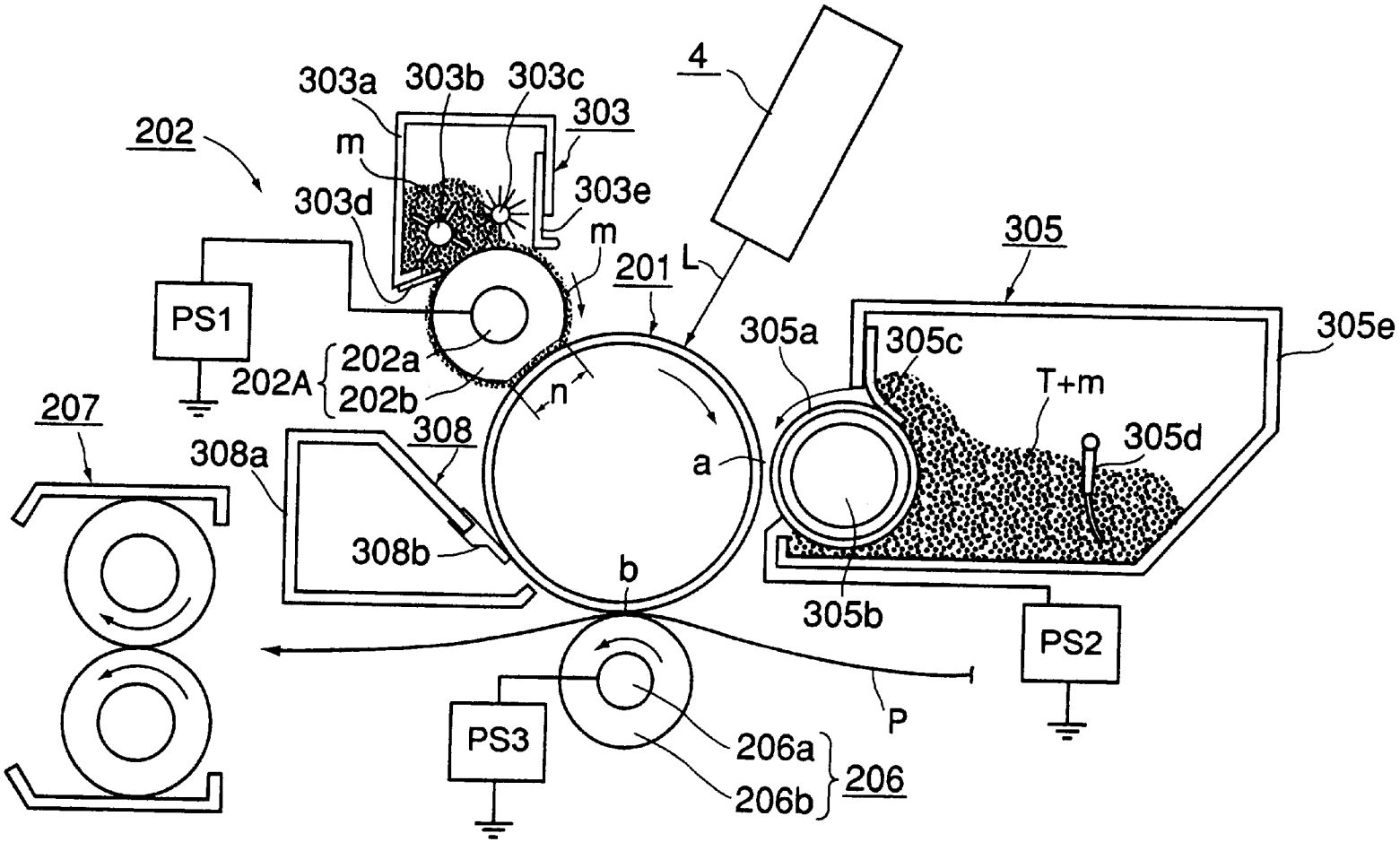
FIG. 15 is a schematic sectional view of the second comparative example of an image forming apparatus.

Unlike the printer in Embodiment 20-2, the printer in this Embodiment 20-3 is a printer which does not employ a toner recycling process, and is provided with a conventional cleaning apparatus. FIG. 15 is a schematic sectional view of the printer in Embodiment 20-3, and shows the general structure thereof.

A cleaning apparatus 308 is structured so that a cleaning blade 308*b* for scraping away the transfer residual toner particles is placed in contact with the peripheral surface of the photoconductive drum 1 and so that the transfer residual toner particles are collected in a cleaning means container 308*a.*

Further, a charging particle supplying apparatus 303 (electrically conductive particles supplying means) is placed in contact with a portion of the charge roller 202A to directly supply the charge roller 202A with the charging particles m. The charging particle supplying apparatus 303 stores the charging particles m in its housing 303*a,* and stirs the charging particles m by a stirring member 303*b,* while scraping away the excessive amount of the charging particles m by a regulating member 303*c* in the form of a fur brush. The overflowing of the charging particles m is prevented by sealing members 303*d* and 303*e.*

(3) EVALUATION RESULTS

The results of the evaluation of each embodiment is given in Table 5, and the efficacy of the present invention will be described with reference to the table.

a) Image Deterioration (fog)

Fog means a type of image defect which appears across the white areas of an image, that is, a phenomenon that a small amount of toner particles are developed (adhered) onto the areas to which no toner particles are to be adhered (areas correspondent to the unexposed areas of the peripheral surface of the photoconductive drum 201), and makes a finished image appear as if it has been soiled.

The amount of fog was measured using an optical reflectance meter TC-6DS (Tokyo Denshoku Co., Ltd.); the fog reflectance, or the difference obtained by subtracting the optical reflectance of a recording paper from the optical reflectance of a copy, was evaluated as the amount of the fog of the copy.

More specifically, the amount of fog was obtained as the average of the values obtained by sampling in optical reflectance no fewer than ten spots on a copy, the fog reflectance on the first copy made after 10,000 copies were printed, was evaluated.

b) Image Irregularity Across Solid Black Area Caused by Charging Particles

As the charging particles m, microscopic zinc oxide particles, which are white, are used. Therefore, the solid black areas of an image sometimes appear nonuniform due to the nonuniformity in the amount of the charging particles m present across the solid black areas. This phenomenon is likely to be seen during the initial stage of an image formation, in which the charging particles m is likely to be supplied by an excessive amount. Thus, the image irregularity for which the charging particles m are responsible was evaluated based on the first solid black image formed after 500 copies were printed, with reference to the following standard.

E (Excellent): amount of the charging particles m is too small to visually recognize, G (Good): amount of the charging particles m is slightly more, but is still too small to visually recognize, N (No good): amount of the charging particles m is large enough for the irregularity caused by the charging particles m to be visually recognizable.

which acts on the toner particles is essentially electrostatic force. Therefore, the deteriorated toner particles with positive charge, for example, are not immediately recovered, and can be rectified in polarity by being rubbed against the charging particles m. However, in reality, it is rather difficult

TABLE 5

| | STRUCTURE | | | | | | | PARTICLE UN- |
|---|---|---|---|---|---|---|---|---|
| | TNR/ STRUCTURE | SF-1 | SF-2 | VARIANCE COEFFICIENT | FOG INITIAL | FOG AFTER 10K | FOG Vback + 50 | EVENNESS ON SOLID BLACK |
| EMB. 20 | NON-MAG | 170 | 150 | 33 | 0.9 | 1.2 | 1.5(+0.3) | G |
| EMB. 20-2 | MAG | 170 | 150 | 33 | 1.2 | 2.4 | 2.9(+0.7) | N |
| EMB. 20-3 | MAG/CLNR | 170 | 150 | 33 | 1.2 | 1.3 | 1.6(+0.3) | G |
| EMB. 21a | NON-MAG | 110 | 105 | 30 | 0.7 | 0.7 | 0.8(±0) | G |
| EMB. 21b | NON-MAG | 120 | 120 | 23 | 0.7 | 0.7 | 0.9(±0) | — |
| EMB. 21c | NON-MAG | 120 | 140 | 30 | 0.8 | 0.9 | 1.0(+0.1) | — |
| EMB. 21d | NON-MAG | 120 | 150 | 27 | 0.8 | 1.0 | 1.1(+0.1) | — |
| EMB. 21e | NON-MAG | 140 | 120 | 25 | 0.7 | 0.7 | 0.7(±1) | — |
| EMB. 21f | NON-MAG | 140 | 140 | 30 | 0.8 | 0.9 | 1.1(+0.1) | — |
| EMB. 21g | NON-MAG | 140 | 150 | 25 | 1.0 | 1.0 | 1.1(+0.1) | — |
| EMB. 21h | NON-MAG | 160 | 140 | 25 | 0.9 | 0.9 | 1.0(+0.1) | — |
| EMB. 21i | NON-MAG | 160 | 160 | 30 | 1.0 | 1.0 | 1.1(+0.1) | — |
| EMB. 21j | NON-MAG | 165 | 140 | 25 | 1.0 | 1.0 | 1.19(+0.1) | — |
| EMB. 21k | NON-MAG | 165 | 160 | 27 | 1.0 | 1.2 | 1.4(+0.2) | — |
| EMB. 21l | NON-MAG | 170 | 150 | 30 | 1.1 | 1.2 | 1.4(+0.2) | — |
| EMB. 22 | NON-MAG/ DEV. SUPPLY | 150 | 170 | 33 | 1.0 | 1.0 | 1.1(+0.1) | E |
| EMB. 23 | NON-MAG/SEQ | 150 | 170 | 33 | 0.9 | 1.0 | 1.1(+0.1) | G |

The superior features of the present invention will be described with reference to Table 5.

1) In Embodiment 20-2, the amount of fog increased as the cumulative usage of the printer increased. There are several causes for the increases in the amount of fog; for example, the decrease in back contrast potential level, and/or developer deterioration, resulting from the failure in charging the photoconductive drum 201 to a satisfactory potential level, or the like causes. However, in the case of a conventional image forming apparatus such as the printer in Embodiment 20-3, which was provided with a cleaning blade, the amount of fog remained relatively stable throughout the operation.

Further, in Embodiment 20-2, once the developing apparatus 305 deteriorated in performance due to the accumulation of its usage, its performance in terms of fog did not recover even after the charging apparatus 202 was rejuvenated. Thus, it may be speculated that in Embodiment 20-2, it was easy for the toner particles to accumulate, because of the absence of the cleaner.

In a cleanerless system, in which the transfer residual toner particles are temporarily taken into the charging member, are normalized in triboelectrical charge, and then, are recovered into the developing apparatus, the toner particles expelled from the charging member are overwhelmingly negative in polarity. However, a certain amount of the toner particles which are improper in charge characteristics (over- or undercharged, or reverse in polarity) is also expelled. There will be no problem if these toners particles are not immediately recovered by the developing apparatus, and are returned to the charging member to be frictionally charged. However, in Embodiment 20-2, the printer employs a developing system which uses magnetic toner. Therefore, the toner particles having been expelled from the charge roller are recovered by magnetic force, accumulating as deteriorated toner particles, in the developing apparatus 305.

2) On the other hand, in the case of the nonmagnetic toner t in the embodiments of the present invention, the force to assure that absolutely no deteriorated toner particles are recovered. Therefore, it is necessary not to promote the deterioration of the toner particles which entered the developing device, in the developing device. Thus, in this embodiment, the hardness of the rubber layer of the supply roller is set to a level lower than the hardness of the charge roller, so that the promotion of the toner deterioration in the developing device is prevented. Therefore, the amount of the fog, for which toner deterioration is responsible, remains stable throughout the accumulation of the apparatus usage.

3) When this embodiment was evaluated by changing the DC value of the development bias by +50 V to widen the gap in potential level between the development bias and charge bias in order to simulate a condition in which it is easy for the toner particles reverse in polarity to be developed, the amount of fog increased in the comparative examples, proving that the amount of the toner particles reverse in polarity had increased in the comparative examples.

4) On the other hand, in Embodiment 20, no increase in fog was observed, and therefore, it is evident that toner deterioration was reduced.

5) Regarding the supplying of the charging particles m, in Embodiment 20-2, an excessive amount of the charging particles m was supplied, resulting in the nonuniformity of the solid black areas of an image, for which the charging particles m were responsible, during the initial stage of a printing operation, whereas in Embodiment 20, the nonuniformity was less.

6) Next, in Embodiment 21, the closer to being perfectly spherical the toner particles, the more properly they were frictionally charged, reducing the amount of the unsatisfactorily charged toner (undercharged and/or reversed in polarity). In addition, the adhesive force of the toner particles relative to the photoconductive drum also reduced, and therefore, the amount of fog reduced. In other words, this embodiment is also effective to reduce the amount of the fog. Further, it is effective to reduce the amount of the torque necessary to rotate the charge roller 202A, as well as to prevent the fusing of the toner particles.

Further, spherical toner particles roll very easily due to their shape. Thus, in the charging nip n, they mix with the charging particles m, being rubbed thereby, while rolling. Consequently, they can be uniformly charged to negative polarity by friction in the developing apparatus 305. For this reason, as the toner particles on the photoconductive drum 201 reach the development area a after passing through the charging nip n, they follow the electrical field formed between the photoconductive drum 201 and development sleeve 205*a;* when a latent image is present, they can be moved onto the photoconductive drum 201, whereas when on latent image is present, they can be moved to the development sleeve 205*a*. Therefore, the closer to being perfectly spherical the toner particles, the more obediently they follow the electrical field, being prevented from entering, as deteriorated toner particles, into the developing apparatus.

7) As the result of the above described effects, among Embodiments 21 to 23, the closer to being perfectly spherical the toner particles, the better results they showed. In other words, according to the results of the tests, the values of SF-1 and SF-2 which are desirable for the present invention are:

SF-1=100–160

SF-2=100–140 preferably,

SF-1=100–140

SF-2=100–120.

8) In Embodiment 22, the development performance characteristic was kept stable by keeping constant the charging particle density in the adjacencies of the development sleeve, and the charging particles m were supplied to the charge roller 202A by causing the charging particles m to stably transfer to the photoconductive drum 201. Therefore, the toner particles t were smoothly normalized in the charging process, being prevented from deteriorating. As a result, the deterioration of the performance of the developing apparatus 205 was reduced. In addition, the supplying of the excessive amount of the charging particles m was eased by keeping constant the amount of the charging particles m in the developing apparatus 205.

9) In Embodiment 23, the contamination of the charge roller 202A by toner particles was prevented. However, AC bias was applied in combination with DC bias. Therefore, both positive and negative toner particles were expelled. In the case of the conventional magnetic toner, a certain amount of the reverse polarity toner particles was also recovered, deteriorating the developing apparatus in performance. In comparison, in Embodiment 23, by employing a method using nonmagnetic toner, the toner particles could be frictionally charged by the charge roller 202A, without being immediately recovered. As a result, the printer performance was better even in terms of fog.

MISCELLANIES

1) In Embodiments 20–23, it is desired that on the peripheral surface of the photosensitive drum 201 as an image bearing member, a charge injection layer 216 is provided to adjust the electrical resistance of the peripheral surface of the photoconductive drum 201.

Figure 16:
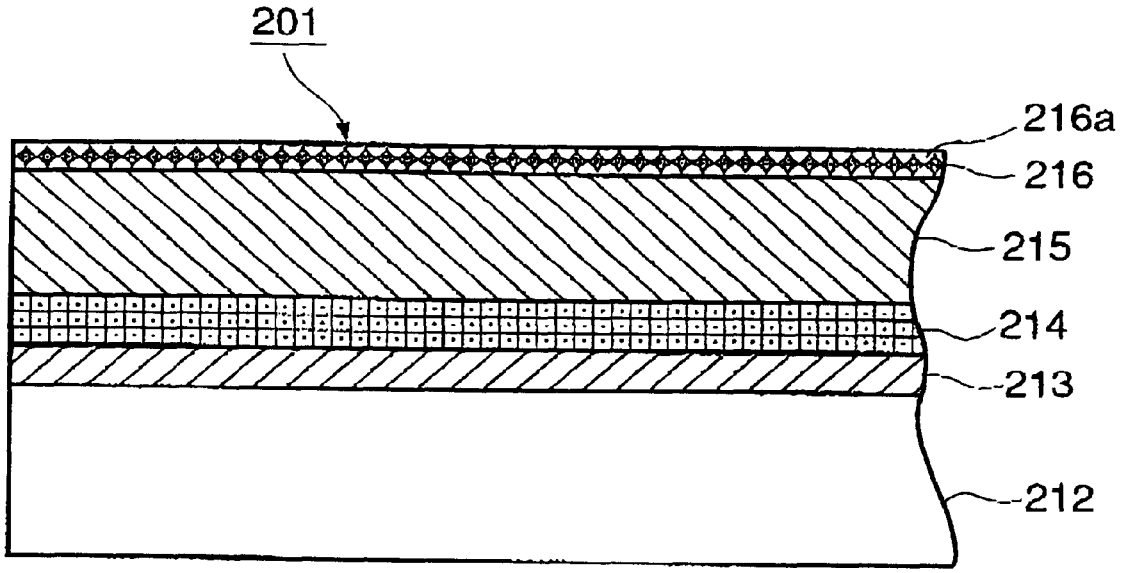
FIG. 16 is a schematic sectional view of the peripheral portion of a photoconductive member comprising a charge injection layer, and shows it laminar structure.

To describe a charge injection layer with reference to a photoconductive member employing negatively chargeable photoconductor, FIG. 16 is a schematic sectional view of the peripheral surface portion of the photoconductive drum 201, the outermost layer of which is a charge injection layer, and shows the laminar structure of the photoconductive drum 201. The photoconductive drum 201 is a combination of an ordinary organic photoconductive drum, comprising an aluminum base member 212 (aluminum drum) and three functional layers, that is, an undercoat layer 213, a charge generation layer 214, and a charge transfer layer 215, which are coated in layers on the peripheral surface of the aluminum base member 212 in the listed order, and a charge injection layer 216 coated on the charge transfer layer 215 in order to improve the chargeability of the photoconductive drum 201.

As for a method for forming the charge injection layer 216, ultramicroscopic particles 216*a* (approximately 0.03 $\mu$m in diameter) of $SnO_2$, as electrically conductive particles (electrically conductive filler), and polymerization initiator, and the like, are mixed/dispersed into photo-curable acrylic resin as binder. Then, the mixture is coated on the charge transfer layer 215, and is photo-cured, to form the charge injection film (layer) on the charge transfer layer 215.

In addition to the above listed ingredients of the charge injection layer 216, lubricant such as tetrafluoroethylene may be mixed/dispersed into the above described mixture to reduce the surface energy of the peripheral surface of the photoconductive drum 201. Such a modification is effective to reduce the overall amount by which the charging particles adhere to the peripheral surface of the photoconductive drum 201.

One of the most important aspects of the charge injection layer 216 is the electrical resistance of its surface layer. In a charging method based on the direct injection of electrical charge, the efficiency with which electrical charge is given or received can be increased by reducing the electrical resistance on the side of an object to be charged. On the other hand, if the object to be charged is a photoconductive member for image formation, it must be able to retain an electrostatic latent image for a certain length of time. Thus, a range of $1\times10^{9}$–$1\times10^{14}$ ohm.cm is proper as the range for the volumetric resistivity of the charge injection layer 216.

Further, even if a photoconductive member is not provided with the charge injection layer 216 as it is in the preceding embodiments, the effects similar to those obtained with the provision of the charge injection layer 216 can be obtained as long as the electrical resistance of the charge transfer layer 215 is within the above described range. Similar results can also be obtained with the use of a photoconductive member based on amorphous silicon or the like, the volumetric resistivity of the peripheral surface of which is approximately $10^{12}$ ohm.cm.

2) In Embodiments 20–23, magnetic toner was used, and the developing apparatuses were structured not to employ a magnet. However, from the standpoint of the gists of these embodiments, it is important to develop a latent image without using magnetic force. Even if magnetic toner is employed, it can be predicted that effects similar to those obtained with the use of nonmagnetic toner will be obtained, as long as a development process is carried out with the use of a nonmagnetic developing apparatus. On the other hand, even if the magnet of a developing apparatus is left unmodified, effective magnetic force can be reduced by reducing the amount of the magnetic substance in toner. Therefore, it is reasonable to expect to a certain extent effects similar to the effects obtained with the use of nonmagnetic toner. From the above described viewpoints, it is reasonable to expect the effects of the present invention, even from a two-component developing apparatus which uses a combination of magnetic carrier and nonmagnetic toner. In particular, from the standpoint of mechanical stress upon toner particles in a developer container, a two-component developing apparatus is superior in that a two-component developing apparatus is structured so that not only does it reduce the deterioration itself, but also, it makes it difficult for the deteriorated toner particles to accumulate.

3) These embodiments were described with reference to a developing apparatus in which a latent image was developed in a noncontact manner, that is, with a toner bearing member being kept a predetermined gap apart from an image bearing member. However, a certain amount of effect may be expected even from a contact developing apparatus which develops a latent image by placing an elastic toner bearing member in contact with an image bearing member. However, in contact development, toner particles are rubbed in the interface between an image bearing drum and a development roller, which promotes toner deterioration. From this point of view, noncontact development is preferable.

In all of the preceding embodiments, the image recording apparatus was laser printer. However, the application of the present invention is not limited to a laser printer. On the contrary, the present invention is also applicable to an image recording apparatus (image forming apparatus) other than a laser printer. For example, it is also applicable to an electrophotographic copying machine, a facsimile machine, a word processor, and the like, which is obvious.

When an image recording apparatus is an electrostatic recording apparatus, an image bearing member as an object to be charged is an electrostatically recordable dielectric member.

The shape of an image bearing member is not limited to a drum shape. In other words, an image bearing member may be in the form of an endless belt, a belt which is not endless, or a sheet.

The shape of a contact charging member is not limited to a roller shape. It may be in the form of an endless belt, a belt which is not endless, or the like.

The application of a charging apparatus in accordance with the present invention is not limited to the charging of the image bearing member (electrophotographic photoconductive member, electrostatically recordable dielectric member, and the like) of an image recording apparatus. On the contrary, a charging apparatus in accordance with the present invention is effectively usable as a charging means (inclusive of discharging means) for charging a wide range of objects, which is obvious.

While the invention has been described with reference to the structures disclosed herein, it is not confined to the details set forth, and this application is intended to cover such modifications or changes as may come within the purposes of the improvements or the scope of the following Claims.

What is claimed is:

1. A charging device for electrically charging a member to be charged, said device comprising:

charging particles including electroconductive particles having particle diameters in the range of 10 nm–10 $\mu$m; and a charging particles carrying member, which forms a nip with the member to be charged, for carrying said charging particles to the nip, wherein said charging particles have resistances in the range of $10^{-1}$–$10^{12}$ $\Omega\cdot$cm, and wherein (an amount, per unit area, of said charging particles carried by said charging particles carrying member)/(an average roughness Ra of a surface of said charging particles carrying member) is in the range of 0.005–1 mg/cm$^2$/$\mu$m.

2. A device according to claim 1, wherein a coating ratio Rc, which is a ratio of said charging particles covering said charging particles carrying member, satisfies the following condition:

$$1 \geqq Rc \geqq 0.2.$$

3. A device according to claim 1, wherein said charging particles carrying member has a surface resistance in the range of $10^4$ to $10^{10}$ $\Omega/\square$.

4. A device according to claim 1, wherein said charging particles carrying member includes an elastic member provided with a surface foam layer formed thereon.

5. A device according to claim 1, wherein said charging particles carrying member is movable with a peripheral speed difference relative to the member to be charged.

6. A device according to claim 1, further comprising charging particles supplying means for supplying said charging particles to said surface of said charging particles carrying member.

7. A device according to claim 1, wherein said charging particles carrying member includes a roller.

8. A device according to claim 1, wherein the member to be charged includes an image bearing member for bearing an image.

9. A device according to claim 1, wherein the average roughness Ra of said surface is in the range of 1–500 $\mu$m.

10. A device according to claim 1, wherein said charging particles are non-magnetic.

11. An image forming apparatus comprising:

an image bearing member;

a charging device for electrically charging said image bearing member, said charging device including charging particles including electroconductive particles having particle diameters in the range of 10 nm–10 $\mu$m; and a charging particles carrying member, forming a nip with the image bearing member, for carrying said charging particles to the nip, wherein said charging particles have resistances in the range of $10^{-1}$–$10^{12}$ $\Omega\cdot$cm, wherein (an amount per unit area of said charging particles carried by said charging particles carrying member)/(an average roughness Ra of a surface of said charging particles carrying member) is in the range of 0.005–1 mg/cm$^2$/$\mu$m.

12. An apparatus according to claim 11, further comprising developing means for developing an electrostatic image formed on said image bearing member with a developer, wherein said developing means is capable of collecting developer remaining on said image bearing member.

13. An apparatus according to claim 12, wherein the developer remaining on said image bearing member is carried on said charging particles carrying member, then transferred from said charging particles carrying member to said image bearing member.

14. An apparatus according to claim 12 or 13, wherein said developing means contains therein said developer and said charging particles, wherein said charging particles are supplied from said developing means to said image bearing member, and wherein said charging particles carried on said image bearing member are supplied to said charging particles carrying member.

15. An apparatus according to claim 12, further comprising exposure means for forming an electrostatic image by exposing said image bearing member, wherein said image bearing member includes a photosensitive member, and wherein said exposure means forms the electrostatic image by exposing said photosensitive member.

16. An apparatus according to claim 11, wherein said image bearing member includes a surface layer having a volume resistivity in the range of $1\times10^{9}$–$1\times10^{14}$ Ω·cm.

17. An image forming apparatus comprising:

an image bearing member;

a charging device for electrically charging said image bearing member, said charging device including charging particles including electroconductive particles having particle diameters in the range of 10 nm–10 μm;

a charging particles carrying member, forming a nip with said image bearing member, for carrying said charging particles to the nip; and developing means for developing an electrostatic image formed on said image bearing member with a one-component developer including a non-magnetic toner, wherein said developing means contains therein said developer and said charging particles, and wherein said charging particles are supplied from said developing means to said image bearing member, and wherein said charging particles carried on said image bearing member are supplied to said charging particles carrying member, wherein the developer remaining on said image bearing member is carried on said charging particles carrying member, and then is transferred from said charging particles carrying member to said image bearing member, wherein said developing means is capable of collecting developer remaining on said image bearing member, wherein said charging particles have resistances in the range of $10^{-1}$ to $10^{12}$ Ω·cm;

wherein (an amount, per unit area, of said charging particles carried by said charging particles carrying member)/(an average roughness Ra of a surface of said charging particles carrying member) is in the range of 0.005–1 mg/cm$^2$/μm, and wherein a coating ratio Rc, which is a ratio of said charging particles covering said charging particles carrying member, satisfies the following condition:

$$1 \geqq Rc \geqq 0.2.$$

18. An apparatus according to claim 17, wherein said developing means includes a developer carrying member, opposed to said image bearing member, for carrying a developer, and the developer carried on said developer carrying member is out of contact with said image bearing member.

19. An apparatus according to claim 18, wherein said developing means further includes a developer feeding member, contactable to said developer carrying member, for supplying the developer to said developer carrying member, and said developer feeding member has a rubber hardness, which is smaller than a rubber hardness of said charging particles carrying member.

20. An apparatus according to claim 18, wherein said developing means further includes a developer chamber in which said developer carrying member is provided, and a developer accommodating chamber for accommodating the developer and for supplying the developer to said developer chamber.

21. An apparatus according to claim 17, wherein said non-magnetic toner has a shape factor SF-1 in the range of 100–160 and a shape factor SF-2 in the range of 100–140.

22. An apparatus according to claim 17, wherein said charging particles carrying member is supplied with a DC voltage when said charging device charges said image bearing member to form an electrostatic image thereon, and wherein said charging particles carrying member is supplied with a superimposed voltage of a DC voltage and an AC voltage when said charging device does not charge said image bearing member to form the electrostatic image thereon.

23. An apparatus according to claim 17, further comprising exposure means for forming an electrostatic image by exposing said image bearing member, wherein said image bearing member includes a photosensitive member, and wherein said exposure means forms the electrostatic image by exposing said photosensitive member.

24. An apparatus according to claim 17, wherein said image bearing member includes a surface layer having a volume resistivity in the range of $1\times10^{9}$–$1\times10^{14}$ Ω·cm.

* * * * *

UNITED STATES PATENT AND TRADEMARK OFFICE

CERTIFICATE OF CORRECTION

PATENT NO. : 6,549,742 B1
DATED : April 15, 2003
INVENTOR(S) : Yasunori Chigono et al.

It is certified that error appears in the above-identified patent and that said Letters Patent is hereby corrected as shown below:

Title page,
Item [57], ABSTRACT,
Line 3, “particles” should read -- particle --.

Column 10,
Line 13, “nave” should read -- have --; and
Line 15, “infection” should read -- injection --.

Column 11,
Line 40, “Charge” should read -- charge --; and
Line 51, “form” should read -- uniform --.

Column 13,
Line 2, “infection” should read -- injection --.

Column 14,
Line 17, “Material” should read -- material --.

Column 15,
Line 3, “mere” should read -- more --;
Line 9, “an” should be deleted;
Line 38, “particle” should read -- particles --; and
Line 40, “interiors” should read -- interfere --.

Column 16,
Line 2, “2A, in” should read -- 2A. In --;
Line 24, “1 mg/cm$^2$/$\mu$an” should read -- 1 mg/cm$^2$/$\mu$m --; and
Line 26, “$\mu$m), m” should read -- $\mu$m), --.

Column 17,
Line 1, “of” should be deleted.

Column 22,
Line 30, “particles” should read -- Particles --.

Column 24,
Line 4, “(Fiar):” should read -- (Fair) --.

Column 42,
Line 9, “fall” should read -- falls --.

UNITED STATES PATENT AND TRADEMARK OFFICE

CERTIFICATE OF CORRECTION

PATENT NO. : 6,549,742 B1
DATED : April 15, 2003
INVENTOR(S) : Yasunori Chigono et al.

It is certified that error appears in the above-identified patent and that said Letters Patent is hereby corrected as shown below:

Column 43,
Line 5, “preservation” should read -- Preservation --.

Column 44,
Line 50, “follow” should read -- following --; and
Line 53, “cretely, sphex,” should read -- at 500x, --.

Column 47,
Line 34, “Is” should read -- is --.

Column 48,
Line 60, “is” should read -- are --.

Column 53,
Line 55, “Claims.” should read -- claims. --.

Signed and Sealed this

Twentieth Day of January, 2004

JON W. DUDAS
*Acting Director of the United States Patent and Trademark Office*